US012528009B1

(12) United States Patent
Uribe et al.

(10) Patent No.: US 12,528,009 B1
(45) Date of Patent: Jan. 20, 2026

(54) USES OF SPORT HAND COVERS IN THE SPORT OF GOLF

(71) Applicants: Melina Uribe, Redlands, CA (US); John Ramirez, Redlands, CA (US)

(72) Inventors: Melina Uribe, Redlands, CA (US); John Ramirez, Redlands, CA (US)

( * ) Notice: Subject to any disclaimer, the term of this patent is extended or adjusted under 35 U.S.C. 154(b) by 0 days.

(21) Appl. No.: 18/585,043

(22) Filed: Feb. 22, 2024

(51) Int. Cl.
*A63B 71/14* (2006.01)
*A41D 19/00* (2006.01)

(52) U.S. Cl.
CPC ..... *A63B 71/146* (2013.01); *A41D 19/0013* (2013.01); *A41D 2600/10* (2013.01); *A63B 2209/10* (2013.01)

(58) Field of Classification Search
CPC ..... A63B 71/146; A41D 19/0013; A41D 2600/10
USPC ..... 473/409
See application file for complete search history.

(56) References Cited

U.S. PATENT DOCUMENTS 2,975,429 A * 3/1961 Newman ..... A63B 71/146 D29/113
3,387,306 A * 6/1968 Korey ..... A63B 71/146 2/159
3,394,408 A * 7/1968 Bush ..... A63B 71/146 473/205
4,805,242 A * 2/1989 Bolton ..... A41D 19/0024 2/160
5,511,247 A * 4/1996 Block ..... A63B 71/146 2/160
6,370,693 B1 * 4/2002 Riccio ..... A41D 19/01576 2/160
6,421,836 B1 * 7/2002 Park ..... A63B 71/146 2/161.4
8,485,921 B2 * 7/2013 Ramirez ..... A41D 19/0017 473/409
9,003,569 B2 * 4/2015 Ramirez ..... A63B 71/141 2/163
10,016,671 B2 * 7/2018 Ramirez ..... A41D 19/0017
11,439,884 B1 * 9/2022 Lynn ..... A41D 19/0048
2004/0031120 A1 * 2/2004 Cherian ..... A42B 3/26 15/210.1
2004/0107476 A1 * 6/2004 Goldwitz ..... A63B 71/148 2/161.1
2007/0234466 A1 * 10/2007 Stengel ..... A41D 20/00 2/160
2010/0186140 A1 * 7/2010 Ramirez ..... A41D 19/0017 2/163
2013/0281234 A1 * 10/2013 Ramirez ..... A41F 1/06 2/161.1
2014/0373251 A1 * 12/2014 Ramirez ..... A63B 71/146 2/163
2015/0059052 A1 * 3/2015 Ramirez ..... A63B 57/353 2/163

(Continued)

FOREIGN PATENT DOCUMENTS

KR 20110103490 * 9/2011
KR 20190116768 A * 10/2019

(Continued)

*Primary Examiner* — Steven B Wong

(57) ABSTRACT

According to the various features of the present invention which will become apparent as the description thereof proceeds, the present invention provides partial hand covers and uses of hand covers, intended to increase the overall performance in sports activities.

7 Claims, 20 Drawing Sheets

(56) References Cited

U.S. PATENT DOCUMENTS

| | | | | |
|---|---|---|---|---|
| 2015/0282538 | A1* | 10/2015 | Ramirez | A41D 19/0017 2/160 |
| 2015/0290521 | A1* | 10/2015 | Ramirez | A41D 19/0017 2/161.3 |
| 2016/0074741 | A1* | 3/2016 | Ramirez | A63B 71/146 2/161.3 |
| 2016/0144265 | A1* | 5/2016 | Ramirez | A63B 57/207 2/161.3 |
| 2016/0303462 | A1* | 10/2016 | Ramirez | A63B 71/141 |
| 2016/0339325 | A1* | 11/2016 | Ramirez | A63B 71/146 |
| 2017/0080322 | A1* | 3/2017 | Ramirez | A41D 19/0013 |
| 2017/0232329 | A1* | 8/2017 | Ramirez | A41D 27/28 2/161.3 |
| 2017/0266538 | A1* | 9/2017 | Ramirez | A63B 71/141 |
| 2018/0042316 | A1* | 2/2018 | Wiseman | A63B 57/60 |
| 2018/0256965 | A1* | 9/2018 | Ramirez | A41D 19/01547 |
| 2018/0326292 | A1* | 11/2018 | Ramirez | A63B 71/146 |
| 2018/0369680 | A1* | 12/2018 | Ramirez | A63B 71/148 |
| 2019/0054364 | A1* | 2/2019 | Ramirez | A41D 19/0017 |
| 2020/0037683 | A1* | 2/2020 | Ramirez | A41D 19/01547 |
| 2020/0146373 | A1* | 5/2020 | Ramirez | A41D 19/01558 |
| 2021/0197067 | A1* | 7/2021 | Ramirez | A41D 19/01547 |

FOREIGN PATENT DOCUMENTS

| | | | | |
|---|---|---|---|---|
| KR | 20240020571 | A * | 2/2024 | |
| WO | WO-2005053801 | A1 * | 6/2005 | A63B 47/04 |
| WO | WO-2020111480 | A1 * | 6/2020 | A63B 1/146 |

* cited by examiner (Related Art)

420

421

426

423

424

427

425

(Related Art)

USES OF SPORT HAND COVERS IN THE SPORT OF GOLF

FIELD OF THE INVENTION

The present invention relates to sports apparatus and equipment, and uses thereof, used in playing the game of various sports. The present invention and its multi-sport glove embodiments significantly enhance the overall performance in athletic tasks and/or execution commonly associated during sports play, particularly in, but not limited to, football and golf by configuring to meet the specific requirements of a football quarterback's throwing hand and a golfer's dominant hand, for example. The present invention unique finger configurations completely cover the thumb and pinkie finger of a user's hand. Additionally, at least a portion of the user's forefinger, middle finger and ring finger are uncovered. Furthermore, the present invention may offer grip enhancers on the palm area, the thumb segment or on any existing finger segments. Additionally, the present invention may offer protective properties on the dorsal segment of the glove and any wrist portion thereof.

BACKGROUND OF THE INVENTION

An important goal in playing sports in to win. Often that means proper play execution, good ball control, good grip and feel, and proper form in the sports fundamentals. Gloves and other types of hand covers are permitted in most sports. Many individuals use gloves to enhance, in some way, their competitive edge. Indeed, gloves have become so important that different types of gloves have been created for different sports. Even within a sport, different types of gloves have been invented to, among other things, maximize performance in specific tasks.

In FOOTBALL, for example, there are gloves that offensive and defensive tackles can wear, that have thick padding around part of the hand. Offensive receivers can purchase more expensive, all closed-finger, thin gloves to enhance their ability to catch and grip a football.

The use of gloves in football is so widespread that nearly every football player uses them, with the notable exception of football quarterbacks. You rarely see a quarterback wear gloves, even if just to keep warm. Most quarterbacks choose to play football without gloves, especially on their dominant (throwing) hand. This is largely because prior art consists of generic full-fingered gloves which are uncomfortable and burdensome on a quarterback's throwing hand, particularly on those fingers a quarterback places over the football laces. In addition, the full-fingered gloves prevent a quarterback to have any significant 'feel' of the football.

This ability to feel is critical when playing the position of quarterback. When the quarterback receives the ball from the teammate playing the Center position, the quarterback especially during a pass play, has to quickly find the laces on the football by feeling and not looking at the football. The quarterback has to look for an open player to pass to, and cannot therefore look down at the football to find the football laces.

This need to 'feel' a ball with a hand has therefore resulted in quarterbacks having to make a difficult choice. Although clearly these players would benefit from added grip enhancers on the throwing hand to increase their passing receptions or to decrease fumbles, for example, prior art gloves force a quarterback to choose between all feel and no feel. Virtually all quarterbacks have chosen to maintain feel and therefore sacrifice the ability to better grip the football. It is no surprise that quarterback fumbles remain a significant problem in football, even at the highest performance levels, and currently remains an insoluble problem in the sport for amateurs and professionals alike.

Playing the position of quarterback without the help of gloves, however, can also be an inferior choice. An illustration by wikihow.com/Throw-a-spiral (FIG. 13) shows a conventional way to hold and throw a football where the quarterback has his middle finger and ring on top of the football laces, the Index [forefinger] finger on the strap at one end of the football and the pinkie finger at the other end, both unsupported by any football laces. Finally the thumb is placed on the bottom side of the football and is the only digital segment on the bottom side of the football. Whereas the fingers over the laces have a solid grip on the ball—primarily due to the football laces on the ball—the three digital segments off the laces (thumb, forefinger and pinkie finger) are virtually unsupported and therefore have a relatively weaker grip, creating a weak overall grip on the football.

This weak overall grip becomes more pronounced when added stress is placed on the thumb or forefinger. When a quarterback, intending to pass the football suddenly has to scramble, for example, or if the quarterback 'pumps' the ball (goes through all the motions and speed of throwing the ball but doesn't actually release the ball), the grip strength of the thumb and forefinger can determine whether or not a quarterback fumbles the football.

Unfortunately, one need only view the statistics to see that fumbles persist as an insoluble problem, even at the professional level today. In the 2010 National Football League (NFL) season, there were only ten players who had nine or more fumbles in the season. All ten players were quarterbacks (The Official NFL Record & Fact Book, 2011).

Under the 'tips' section of Wikihow.com, it further describes proper football throwing form: "A proper throw will feel like it's only utilizing the thumb, Index [forefinger], and middle finger. Good release will 'roll' off of your Index and middle finger, to impart more spin; you may snap your wrist through as you follow through to the hip. The other three fingers on your hand stabilize the ball as its being flung. They should not be used to impart spin on the ball. The most important finger to throwing a spiral is the Index finger; it is the finger that holds the most leverage in putting spin on the ball." The conventional way of playing the position of quarterback therefore requires an ability to have solid grip and control with the forefinger and thumb, fingers that are not able to be placed over the football laces; the resulting glove-less grip creates a strong hold on the ball by all the fingers except the thumb, the forefinger and the pinkie finger—the most important fingers when throwing a football. On a wet football field, during extreme weather conditions (hot or cold), that weaker or looser grip makes for a much more difficult completed pass, less success at throwing a spiral, and inconsistency and inaccuracy in passing.

Passing the ball is a significant part of the sport of football, sometimes throwing as much as 103 times in a single game (e.g., Seattle vs. San Diego, 2002). Thus, developing a solution to enhance one's ability of better controlling a football and completing a pass reception would substantially impact the sport.

There have been some attempts through the years to solve the problems of inconsistencies and turnovers in the sport of football. For example, changes have been made to the actual football in order to make the ball easier to handle. Changes to the shape and size, as well as the addition of grip enhancing materials to the ball—such as the addition of PVC dots—have made it possible to make the ball more grippable. The ability of the quarterback to maintain control of the football was still problematic because of the lack of any grip enhancing device for the player to use; gloves that could be placed on the throwing hand such that the football quarterback could now more significantly control a ball with his arm, thereby creating an overall grip of the football throughout the football. As a result of this unmet need, inconsistencies and turnovers were still high in the sport.

The introduction and subsequent proliferation in the use of gloves found some success but even with these advancements, however, fumbles and incompletes still persist today, partly because none of the prior art gloves could be useful, and are therefore inoperable, to quarterbacks.

Consequently, there is also a need for a sport glove of some kind which permits the quarterback to hold a football more securely. These problems may be addressed by providing a new sports glove that is configured to properly address the grip and feel requirements of the throwing hand of a quarterback, such as the present invention.

Quarterbacks are also now starting to intentionally run more (hereinafter called 'rushing') with the football creating an even greater need to configure a glove to meet the specific needs of a quarterback. New art is required that can offer superior grip enhancing abilities, critical not only in ball control, but also in quarterback rushing successes.

Quarterback injuries can also become a big problem in the sport. Protecting the quarterback from injury is so important that rules have been established to try and minimize those injuries. Gloves have proved useful in protecting other users playing other positions in football, but prior art gloves have not been configured for use by quarterbacks. To be sure, many quarterback injuries take place on the quarterback's throwing hand, primarily on the back portion of the hand, on the side of the hand or palm area, or on the fingers of the throwing hand.

Prior art configuration problems cease to protect a quarterback's throwing hand. As is well known, repeated exposure to hand injury can cause damage to the systems of the hand, such as the nervous system, the muscular system or the skeletal system. Therefore, there is not only an opportunity for new art, but there is an increasing concern and critical need to solve this configuration problem as not only professional quarterbacks but children and teenagers are currently playing this football position without a glove on their dominant and therefore are playing without any protection over their hand.

Consequently, there is also a need for a protective sport glove of some kind which permits the quarterback to hold a football securely and still provide adequate protection of the throwing hand against impacts from opposing players.

Over the last decade or two, quarterbacks have clearly increasingly chosen to rush for yardage and act more like a running back at times. The top five NFC Conference quarterbacks, for example, rushed for a total of 1,562 yards in the 2010 season. It is also no surprise, therefore, that there were a total of 731 fumbles in the entire NFL that season, and fully over 25% of all those fumbles were attributed to quarterbacks (2010 NFL Season). As this trend continues, especially with more popular offensive formations such as 'the wildcat' and 'spread' formation, these grip-enhancing shortcomings will undoubtedly be more pronounced. Previous failures to create gloves to support a quarterback's throwing hand, not only while throwing the football but also while rushing with the football, is becoming a growing significant problem in need of a solution at the professional level and therefore certainly at the collegiate and amateur levels.

There is therefore a need for significant advances in the sport of football to assist quarterbacks, a position that touches and controls the football more than any other position in the sport. New art needs to be offered, such as the present invention, to meet the needs of quarterbacks by developing a glove that is configured to meet the unique needs of that position.

In the field of GOLF, to be sure, there exists much prior art in the form of gloves for a golfer's weak (non-dominant) hand. In fact, most active golf players wear a glove on their weak hand, and go without a glove for their strong hand (if one were to go to any major store to buy golf gloves, they would be sold and packaged in single—one glove—not sold in pairs). Gloves are prevalent in golf largely because of the role that hand grip plays in a golfer's overall performance.

Whereas weak-hand support products seem to be crowded in the sport of Golf, there is a long existing need for a device that could offer added support for a golfer's strong hand without significantly diminishing its ability to adequately feel the golf club. Inventing a solution to this long standing problem could, among other things, allow for greater golf swing control and consistency, and create an entirely new market to support a golfer's strong-hand.

There is therefore an opportunity to invent a device that could offer some 'feel' ability for the dominant hand, while significantly enhancing the grip ability of that same hand. This would increase overall hand control of a golfer's club swing by allowing a golfer to have added grip capabilities on both hands, and therefore greater success in competition.

In Golf Magazine's April 2005 edition, golf instructor Charlie King provides an overview of how to grip a golf club. "Good golf starts with your grip. The proper hold on the club helps you do three crucial things: Hinge your wrists, control the clubface at impact and support the club throughout the swing. Here are three simple grip tips." As King continues, his third tip is "both hands; solid at the top. An effective grip sets the face square at the top, with the shaft parallel to the target line. You should feel most of the club's weight in your left thumb and right forefinger. Now you're ready to turn it loose." Although prior art seems to be crowded in offering a glove for the weak-hand to support and better control the club weight placed on the thumb of the weak hand, there remains an unmet need for added support on or around the forefinger of the ungloved strong (dominant) hand. Additionally, constant swinging of a golf club at real swing speeds often results in soreness on and between the thumb and forefinger of a golfer's strong hand wearing no glove. This soreness can often also come from the rubbing or slipping between the club handle and the portion between the thumb and forefinger of the strong hand, suggesting a need to find a way to increase the grip of a golfer's strong hand, as well as protect this hand from soreness. This is especially important in the sport of golf because even the smallest of slipping—during the golf swing or upon impact of the golf ball—can create enormous inconsistencies and inaccuracies, critical issues in determining overall performance in golf.

A further reason why golfers are not using gloves on their strong hand has to do with the fact that gloves innovations have not been effectively configured to best conform to a golfer's preferred golf grip. For example, golfers using the conventional overlapping grip method overlay their strong hand's pinkie on top of the weak hand. While this allows for some coordination between the user's two hands, the strong hand's grip on the weak hand relies principally on the strong hand's pinkie finger grip on the strong hand. The pinkie finger is a fairly weak finger, often slipping during the downswing of a golf swing.

A preferred configuration for the golfer's strong hand would be, for example, a glove which could increase the grip capabilities of the dominant hand's thumb and pinkie finger, while offering the user to maintain a high level of feel by exposing the fingertips of the forefinger, the middle finger, and the ring finger, thus offering the ability of a wearer to simultaneously have significant grip and feel of a sports apparatus such as football or golf club.

Consequently, there are clear indications that an entirely new market exists for a device that could support a golfer's strong hand. In particular, there remains an unmet need that would provide multiple benefits, such as better overall grip and more coordination with both hands during the practice or play of golf, and in various other sports activities. The present invention solves the above mentioned problems by, among other things, providing a glove configured for use on the dominant hand that can increase grip abilities on areas primarily responsible for the gripping a golf club, while allowing portions of the other fingers to be uncovered and able to maintain necessary feeling capabilities.

The golf method of golfers wearing a standard full-fingered golf glove only on their weak-hand, while increasing the overall grip of the weak hand, can also be an inferior option in that it results in a significant loss of tactile capabilities on their weak-hand. Cognizant of this major deficiency, virtually all golfers will not wear a glove on their dominant hand while gripping a golf club, presumably to compensate for the loss of tactile sensation from wearing a glove on their weak-hand. Although this method of gripping a golf club, by wearing only one golf glove, does provide some tactile sensation on the overall grip, the tactile sensation is limited to only the dominant hand. This limitation of only allowing skin contact by the dominant hand has often resulted in several problems such as: difficulty in weak-hand and dominant hand coordination because skin contact between hands is blocked by the glove; difficulty in assessing proper golf club positioning by the weak-hand throughout the golf swing; and difficulty in getting proper feedback from weak-hand sensations if one completes an improper golf swing.

It is no surprise that golfers often have difficulty landing a golf ball on the fairway, even at the highest performance levels, and currently remains an insoluble problem in the sport for amateurs and professionals alike.

There is, therefore, a long-standing need to invent a device—and improve prior art—that could offer some 'feel' ability on the weak hand, without significantly diminishing that enhanced grip ability that gloves offer. The result would of course significantly improve the current challenging method of swinging a golf club and increase overall hand control of a golfer's club swing, and greater success in competition.

One very popular golf club grip, for example, is called the interlocking grip. When you use this grip, the forefinger of the golfer's weak-hand is placed over and wrapped around the strong (dominant) hand's pinkie finger. With this grip, clearly the role of the interlocked fingers has Ito do with both grip and coordination and feel between the user's two hands to more effectively control the golf swing and to provide greater overall golf swing consistency. There is, therefore, no real need to cover all of the weak hand's forefinger, which touches the dominant hand's interlocked pinkie finger, and uncovering at least part of the forefinger would actually significantly increase overall coordination by allowing the now uncovered portion of the weak hand's forefinger to touch the skin of the dominant hand's pinkie finger. Embodiments of the present invention would therefore offer significant improvements to prior art by offering a glove which leaves at least the fingertips of the forefinger uncovered thereby offering heightened tactile sensations on the weak hand of a user.

DESCRIPTIONS OF THE INVENTION

Overview of the Present Invention

The present invention provides a glove having dorsal (back) and palmar (front) portions for overlaying respective back and palm regions of a human hand, and dorsal and palmar portions having distal and proximal ends with a plurality of digital segments (or stalls) projecting from said distal ends. The glove includes a glove body having a back portion covering at least a portion of the back of the hand, and a front portion covering the palm of the hand when the glove is worn. The glove body includes at least one finger stall (or finger digital segment) and a thumb stall (or thumb digital segment) each adapted to receive a finger or thumb, respectively, therein. The glove body is configured such that the thumb and pinkie finger digital segments completely enclose a user's thumb and pinkie finger, including enclosing their respective fingertips. Additionally, the glove body has a forefinger digital segment that is adapted to overlay the proximal phalanx and leave exposed at least the fingertip of the user's forefinger when the glove is worn. In other words, at least a portion of the user's distal phalanx will be exposed when the glove is worn such that the skin of the user's finger can touch a device or sporting object such as a football or golf club when the glove is worn. Additionally, the glove body has a middle finger digital that is adapted to overlay the proximal phalanx and leave exposed at least the fingertip of the user's middle finger when the glove is worn. In other words, at least a portion of the user's distal phalanx will be exposed when the glove is worn such that the skin of the user's finger can touch a device or sporting object such as a football or golf club. Additionally, the glove body has a ring finger digital that is adapted to overlay the proximal phalanx and leave exposed at least the fingertip of the user's ring finger when the glove is worn. In other words, at least a portion of the user's distal phalanx will be exposed when the glove is worn such that the skin of the user's finger can touch a device or sporting object such as a football or golf club. This particular digital segment glove configuration creates substantial synergies and surprising results and thereby making gloves now operable for use during sports activities such as in throwing a football or playing golf.

As will be discussed, using embodiments of the present invention now allow a football quarterback, for example, to place the throwing hand's thumb and pinkie finger—now covered by the present invention glove—on the football and significantly increasing the grip and control of the football while simultaneously maintaining maximum tactile abilities by leaving uncovered the fingertips of his forefinger, middle finger, and ring finger. This unique digital segment configuration allows the quarterback the ability to place the exposed fingertips of the user's forefinger, middle finger, and ring finger over the football laces unencumbered while simultaneously maintaining significant feel on the football. This and other features now essentially make the sports glove more operable, novel and significantly superior to prior art in these areas.

In another preferred aspect, the present invention also comprises a grip enhancing mechanism, such as a plurality of projections or a plurality of depressions, on a portion or portions of the palmar surface area of the glove, such as for example, on any thumb and finger stalls, along any portion of any metacarpophalangeal joints, and/or between the thumb and forefinger area, generally defined by the metacarpal of the forefinger and extending up along the metacarpal of the thumb, and therebetween.

The grip enhancing mechanism permits the individual to better grip a ball or an object or device, and creates a higher coefficient of friction than the surrounding palmar portion surface of the glove. In some instances a grip enhancing mechanism is adapted to create a very high coefficient of friction along the glove when it consists of a tackifier, a tackifier compound or a tackified material. The grip enhancing mechanism provides a football quarterback or a golfer for example with multiple benefits such as increased control of a ball or device thereby enhancing performance and overall success at performing a sports task. The grip enhancing mechanism of the present invention may be integral to the glove or may be affixed to the glove surface by, for example, forming a grip enhancing panel and applying the panel onto a portion of the glove.

In another preferred aspect, the present invention also comprises protective properties to protect a user from injury or to protect an injury. A shock-absorbing member or members may comprise of a padded layer or layers may be used so that the glove can be used to protect an injury or to protect an area from being injured. In general, the shock-absorbing member can comprise of conventional materials for dissipating pressure across a surface area, can have varying densities and thicknesses, and can be in the form of a layer or multiple layers. The shock-absorbing member may be flexible, compressible and/or resilient.

The shock-absorbing member or members are located on the dorsal segment of the glove, preferably covering at least a portion of the metacarpal of any of the four fingers, the thumb digital segment, on any existing finger digital segments, or any combination thereof, where many football injuries occur as a quarterback throws a football or rushes with the football. Also, some embodiments may have a shock-absorbing member or members near and around a portion or throughout the dorsal and palmar portions of the wrist area, extending up to as much as about five inches along the carpal bone of the wrist.

The thickness and dorsal surface locations of the shock-absorbing members may vary, of course, depending on preference. In at least one embodiment the entire dorsal segment comprises a shock-absorbing member, and the shock-absorbing member can be one uniform cushion, for example, mirroring the design of the dorsal segment of the glove. The shock-absorbing member is designed to dissipate pressure across the surface area and thereby protect said area from injury when impacted by the ground or from an opposing player when the glove is worn. The shock-absorbing member absorbs and dissipates impact to a significantly higher degree than the material forming the glove body dorsal portion.

Accordingly, embodiments may also provide important added shock-absorbing member features that can now protect a previously unprotected quarterback's throwing hand, for example, including the back of the hand, the thumb and fingers, and wrist areas, and combinations thereof.

The glove also provides an expandable opening means at a wrist end adapted to receive the user's hand. This may comprise of a wrist portion with a securement opening means, such as but not limited to a flap/strap which mechanically engages a flap/strap capture mechanism to secure the glove to the users hand (e.g., a synthetic hook and loop fastening interface which adheres when pressed together, commonly using VELCRO). In this case the flap could overlay a small slit or opening along a portion of the back of the hand to allow the glove to widen when a user places the glove on to the hand. Alternatively, the opening means may comprise of other standard used mechanisms of allowing a user to apply and disengage the glove, such as an elastic band material along the wrist portion, or combinations therebetween. The shock-absorbing member may generally be affixed to the outer surface of the glove dorsal segment or may be integrally formed on the glove. If integrally formed, at least one embodiment may include a liner.

Accordingly, embodiments provide a novel glove with added features that enhances overall control and sports performance.

Construction of the present invention may be accomplished by standard methods, such as, for example, by designing the dorsal and palm sections to meet along a conjoining lateral edge to define a pocket for receiving the eminence of a user's hand.

Detail Description of the Present Invention

Embodiments of the glove is constructed such that includes a thumb digital segment that completely encloses a user's thumb, including enclosing the fingertips, and a pinkie digital segment that completely encloses the user's pinkie finger, including enclosing the fingertips when the glove is worn.

In addition, the glove has a forefinger digital segment with a distal terminal edge. Said forefinger digital segment is adapted to extend to cover the proximal phalanx of the user's forefinger but does not cover the fingertip of the forefinger when the glove is worn. In other words, the forefinger digital segment is adapted to expose a significant portion of the user's distal phalanx when the glove is worn, thereby allowing heightened tactile sensitivities along the fingertip which extends beyond the distal terminal edge such that the skin of the fingertip can touch a device or sports object, while simultaneously enhancing grip capabilities along the covered proximal phalanx of the user's forefinger when the glove is worn. Covering the proximal phalanx allows the user to maintain grip along the area where the proximal phalanx grips a golf club for example, while exposing the distal phalanx gives the user heightened tactile sensitivities along the area where the distal phalanx interlock with the opposing hand's pinkie finger, for example.

In addition, the glove has a middle finger digital segment with a distal terminal edge. Said middle finger digital segment is adapted to extend to cover the proximal phalanx of the user's middle finger but does not cover the fingertip of the middle finger when the glove is worn, defining the middle finger segment. In other words, the middle finger digital segment is adapted to expose a significant portion of the user's distal phalanx when the glove is worn, thereby allowing heightened tactile sensitivities along the fingertip which extends beyond the distal terminal edge such that the skin of the fingertip can touch a device or sports object, while simultaneously enhancing grip capabilities along the covered proximal phalanx of the user's middle finger, for example. Covering the proximal phalanx allows the user to maintain grip along the area where the proximal phalanx grips a golf club for example, while exposing the distal phalanx gives the user heightened tactile sensitivities along the distal phalanx thereby allowing for heightened sensitivity along the middle portion of the user's hand during the golf swing, for example.

In addition, the glove has a ring finger digital segment with a distal terminal edge. Said ring finger digital segment is adapted to extend to cover the proximal phalanx of the user's ring finger but does not cover the fingertip of the ring finger when the glove is worn, defining the ring finger segment. In other words, the ring finger digital segment is adapted to expose a significant portion of the user's distal phalanx when the glove is worn, thereby allowing heightened tactile sensitivities along the fingertip which extends beyond the distal terminal edge such that the skin of the fingertip can touch a device or sports object, while simultaneously enhancing grip capabilities along the covered proximal phalanx of the user's ring finger. Covering the proximal phalanx allows the user to maintain grip along the area where the proximal phalanx grips a golf club for example, while exposing the distal phalanx gives the user heightened tactile sensitivities along the distal phalanx thereby allowing for heightened sensitivity along the back portion of the user's hand during the golf swing, for example. The palmar portion of the glove body also covers the palm segment overlaying the palm of the hand; the dorsal portion of the glove body also covers the back of the user's hand when the glove is worn. The glove also has a wrist portion that surrounds the wrist of the user.

One sport where the present invention will clearly enhance performance is in the sport of football. As previously discussed, wearing a glove can be very advantageous and is used by most athletes in most sports activities but are essentially inoperable on a football quarterback's throwing hand, and on a golfer's dominant hand. More specifically, for example, one particular unmet need that the present invention will satisfy by the synergies created by its unique finger configuration will be with football quarterbacks. It is often said that quarterback mechanics and ball-handling skills are vital for offensive success and consistency. In order for the synergies to be created, the present invention must always comprise a glove that covers all of the user's thumb and pinkie finger while the leaving the remaining three fingers all only partially covered, always leaving exposed at least the fingertips of said fingers. In other words, glove embodiments provide digital segments that cover the proximal phalanx of each of the forefinger, the middle finger, and the ring finger, but do not extend to enclose the entire finger, respectively. Consequently in the present invention the distal phalanx is always exposed and is able to touch a device or sports object with the skin of the finger when the glove is worn. This specific and unique finger configuration creates substantial and significant synergies such that it now allows a quarterback to wear a glove—the present invention—and increase his grip and overall control of a football while simultaneously allowing some finger feel of the football. The rest of the hand, front and back, can be completely covered by the glove. Additionally, the embodiment can have a palmar and dorsal portion overlaying at least a portion of the wrist area. For example, the wrist portion could be stitched on the glove and be made of an expandable composition whereby the glove would expand when being placed on a hand, and then naturally readjust to fit snugly around the user's wrists. The entire palm of the user's hand is covered and so is essentially the entire back (dorsal) of the user's hand when the glove is worn.

The synergies of the unique and specific digital segment configuration combination of the present invention partly take place because the digital segment configurations take into account the physical structure of the football, such as the benefits of the laces on a football and thereby gives a quarterback the unique ability to grasp a football over the football laces with the comfort and feel of not having a glove, while adding significant grip support that a glove provides over the thumb and pinkie finger, particularly over the fingertips of the thumb and pinkie finger if the user's hand when the glove embodiment is worn. Improvement in throwing accuracy and overall performance will result from this unique type of support provided by the new art.

It is essential that the present invention completely cover the user's thumb when the glove is worn. When preparing to throw a football the only digital segment on the bottom side of the football is the user's thumb which is unsupported by the football laces which are on the top side of the football. Therefore it is crucial that the user's thumb be provided with the grip support of a glove. The usefulness of a glove without a completely enclosed thumb segment would be significantly minimized because it would lose the synergies otherwise created. Equally important to the creation of the synergistic effects of the present invention are the exposed fingertips of the user's forefinger, middle finger, and ring finger when the glove is worn. Exposing these fingertips allow the user to place these fingers over or abutting the cross-stitched laces on the top side of the football unencumbered by the glove. An official National Football League football has eight cross-stitched laces, and the distance between each lace-which is the location where the quarterback overlays his or her hand when throwing a football —is one centimeter. The typical width of a finger on a standard six-foot one inch tall Latino is slightly more than one inch. So trying to place one's gloved fingertips between the laces would become so cumbersome that it would make the glove essentially inoperable of completing its intend task—gripping and successfully throwing a football. By leaving these specific fingertips of the user's hand exposed you thereby create synergies that now allow a quarterback to use a glove on his or her throwing hand. Furthermore, by covering each and every one of the user's proximal phalanges (in other words, proximal phalanx of the user's the thumb, forefinger, middle finger, ring finger and pinkie finger are each covered by the glove embodiment) the present invention creates a steady, consistent and enhanced grip throughout the user's hand when gripping a football.

The present invention solves the configuration challenges of prior art and now makes the athletic glove operable for use by quarterbacks using conventional methods of controlling a football. The present invention now therefore also offers a new method of playing the position of quarterback. When throwing a football, for example, the quarterback will first place the present invention partial-fingered glove on his throwing hand. After receiving the football from the Center, he will look down the football field while using primarily his uncovered fingers to feel and locate the football laces on the football. After locating the football laces, he will quickly place the uncovered portion of his middle finger, ring finger over and in-between the cross-stitched laces on the top side of the football. He will also either place his forefinger in-between or abutting the football laces, thus creating a solid grip over the top half of the football. The quarterback will place his now fully enclosed thumb on the proximal half of the football, and his now fully enclosed pinkie on the distal half of the football thus creating a solid grip throughout the entire football. The quarterback then locates a teammate to throw the football and proceeds to throw the football. The quarterback's forefinger phalanx now partially covered and supported by the glove will be able to more properly release the football—or more properly spin the football with his now grip enhanced forefinger—and deliver the football to the intended target more accurately.

In addition to offering greater throwing accuracy and consistency, these and other embodiments should also help minimize quarterback fumbles by adding support when 'pumping' the ball, when scrambling from being tackled, and when rushing and throwing the football. When in 'shot gun' formation especially, a quarterback must quickly look down field at his receivers and 'feel' for the football laces. The present invention will allow a quarterback to maintain a heightened sense of feel in his uncovered fingertips, while increasing the grip support on the completely covered thumb and pinkie finger. These significant and substantial features will, among other things, enhance grip and control while maintaining or even enhancing overall feel. With quarterback fumbles reaching as high as 23 fumbles in a single season (Kerry Collins, 2001) these and other grip enhancing embodiments for football quarterbacks will significantly impact the sport of football.

An additional significant benefit will be that the user will now have critically improved grip at both ends of the football—by a significantly enhanced grip along from the user's completely covered thumb, at one end of the football, and by a significantly enhanced grip from the user's completely covered pinkie finger, at the other end of the football. The result is a significantly increase grip along the entire grip of the user's hand, from the significantly enhanced grip on the bottom side (by the enclosed thumb), the top side (by the enclosed pinkie finger and partially covered forefinger), while maintaining the necessary tactile sensations to both feel and properly use the laces on the top of the football.

Additionally, embodiments may comprise of a series of discrete grip enhancing mechanism each overlaying select portions of the user's hand to create a higher coefficient of friction. The discrete grip enhancing mechanism may be provided that only extends on the metacarpophalangeal joint of the forefinger. In other words, the grip enhancing mechanism may be provided only on a discrete location and is therefore bound by the area. When referring to a discrete grip enhancing mechanism it is to be understood that the description of the location of the discrete grip enhancing mechanism defines the boundary of that particular discrete grip enhancing mechanism. For example, if a discrete grip enhancing mechanism formed of a tackifier along the forefinger stall palmar portion it is understood that the this particular discrete grip enhancing mechanism is thereby bounded by and only along the forefinger stall palmar portion and does not extend beyond the forefinger stall palmar portion. Should the embodiment have a grip enhancing mechanism overlaying any other portion of the glove then that embodiment would thereby have two or more grip enhancing mechanisms. In other words, the term 'discrete' should be interpreted to mean 'is only one' and is bounded by the location described in discussing that particular grip enhancing mechanism.

The grip enhancing mechanism may comprise a high friction surface or a textured surface. The grip enhancing mechanism may further comprise of a beaded surface pattern projecting out at least ½ millimeter, and which could be integral to the glove material and would preferably extend throughout the entire designated surface area. Embodiment may also offer a grip enhancing mechanism on the palmar side of the existing finger stalls as well as the thumb stall, preferably on a portion of one or any of the proximal phalanges of the finger and thumb stalls, thus defining the terminal edges of the grip enhancing mechanism for the embodiment.

If preferred, embodiments may provide added grip capabilities along the palmar portion on and between the thumb stall and the forefinger stall, and on the pinkie finger, for example. By providing added grip support in this area, a quarterback will have further increased control of the football to better perform common tasks. For example, when a quarterback wants to throw the football but has to temporarily run, or scramble, to avoid being tackled the quarterback most often relies primarily on only the dominant hand to hold on to the football. This added grip enhancers now allow the quarterback to more securely hold the football in the throwing position while scrambling by providing added grip capabilities in select areas, and can throw the football with greater precision while scrambling if necessary.

The targeted grip enhancing mechanism may also preferably overlay any thumb or finger, any of the metacarpophalangeal joints, or on any portion between the thumb and forefinger, and may be separately the only grip enhancers on the embodiment, may be used in combination, or may be throughout the palmar surface.

The unique finger configurations now allow the quarterback the critical ability to finally protect his throwing hand from injury. Embodiments can further comprise, for example, a shock-absorbing member along the dorsal portion overlaying the metacarpals and along the dorsal area of the existing finger and thumb stalls. The shock-absorbing member of this and other embodiments can comprise of a pad or pads, such as any foam or cotton-based fabric for example, that are adapted to provide a cushiony effect to protect the selected areas of the hand. The padding can extend along at least a portion of the dorsal segment of the glove. An embodiment, for example, comprises a shock-absorbing member consisting of a foam padding that overlays and is bounded by the four metacarpals of the pinkie finger, the ring finger, the middle finger and the forefinger. Additionally, this embodiment comprises a shock-absorbing member consisting of a foam padding that overlays and is separately bounded by the proximal phalanges of the pinkie finger, the ring finger, and middle finger and the forefinger, thus defining its terminal edges (the phalanges and the dorsal surface of the glove). The shock-absorbing members can be operably attached to the glove, for example. The foam pads each can be about six millimeters in height, each encased in separate, preferably flexible materials, such as flexible plastics or synthetic cottons. Other embodiments may have various heights, of course. The encased pad, for example, can then be stitched on to their respective locations, as described. Each of the encased paddings can be one or a plurality of small cushions. The shock-absorbing member is stretchable, elastic and configured to absorb impact from opposing players of from falling on the ground when the glove is worn.

This and other embodiments offer superior capabilities, critical not only in overall ball control and passing the football, but also in quarterback rush attempts. Over the last decade or two, quarterbacks have increasingly chosen to rush for yardage and at times act more like a running back. Through his years in the NFL, for example, professional football quarterback Michael Vick has attempted over 650 rushes. More recently, NFL quarterback Tim Tebow had 43 rush attempts in a single season, with an average of over 3.16 yards per carry.

Clearly, these trends suggest that successful quarterbacks will be required to rush more with the football the result will often mean getting hit on the dominant hand which is usually protecting the football. Largely because of this, individuals playing the position of running back almost all wear gloves to be able to maintain control of the ball during impact; now with quarterbacks starting to become the second leading rushers on their respective teams (Tebow, Denver Broncos, 2010) the need for the quarterback to wear the present invention on his or her dominant hand grows even higher, so as to maximize ball control while rushing.

Embodiments may also offer critical added protection over the dominant hand of quarterbacks who choose to rush with a football. College football teams are also requiring quarterbacks to rush more often, further increasing the critical need for these embodiments. The 2013 BCS College Orange Bowl between Northern Illinois University and Florida State University featured a starting quarterback who was the leading rusher for his team that season, with 1,771 rushing yards and 19 rushing touchdowns (Jordan Taylor, 2012, NUIhuskies.com/stats/2012-2013). As the National Football League continues to address the importance of better protecting its football players from injuries, it becomes essential that the present invention be used to protect the currently unprotected throwing hands of football quarterbacks.

The shock-absorbing member can comprise of any material that could provide added protection to a user's thumb, fingers, hand, wrist, or combinations thereof. The shock-absorbing member comprise of conventional materials for dissipating pressure across a surface area, can have varying densities and thicknesses, and can be in the form of a layer or multiple layers.

The shock-absorbing member may be flexible, compressible and/or resilient. The shock-absorbing member can comprise of, for example, any foam or cotton-based fabrics, cloth paddings, such as a cushion, foams such as a polyurethane foam pad, and flexible plastics, and the like, to absorb impact received from opposing players or from hitting the ground. It can comprise foam-filled segments, such as polyethylene foam pads, or it can be of cotton or cloth, or gels. For example, the shock-absorbing member may comprise of a unitary pad or pad segments, and may comprise any open cell or closed cell foam, such as BOLLARD foam, polyolefin foam and the like. The shock-absorbing member may also be made of any common materials used in providing glove padding, including natural or synthetic rubber, natural or synthetic rubber foams, gels, polyester fiber, or cotton or other natural or synthetic wadding materials. Additionally, it may comprise of a foam possessing a substantially uniform cell distribution or polyvinyl chloride foam plastic.

The shock-absorbing member may comprise of cushions or pads which can be implemented as any of a variety of conventional padding material, such as foam rubber of varying densities and thicknesses, layers of fabric of various types and thicknesses, conventional gel or plastic material, liquid-holding compartments, or other types of conventional materials. The shock-absorbing member may also be fabricated from more rigid materials such as plastics or fiberglass materials. It will be apparent to one of ordinary skill in the art that many other implementations of the shock-absorbing member are possible.

The shock-absorbing member need not be very thick but can be, beginning from about 600 micrometers to several inches. The thickness may vary according to location, such as finger versus metacarpal areas, and degree of desired protection but provides a greater degree of protection than the surrounding dorsal portion of the glove.

The thickness of similar embodiments may vary depending on several factors, such as for example, user preference. In other words, embodiments may be configured to absorb more or less by the thickness of the shock absorbing member. The embodiment can thus create a cushioning effect to, for example, protect an injury. For example, quarterbacks who rarely rush with the football may only require a thinner pad, say 0.25 inch or less, as opposed to quarterbacks who more often need to rush with the ball.

The shock-absorbing member is located on the dorsal portion of the glove. Within that parameter, preferably, the shock-absorbing member can overlay any portion of any thumb or finger, on any portion of the five metacarpals, or any combination thereof. In at least one embodiment, the entire dorsal segment comprises a shock-absorbing member, thereby generally mirroring the dorsal segment's design or structure of the glove.

Preferably, embodiments can also have a shock-absorbing member along the dorsal surface overlaying any portion of the wrist area including any of the carpometacarpal joints or the carpal bones, provided a segment overlaying the wrist exists. The shock-absorbing member overlaying the carpals on the wrist area may extend to also cover up to about five inches, and may do so as separate padding segments, for example, to allow for significant wrist flexibility, or may be configured as one pad.

The shock-absorbing member can be constructed on the glove using standard techniques placing paddings on gloves, such as by stitching for example, or may alternatively be integrally formed on the glove. For example, the shock-absorbing member may be encased in a compartment or compartments that are then attached to select areas of the glove. Alternatively, said compartments may be integrally formed on the glove and the shock-absorbing member could be interposed in the glove, with the compartment or plurality of discrete shock-absorbing protective protrusions projecting out from the glove. The construction of these compartments may comprise of any flexible material, such as rubber, or may be of the same materials that form the glove. Said compartment or compartments could house and allow said shock-absorbing member to project out to provide protection in desired areas along generally the dorsal surface of the glove.

By way of example, if the shock-absorbing member is placed onto the outer surface of the dorsal segment, it is envisioned that the pad could be sewn, bonded or otherwise attached atop the dorsal segment of the glove. A shock-absorbing member could include an outer layer of material which encapsulates the pad and enables the outer periphery of the pad to be positioned without damaging the pad. For example, it is envisioned that the pad may include an outer layer made of the same material as the rest of the glove, or may be a heavier, thicker material, such as synthetic leather. The shock-absorbing member, in this case a pad, is then inserted into the compartment. The compartment can then be sewn, adhered to or otherwise secured on the glove, such as deposed adjacent the dorsal segment of the thumb stall and thereby provide a greater degree of cushion and protection than the surrounding dorsal portion of the glove.

The shock-absorbing member may also be integrally formed on the glove. For example, the shock-absorbing member may be located between the inner surface of the dorsal segment of the glove, and a liner or sleeve. The liner (or sleeve) material would therefore be positioned between the shock-absorbing member and a user's hand. The liner could be attached to the glove by standard methods, such as by conventional stitching about the perimeter of the dorsal segment, whereby the padded layer would be inserted and then sealed.

A similar method if the shock absorbing member is integrally formed on the sports glove, comprises a flexible, preferably integrally molded dorsal member which has a tougher outer protective surface and a smooth hand contacting inner material, such as a liner or sleeve, being connected together around the peripheral edge of the molded member. The outer member may have a plurality of discrete shock-absorbing protective protrusions whereby the shock-absorbing members could be housed. The protrusions may be in a variety of heights and shapes, and of sufficient dimensions to house each shock-absorbing member and thereby provide a greater degree of protection than the surrounding dorsal portion of the glove.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing in the rain or snow.

These novel features will give a quarterback added protection from the abrasion from hitting a user's fingers against the helmet of an opponent, for example, or when wrapping his throwing hand around the football when rushing. The shock-absorbing member sections of the present invention offer the unique ability of being able to protect an injury while maintaining grip capabilities in select areas by offering padded layer or layers, a significant and substantial advancement to prior art, such as bandages and BAND-AID, thus providing a solution to a long-felt need of being able to protect a quarterback's throwing hand.

Some embodiments, of course, will not have a shock-absorbing member on any part of the glove. These embodiments that are absent of any shock-absorbing member will be useful and significantly beneficial to football quarterbacks but also especially to those playing the sport of golf, primarily because the unique finger configurations of the glove, as well as because of any grip enhancing mechanism on embodiments. Embodiments comprising a shock-absorbing member would therefore also require a glove that is adapted to overlay the back of the user's hand when the glove is worn.

Embodiments of the present invention offer football quarterbacks many benefits including:

- stronger overall grip
- higher completed pass accuracy
- more success at throwing a spiral
- higher consistency and performance in ball handling and control
- better control resulting in less fumbles
- greater success at quarterback play execution
- added protection, by the shock-absorbing member, on select areas of the hand and/or wrist
- greater success when a quarterback runs/rushes with a football
- grip enhancers on the throwing hand of the quarterback
- targeted grip enhancers specifically designed to maximize quarterback performance
- significant enhanced and vital protection to a quarterbacks throwing hand
- protection on the throwing hand when the quarterback rushes with the football In football, unstable or weak ball control can, among other things increase fumbles, increase incompletes and thereby increase turnovers and decrease performance. The above features offer significant and substantial benefits which properly address the concerns currently facing many athletes, such as football quarterbacks.

Another sport where the present invention will find much success is in the sport of Golf. For example, the unique finger configuration of the present invention creates surprising results such that users can now use a glove—the present invention—on their dominant hand. When placed on a golfer's dominant hand, the golfer can then use the overlapping grip, for example, and have increased grip with the now covered dominant hand's pinkie finger which overlays and is in direct contact with the non-dominant hand's forefinger. This in turn allows to a more solid unified golf swing by minimizing the likelihood of hand separation during the golf swing. One of the other substantial benefits of using the present invention of the dominant hand is that the user would now have enhanced grip on the dominant hand's fully enclosed thumb and partially covered forefinger, which is currently glove-less and yet most responsible for controlling the golf swing using only one golf glove. Simply completely enclosing the user's thumb and pinkie finger, however, would not necessarily prove useful on the golfer's dominant hand because as aforementioned, a golfer uses his or her dominant hand to provide heightened tactile sensitivities while swinging a golf club. It is imperative therefore that the fingertips of the user's forefinger, middle finger and ring finger be exposed to such a degree as to allow the user to touch a sports object such as a golf club with the skin of said fingertips in order to maintain heightened tactile sensitivities during a golf swing. The results from the partially covered forefinger, middle finger and ring finger provide feel capabilities on the uncovered distal phalanges, while offering added grip along the covered proximal phalanges to more securely hold the golf club throughout the golf swing. By configuring a glove that solves a long standing problem will allow golfers to now wear a glove on both hands. This, in turn will allow the user to have a substantial and significantly higher grip and control of a golf club.

Additionally, the golfer will now also have added grip capabilities, as well as protection from abrasion, along the entirely covered thumb and partially covered forefinger of the dominant hand.

Embodiments may also provide a grip enhancing mechanism on any finger stalls or along the metacarpophalangeal joints if preferred, thus providing added grip capabilities along the area where the club is gripped. The grip enhancing mechanism may comprise a non-slip latex coating, such as a nitrile coating for example, and would be especially useful along the pinkie finger's metacarpophalangeal joint, the area just below where the weak-hand forefinger interlocks with the strong hand pinkie finger defining the terminal edges of this grip enhancing mechanism. Embodiments may further comprise a grip enhancing mechanism along the glove body palmar portion. The grip enhancing mechanism should preferably provide an effective coefficient of friction, preferably of between 1.5 and 4.5.

The grip enhancing mechanism can be formed on the glove by any standard method, for example, embossing, stamping or molding a portion of the glove to create the gripping means. For example, the grip enhancing mechanism can comprise, for example, regular projections of say, about 300 micrometers in height, but may vary in height depending on preference. The projections may all be the same height, and may be in rows. They may be embossed elongated shapes that are interconnected, thus creating a high coefficient of friction throughout the entire palmar surface area of the glove. Other embodiments could of course offer different heights, non-uniform heights, and have a more random pattern on the palmar portions forming the glove.

Alternatively, the grip enhancing mechanism may be attached, affixed or otherwise placed to select areas of the glove by standard methods and forms of attachment such as by overlaying a panel to select areas of the glove. This may be accomplished, for example, by creating a textured surface on a silicone-based layer and then hot melting said silicone surface onto the bottom surface of the most proximal end of the middle finger stall, thus providing a high friction surface on the embodiment. The grip enhancing mechanism may be affixed to the glove by any other standard methods of attachment, such as by stitching or adhesion.

The grip enhancing mechanism is generally located on the palmar portion of the glove. Within that parameter, preferably, the grip enhancing mechanism can be on any portion of any thumb stall or finger stall where a thumb or finger, any portion of the metacarpophalangeal joints, and any portion between the thumb stall and forefinger stall, generally defined by the forefinger metacarpal, the thumb metacarpal, and the glove segment between said metacarpals. The grip enhancing mechanism can therefore be specifically positioned to provide enhanced grip and a higher coefficient of friction along select aspects of primarily the palmar of the glove. Of course, users may prefer any combination of the aforementioned. In at least one embodiment all of the above mentioned comprise of a grip enhancing mechanism including all of the metacarpals. In at least one embodiment, the palmar segment itself comprises a grip-enhancer, thereby covering the entire palmar area of the glove.

Some embodiments, of course, will not have a grip enhancing mechanism on any part of the glove. These embodiments absent of any grip enhancing mechanism will be useful and significantly beneficial to football quarterbacks but also especially to those playing the sport of golf, primarily because of the unique finger configurations of the glove, for example.

The synergies created by the unique finger configuration of the present invention will also offer substantial benefits on the non-dominant hand for those playing the sport of golf using the conventional interlocking grip method, for example. For example, a slice can take place for several reasons. One reason has to do with the dominant hand not moving at the same rate and angle as the weak hand during a golf swing, or not unhinging at the same time. If there is even the slightest separation between the two hands during the golf swing, the club face will not be square at impact; the resulting open face impact will inevitably result in a slice. One popular golf grip method used to overcome hand separation and create a unified golf swing is called the interlocking grip. When you use this grip, the forefinger of the golfer's weak-hand is placed over his dominant hand and is interlocked with the dominant hand's pinkie finger. With this grip, clearly the role of the weak-hand's forefinger has to do with grip but also much more with coordination and feel on the strong-hand to more effectively control the golf swing and to provide greater golf swing consistency. There is, therefore, no real need to cover all of the weak-hand's forefinger, and covering the entire forefinger actually diminishes said forefinger's sensitivities.

Currently, only full-fingered gloves are used by golfers on their weak-hand. Prior art gloves therefore do not allow a golfer to take complete advantage of his/her preferred grip by allowing for skin contact between both hands and thereby maximizing hand coordination throughout the golf swing. Embodiments of the present invention offer significant improvements to prior art by its unique finger configuration.

For example, the present invention comprises a glove that covers all of the weak-hands thumb and pinkie finger while leaving the fingertips of the middle, ring and forefingers, uncovered such that the skin of each fingertip can touch an object. Users who prefer the interlocking grip method will greatly benefit from significantly increased feel between the now uncovered portion of the interlocked forefinger of the gloved weak hand with the ungloved and interlocked pinkie finger of the strong hand. Using the present invention also allows a user to place their completely enclosed thumb and covered portions of their middle finger, ring finger and pinkie finger directly on and touching the golf club to maintain a solid grip by the glove embodiment, while being able to substantially increase tactile abilities by leaving the fingertips of the user's middle finger and ring finger when the glove is worn. This and other embodiments now allow far greater feel and coordination lost with prior art especially when gripping a golf club using the conventional interlocking grip.

The interlocked fingers now allow for far better feedback because both interlocked fingers are now to make skin-to-skin contact, making it easier to adjust a golf swing. Users who prefer this embodiment will greatly benefit from maximum feel between the completely uncovered interlocked fingers of both hands. Exposing the fingertips of the middle and ring fingers are therefore very important to the creation of synergies, in particular for those playing golf using the interlocking grip method, for example. And to those golfers, exposing the fingertip of the forefinger is a critical feature, and is an essential aspect of the present invention and in achieving synergies in: the ability to offer greater golf consistency and accuracy by solving this previously unsolvable problem in prior art; a far more successfully coordinated golf swing; and heightened feel capabilities for better feedback if the golf club inappropriately moves during a golf swing. Additionally, the user's thumb must be completely covered to protect the user's from abrasion from the golf club when using the interlocking grip method. Exposing the fingertip of the user's thumb for example would essentially make the glove inoperable. Using this embodiment will allow a user to maximize feel with both hands not just with only the standard ungloved dominant hand.

Additionally, a grip enhancing mechanism may be provided along the palmar surface of the glove to further increase grip capabilities, if preferred. For example the grip enhancing mechanism may comprise a plurality of projections formed from a skid resistant material, such as neoprene, PVC, rubber or the like. The projections can form a pattern on the palmar surface. Preferably, the high friction surface includes interstices or spaces between projections to allow for necessary flexibility. Preferably, the projections have an average height of about 700 micrometers or more. A grip enhancing mechanism can of course be formed on this and other embodiments. For example, a grip enhancing mechanism can also be formed on any finger stalls or along the metacarpophalangeal joints if preferred, thus providing added grip capabilities along the area where the club is gripped. For the same reasons aforementioned, this embodiment would significantly assist golfers using any of the interlocking, for example. The grip enhancing mechanism may comprise of stripes, for example, projecting out about 600 micrometers.

The grip enhancing mechanism of embodiments may comprise a discrete grip enhancing mechanism and be formed only on select finger stalls and create, for example, a high friction textured surface with a more narrow width, say about 1.5 to three centimeters. The grip enhancing mechanism may include a plurality of projections or a plurality of depressions on the surface of the grip enhancing panel formed from, for example, one of a vinyl material, a rubber material, or a neoprene material, creating a grip enhancing mechanism. The material forming the panel may then be applied to said stalls using any standard bonding methods, such as adhesion or stitching. The plurality of projections can preferably be provided, for example, on at least one phalanx or on only one phalanx of strategically selected portions of a finger stall, such as on only the thumb and pinkie stalls. The projections could preferably extend out less than 1/10 of a centimeter or so, but could range generally from 1/20 of a centimeter to several centimeters.

In general, the grip enhancing panel forming the grip enhancing mechanism may preferably be formed from an elastic material or fabric, including but not limited to, a knitted fabric, for example, LYCRA, rayon, neoprene, a rubber material, a vinyl material, a PVC material, a nitrile material, or the like.

The grip enhancing mechanism comprised of a grip enhancing panel provides a higher and more effective coefficient of friction than the rest of the glove body, preferably of at least 1.5; More preferably, the grip enhancing mechanism comprised of a grip enhancing panel Coefficient of Friction of between 1.5 and 4.5.

Once the grip enhancing surface on the panel has been formed, the panel may then be applied to the palmar surface of the glove by any standard methods, such as by stitches or adhesives, for example.

The grip enhancing mechanism of embodiments creates a higher coefficient of friction than the surrounding material forming the palmar segment of the glove body, and can further be comprised of various grip-enhancing materials, coatings, and designs, including but not limited to, foams, fabrics, PVC dots, perimeter patching designs, linear and non-linear grooves, or combinations thereof, high friction surfaces, textured surfaces, a plurality of regular or irregular projections, a plurality of regular or irregular depressions, non-slip materials and coatings, such as PVC coatings, nitrile coatings and latex coatings, and designs creating coarse surfaces, as well as pebbled or beaded surfaces, convex or concave bumps, striations, cross-hatches, convex or concave linear and non-linear lines, angled ribs, random structures, convex or concave ridges, crevices, elongated segments, and the like. Preferably, the depths of the depressions and/or heights of projections would be such that the gap formed by the depressions or projections would allow for some movement of the palmar surfaces thereby increasing the grip capabilities of the user. The height or depth ranges can generally begin at about 100 micrometers to several millimeters or so.

The grip enhancing mechanism may further comprise a plurality of spaced apart stripes or striped projections formed from a high friction material, such as a PVC material, for example. Preferably the stripes comprise raised or projecting stripes and are arranged to extend generally parallel to the axis of any existing finger stalls. Stripes and other forms may be uniformly spaced or spaced at varying intervals. Similarly, stripes and other forms may have varying thicknesses, heights or depths, depending on preference. The thickness ranges generally can begin at about 100 micrometers to several millimeters or more. These grip-enhancers may create a pattern, may be in rows or randomly placed, and may form circular and non-circular shapes, such as spherical, cylindrical or elongated. Additionally, they may be individually separated or interconnected.

Embodiments of the present invention may further comprise moisture management recesses or microholes generally used on golf gloves, for ventilation or moisture management purposes. This embodiment can be in the form of a standard synthetic leather golf glove, with the dorsal and palmar surface areas essentially covering all five metacarpals, with the only exception of a slit along the dorsal surface which allows the golfer to insert the hand into the glove, and micro recesses along a portion of the glove to allow for ventilation. These recesses can be circular in shape or in the shape of triangles. Additionally, some embodiments may provide moisture management recesses in the form of a identifiable human body part such as a plurality of hearts.

In general, a palmar surface of an embodiment can have a variety of finishes, one portion of the surface can have a smooth finish, for example, and another portion can have a textured surface. The textured portion could create a coefficient of friction, or grip enhancer, on the surface.

Embodiments of the present invention also comprise of a wrist securement opening means to secure the glove to the user's hand. The opening means may be, for example, an elastic means or a flap which mechanically engages a flap capture mechanism, such as a synthetic hook and loop fastening interface which adheres when pressed together, commonly using VELCRO to ensure a strong attachment to the hand, very important when playing active sports requiring high velocity movements that the glove hand. The wrist portion opening means may also further comprise an elastomeric band fixed around then wrist aperture. Embodiments may also have combinations of both a flap capture mechanism and an elastomeric band. The wrist portion may be formed integral with the glove or may be attached to the glove by standard methods, such as by sewing.

The finger segments of embodiments are preferably designed to fit snugly around a user's fingers, as are typical sports gloves. In addition, some embodiments may have material treated by a moisture repellant, for example SCOTCH GUARD or a synthetic resin, extremely useful during the Winter months, usually during the football playoffs. In addition, or alternatively, embodiments may comprise of microrecesses along the dorsal portion of the glove body, for ventilation purposes.

Embodiments may be made and manufactured using standard materials and methods in developing sports gloves, such as synthetic leather. Materials that can comprise these glove embodiments include, but are not limited to, woven materials such as natural, synthetic or blends of natural and synthetic yarns, thermoextruded or thermoset rubbery embodiments such as those made from thermoplastic elastomers. Examples of synthetic yarns include nylon, polyester, and spandex (polyurethane) yarns. Embodiments may also comprise stretch materials and designs, mesh fabrics, recycled and flexible materials, cottons, polyester, rayon, spandex, fleece, leathers and synthetic leathers, rubbers, plastics, woven fabrics, non-woven fabrics, cloths, LYCRA, a vinyl material, a neoprene material, a fleece material, or combinations thereof.

The thickness of the dorsal and palmar segments can generally begin anywhere from 0.005 inches to 0.040 inches as are standard sports gloves, for example, and can depend on several factors such as comfort and durability preferences. Some embodiments may offer more durable material for the dorsal surface thus requiring an even thicker dorsal segment. Of course, the more durable the material for more protection the glove may naturally provide.

SUMMARY

As described herein, the present invention overcomes the limitations of prior art in a number of significant ways. In general, embodiments of the present invention can generally be used in conjunction with any type of hand task activity and/or sports play. As discussed, embodiments offer an individual with the opportunity to increase overall hand task performance. Maintaining or increasing overall control, for example, can provide many benefits to a user of these, and other embodiments. These and other embodiments:

- offer the ability to grip as well as feel a ball, such as a football
- offer the ability to grip as well as feel a sports device, such as a golf club
- provide a unique solution for players who desire better grip capabilities only in select areas
- offer basic benefits that standard gloves offer, now offered also to quarterbacks
- offer a more stabilizing overall grip of a ball or object, by conveying grip-enhancers to select locations of the hand
- provide grip enhancers along the connecting area between the thumb and forefinger
- allow an individual to maintain or increase control of a ball or object along the metacarpophalangeal joints
- permit the ability to use a glove on dominant hand configured to meet the unique needs of a user's preferred golf grip
- improve performance in hand task execution
- offer more control capabilities throughout a sports task, a valuable feature when striking a golf club with greater velocity
- afford more control throughout a football task, such as when throwing a slippery football or while under duress
- allow more hand coordination by adjusting grip-enhancers to match a preferred particular golf swing
- decrease the likelihood of football mishandles
- create more safety in playing the position of quarterback especially for the youth in our country
- finally give quarterbacks the necessary protection already offered to others who rush with the football, such as running backs These are among the many benefits of the present invention, and are not to be construed as limitations of the benefits nor their legal equivalent.

Although the description of the present invention only discussed two sports, it is understood that individuals playing other sports and activities can benefit from embodiments as well, such as baseball, volleyball and basketball for example.

Additionally, although some embodiments may have been discussed in a particular sport, it is only by way of example. In other words, the embodiments discussed relating to football may also easily be used in golf, and vice versa. In addition, the term 'overlay' is not meant to limit how the grip enhancing mechanism or the shock-absorbing member will be created on embodiments of the present invention. Indeed, as has been demonstrated, the grip enhancing mechanism and shock-absorbing member may be integrally formed on many of these embodiments. Therefore, use of the term 'overlay' may be defined more broadly, as "applied, affixed, formed on or otherwise created on."

In addition, only some embodiments have been discussed and in no way is intended to limit all the various embodiments and other embodiments that the present invention provides, such as but not limited to, different designs. Embodiments can of course be used by men and women, boys and girls, professional athletes or amateurs, as well as by those whose dominant hand is the right hand or the left.

BRIEF DESCRIPTIONS OF THE DRAWING

It is expressly understood that the following descriptions and drawings are for illustration purposes only, and in no way are intended to limit the scope of the present invention and its various embodiments. For example, the drawings are of embodiments for the left hand but can easily be created for the right hand.

FIG. 1 is a drawing of the palmar (front) view of a first embodiment. The glove completely covers the thumb and pinkie finger when the glove is worn. Additionally, the glove has a partially covered forefinger digital segment that is adapted to extend to cover the proximal phalanx of the user's forefinger but does not cover the fingertip of the forefinger, a partially covered middle finger digital segment that is adapted to extend to cover the proximal phalanx of the user's middle finger but does not cover the fingertip of the middle finger, and a partially covered ring finger digital segment that is adapted to extend to cover the proximal phalanx of the user's ring finger but does not cover the fingertip of the ring finger when the glove is worn.

FIG. 2 is a drawing of the embodiment as described in FIG. 1, showing the dorsal (back) view.

FIG. 3 is a drawing of the palmar view of a second embodiment. The glove completely covers the thumb and pinkie finger when the glove is worn. Additionally, the glove has a forefinger digital segment that is adapted to extend to cover the proximal phalanx of the user's forefinger but does not cover the fingertip of the forefinger, a middle finger digital segment that is adapted to extend to cover the proximal phalanx of the user's middle finger but does not cover the fingertip of the middle finger, and a ring finger digital segment that is adapted to extend to cover the proximal phalanx of the user's ring finger but does not cover the fingertip of the ring finger when the glove worn.

FIG. 4 is a drawing of the embodiment as described in FIG. 3, showing the dorsal view.

FIG. 5 is a drawing of the palmar view of a third embodiment, shown as a partial-fingered glove. The glove completely covers the thumb and pinkie finger when the glove is worn. Additionally, the glove has a partially covered forefinger digital segment that is adapted to extend to cover the proximal phalanx and the entire middle phalanx of the user's forefinger but does not cover the fingertip of the forefinger, a partially covered middle finger digital segment that is adapted to extend to cover the proximal phalanx and the entire middle phalanx of the user's middle finger but does not cover the fingertip of the middle finger, and a partially covered ring finger digital segment that is adapted to extend to cover the proximal phalanx and the entire middle phalanx of the user's ring finger but does not cover the fingertip of the ring finger when the glove is worn.

FIG. 6 is a drawing of the embodiment as described in FIG. 5, dorsal view.

FIG. 7 is a drawing of the palmar view of a fourth embodiment, shown as a partial-fingered glove. The glove completely covers the thumb and pinkie finger when the glove is worn. Additionally, the glove has a forefinger digital segment that is adapted to extend to cover the proximal phalanx of the user's forefinger but does not cover any portion of the user's distal phalanx, a middle finger digital segment that is adapted to extend to cover the proximal phalanx of the user's middle finger but does not cover any portion of the user's distal phalanx when the glove is worn.

Figure 10:
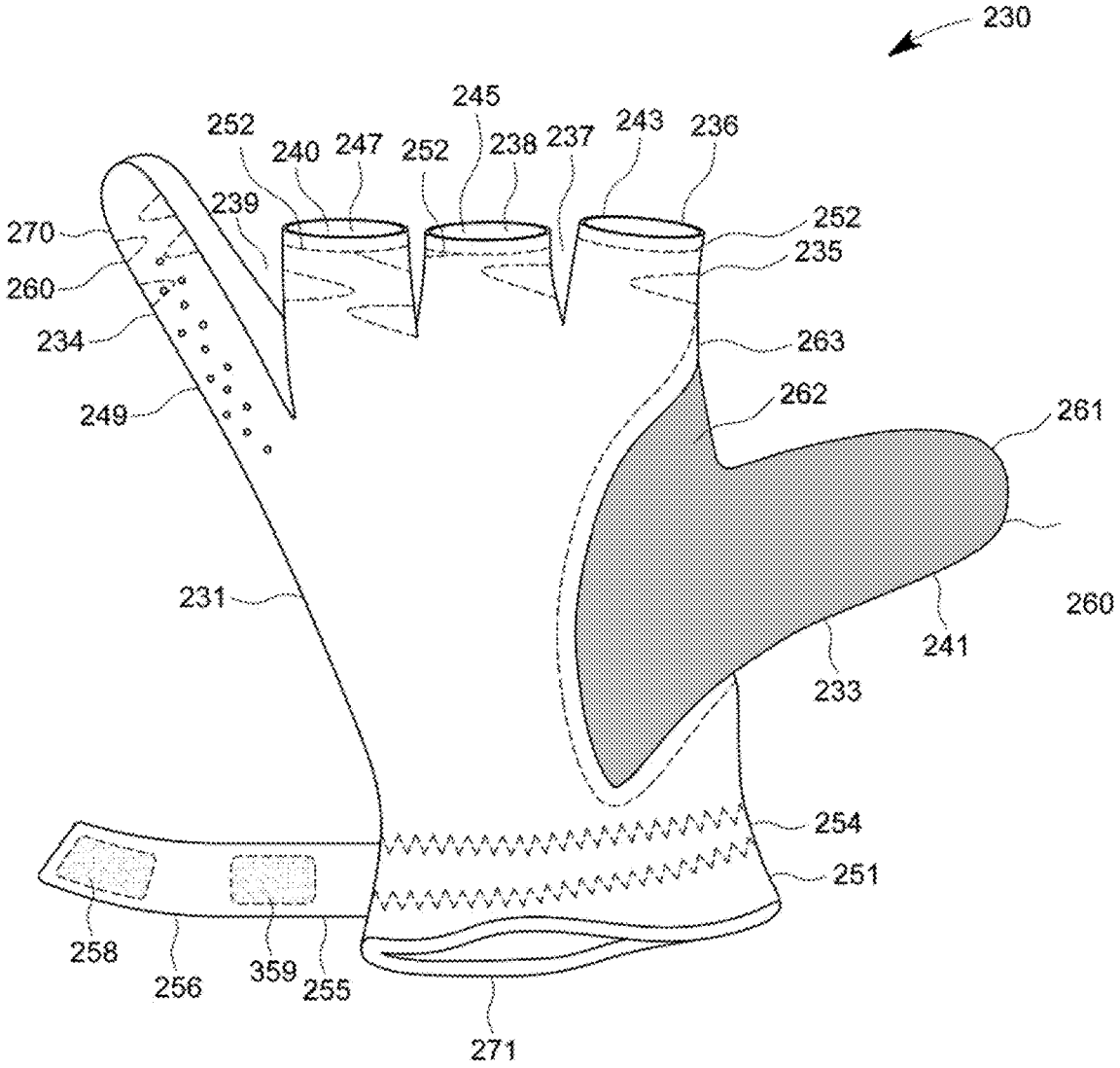

FIG. 10 is a drawing of the palmar view of a fifth embodiment, shown as a partial-fingered glove. The glove completely covers the thumb and pinkie finger when the glove is worn. Additionally, the glove has a forefinger digital segment that is adapted to extend to cover the proximal phalanx of the user's forefinger but does not extend to cover any portion of the user's distal phalanx, a middle finger digital segment that is adapted to extend to cover the proximal phalanx of the user's middle finger but does not extend to cover any portion of the user's distal phalanx, and a ring finger digital segment that is adapted to extend to cover the proximal phalanx of the user's ring finger but does not extend to cover any portion of the user's distal phalanx when the glove is worn.

Figure 11:
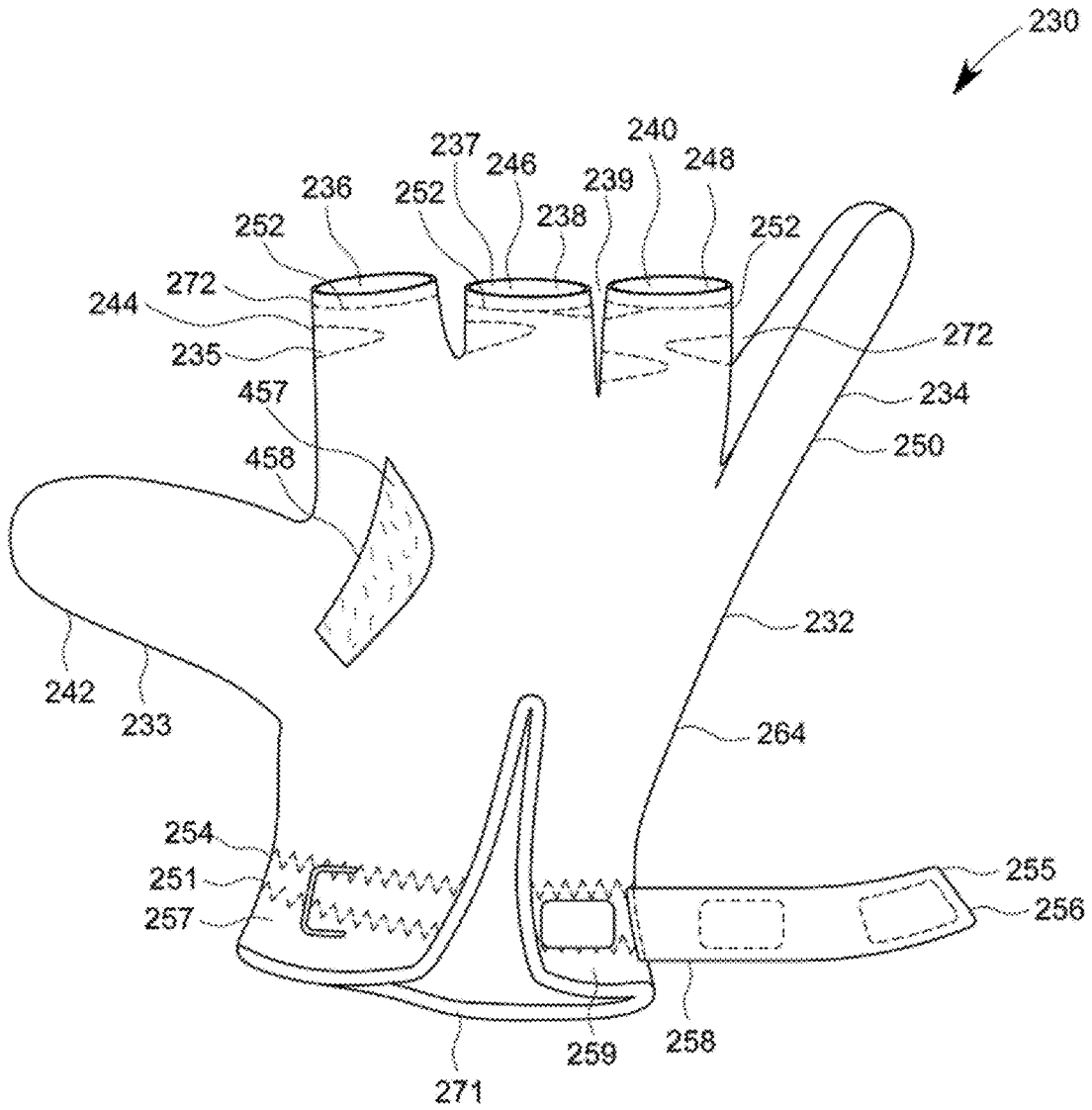

FIG. 11 is a drawing of the embodiment as described in FIG. 10, showing the dorsal view.

Figure 12:
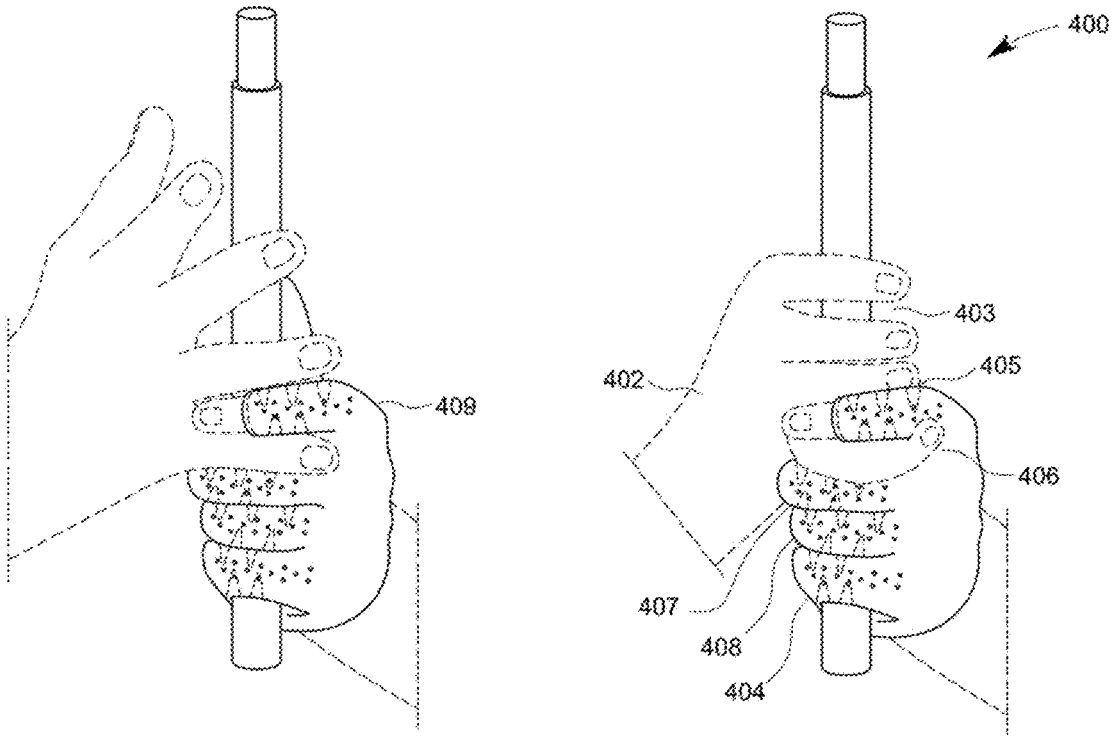

FIG. 12 is an illustration of a user gripping a golf club using the conventional interlocking grip method.

Figure 13:
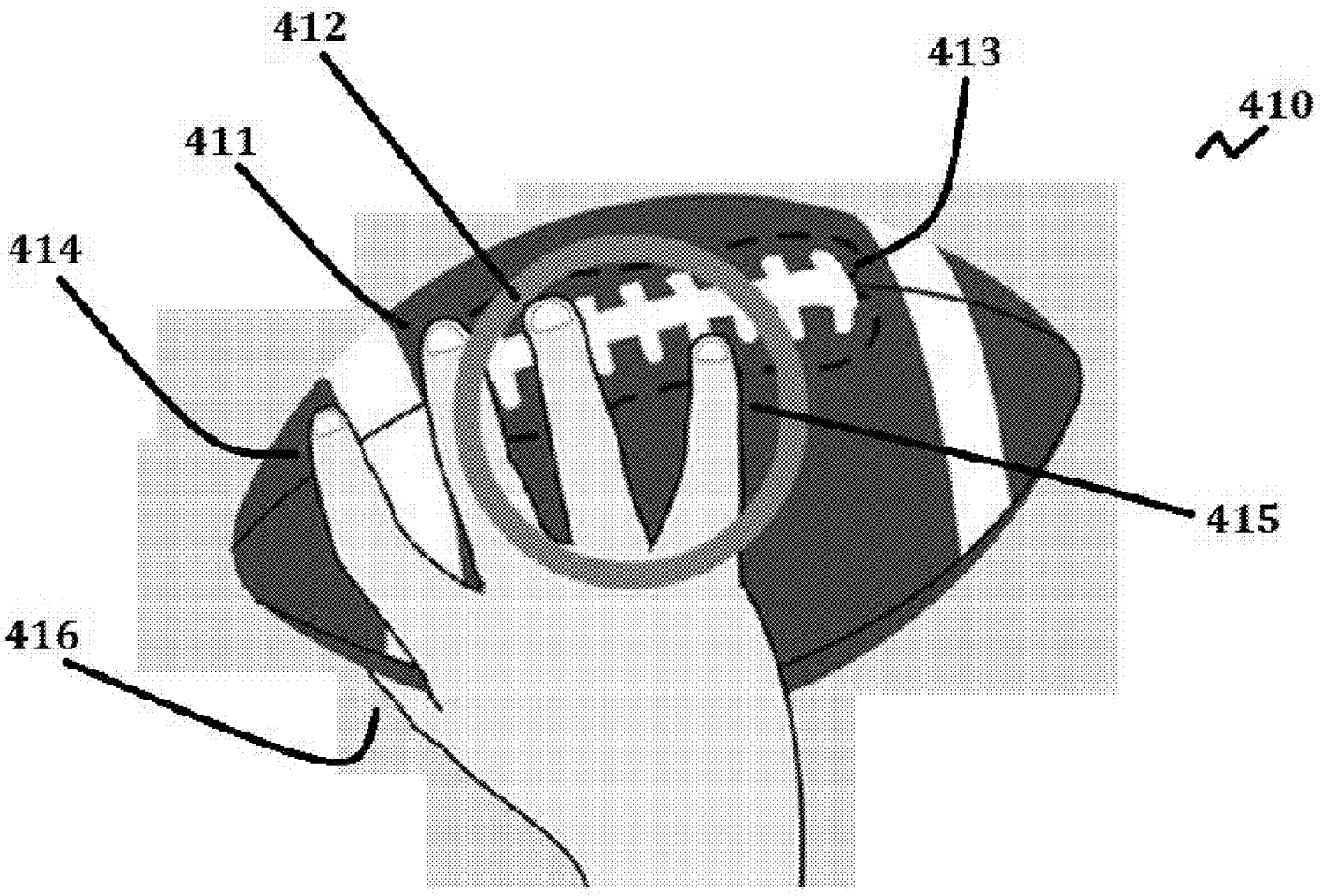

FIG. 13 is an illustration of a standard way of gripping a football when preparing the throw a football.

Figure 14:
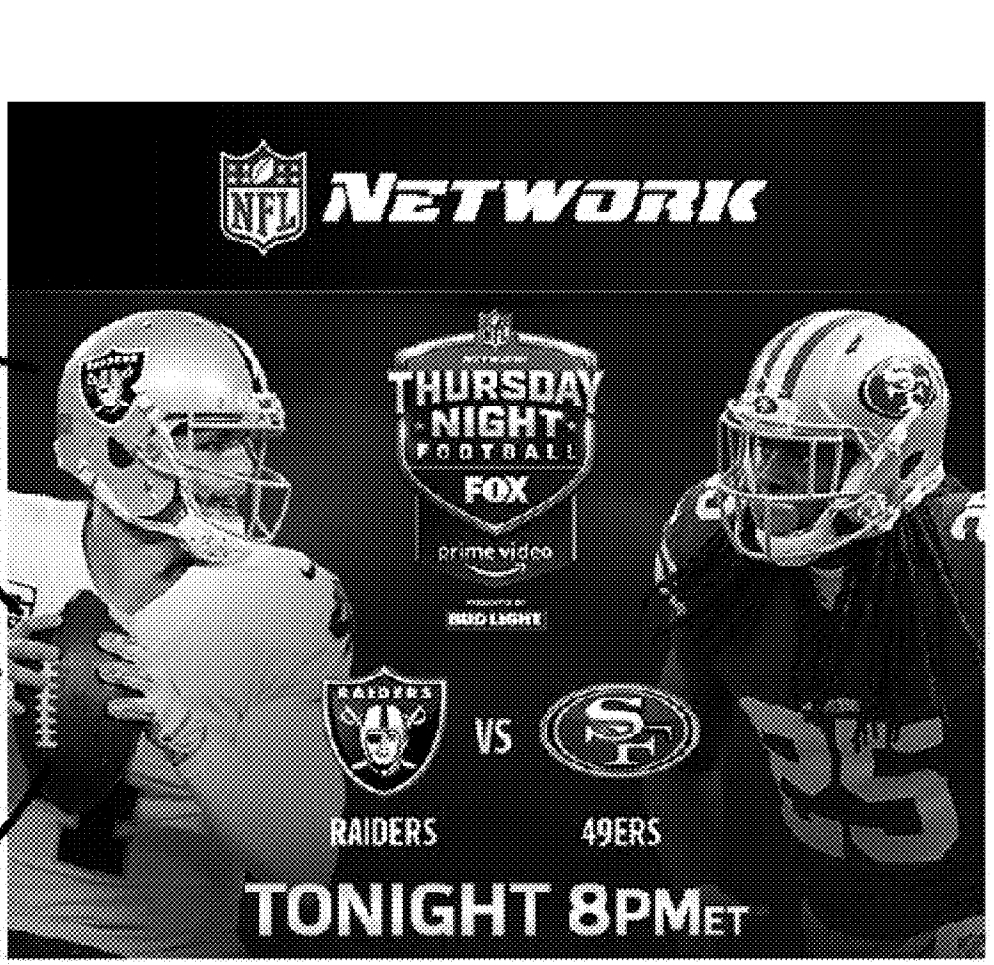

FIG. 14 is a replication of a recent ad promotion which illustrates a standard method of gripping a football when preparing to throw the football down the field.

Figure 15:
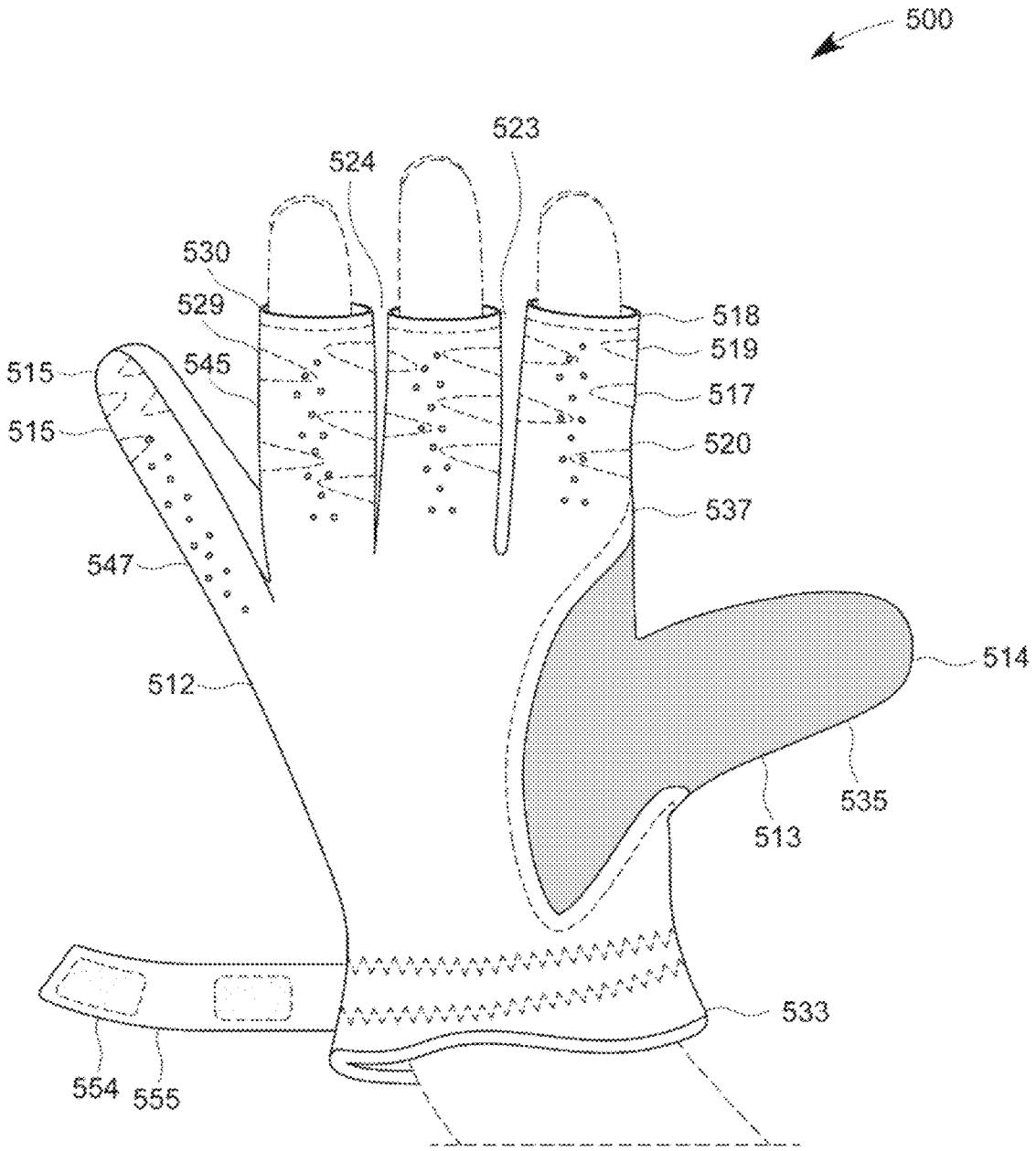

FIG. 15 is a drawing of the palmar view of a sixth embodiment, shown as a partial-fingered glove with a pouch of the back of the sports glove.

Figure 16:
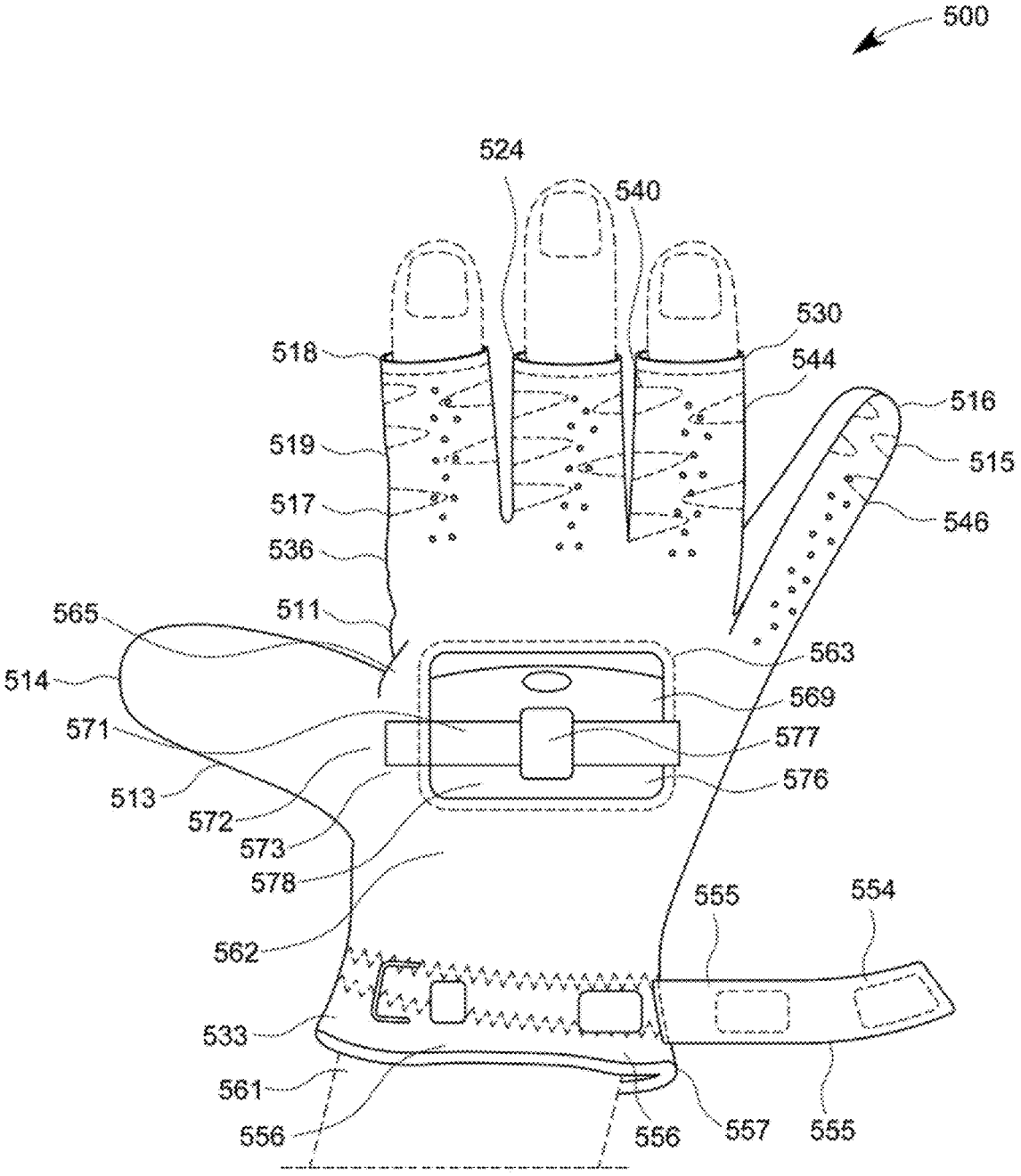

FIG. 16 is a drawing of the embodiment as described in FIG. 15, showing the dorsal view.

Figure 17:
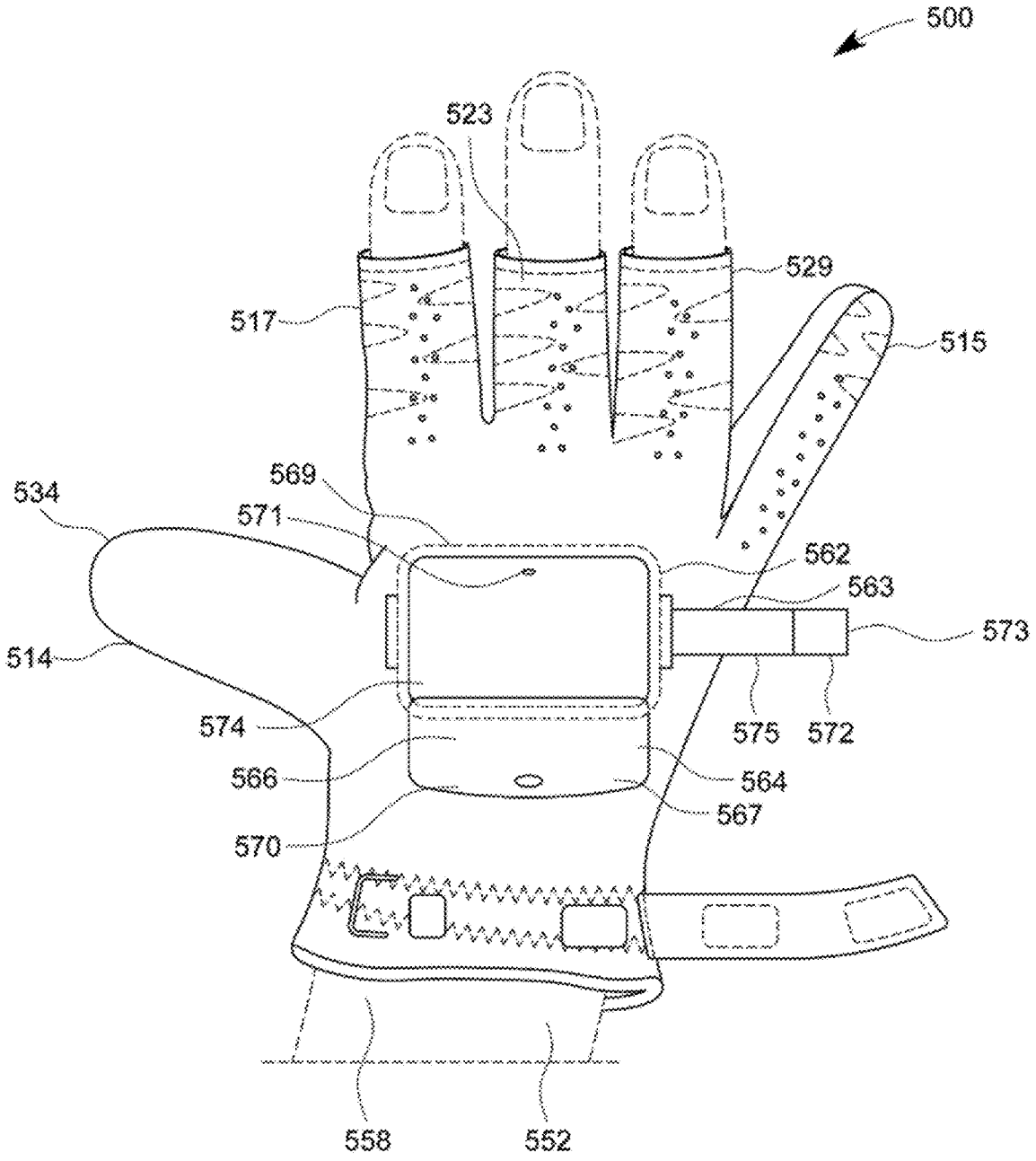

FIG. 17 is another dorsal view of the embodiment as described in FIG. 15, showing other aspects of the pouch and strap.

Figure 18:
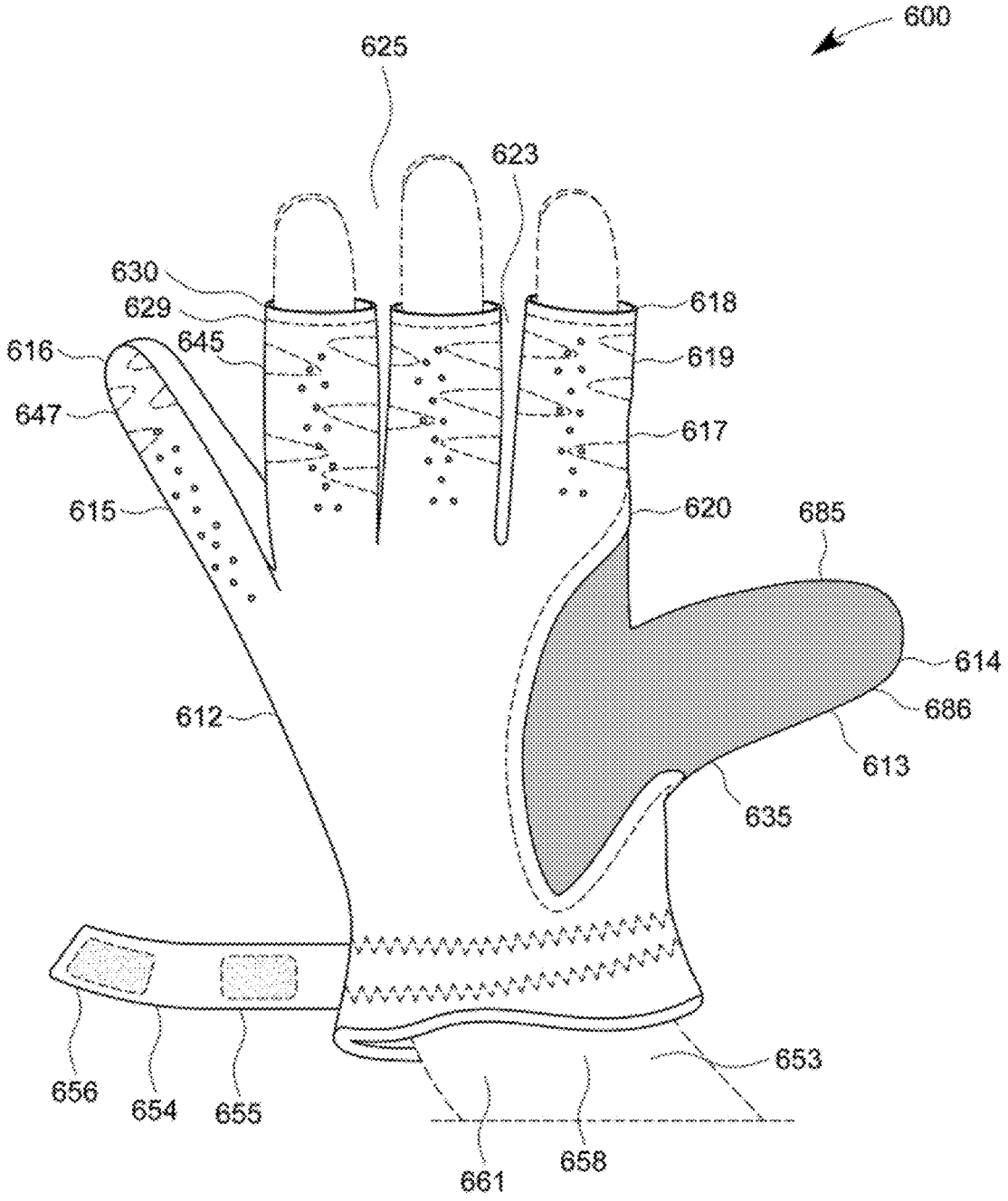

FIG. 18 is a drawing of the palmar view of a seventh embodiment, shown as a partial-fingered glove with a pouch of the back of the sports glove.

Figure 19:
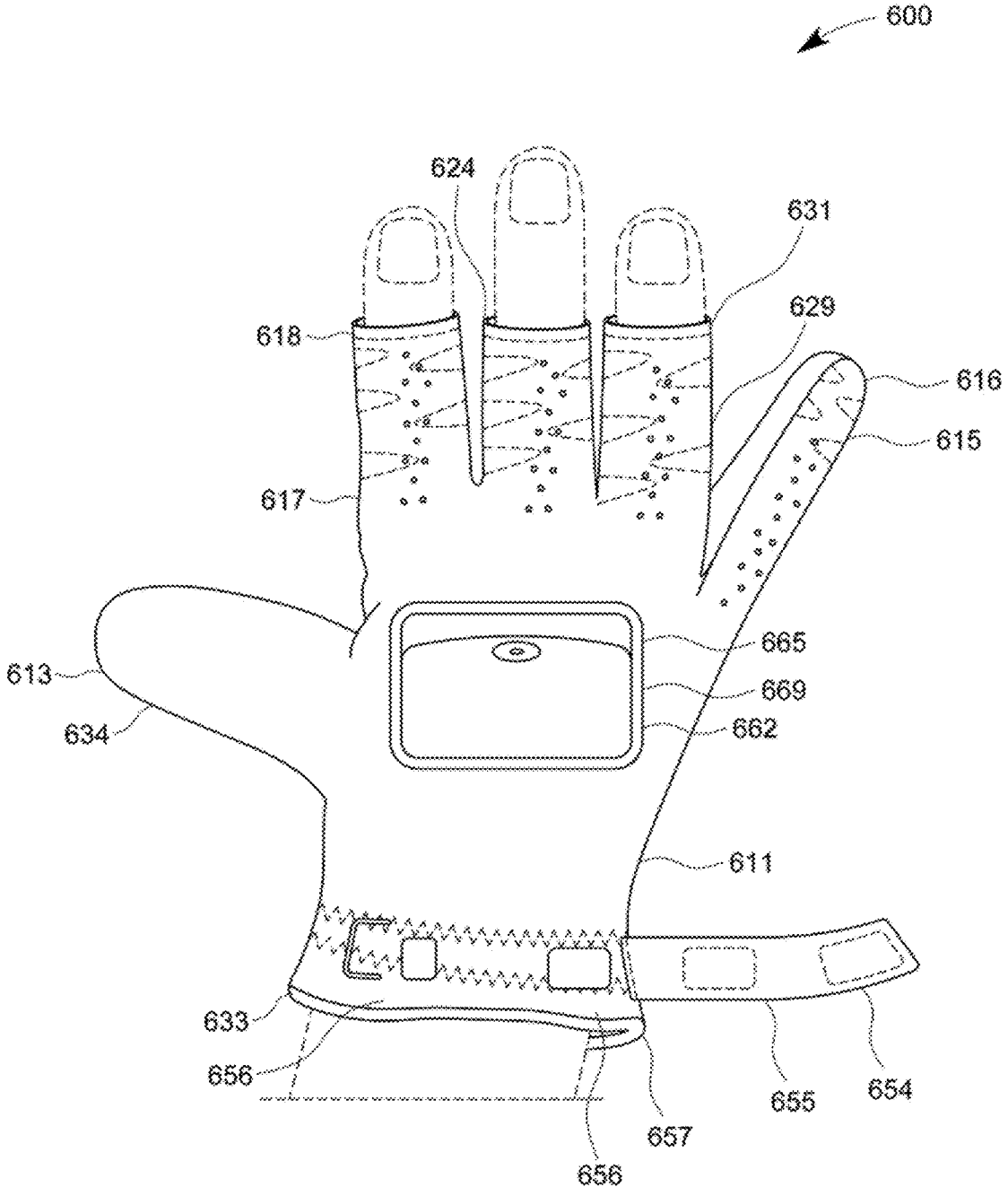

FIG. 19 is a drawing of the embodiment as described in FIG. 18, showing the dorsal view.

Figure 20:
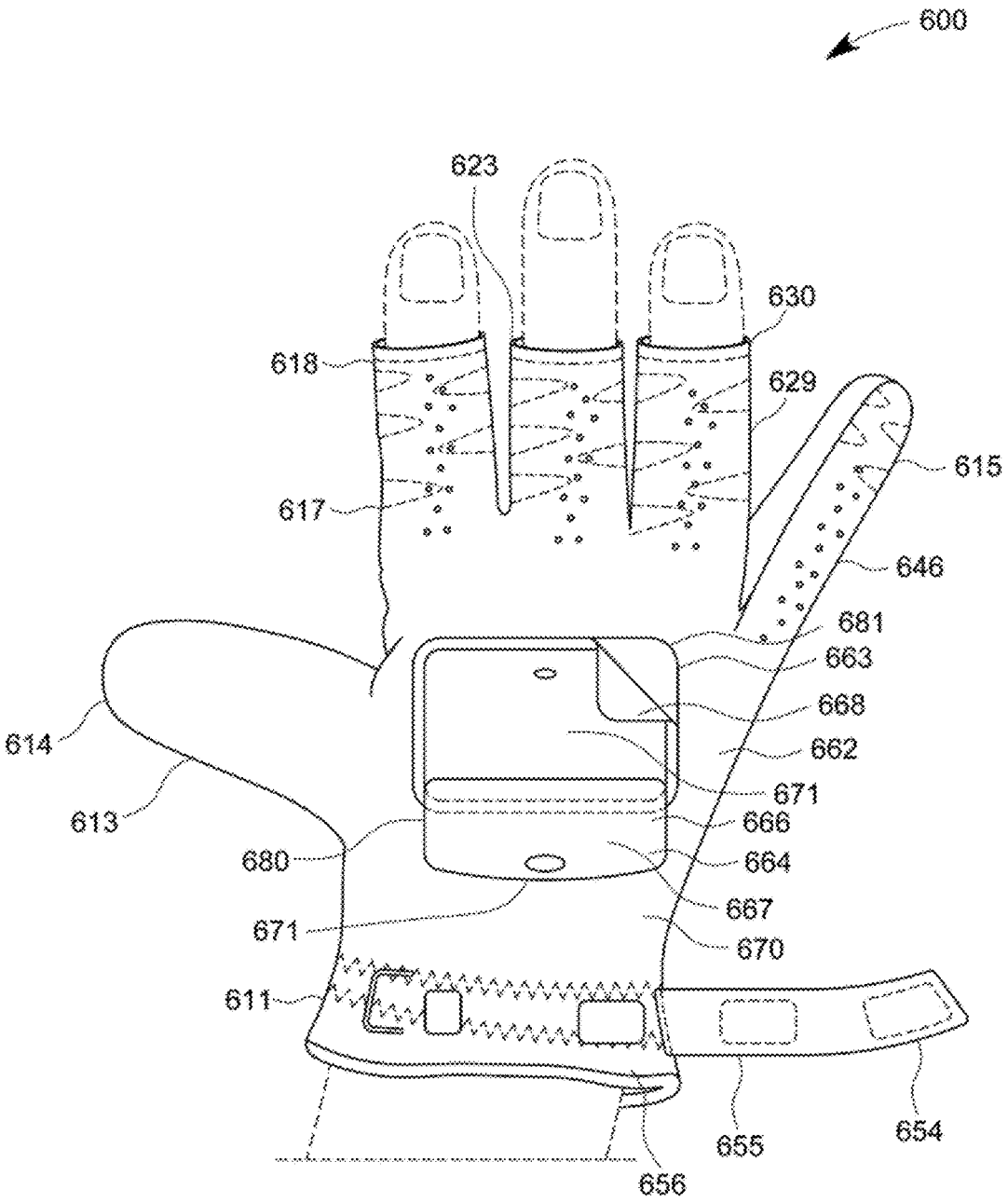

FIG. 20 is another dorsal view of the embodiment as described in FIG. 18, showing other aspects of the pouch and hook-and-loop fasteners on the pouch.

DETAILED DESCRIPTION OF THE DRAWINGS

It is expressly understood that the drawings are for the purpose of illustration and description only and are not intended as a definition of the limits of the invention.

Figure 1:
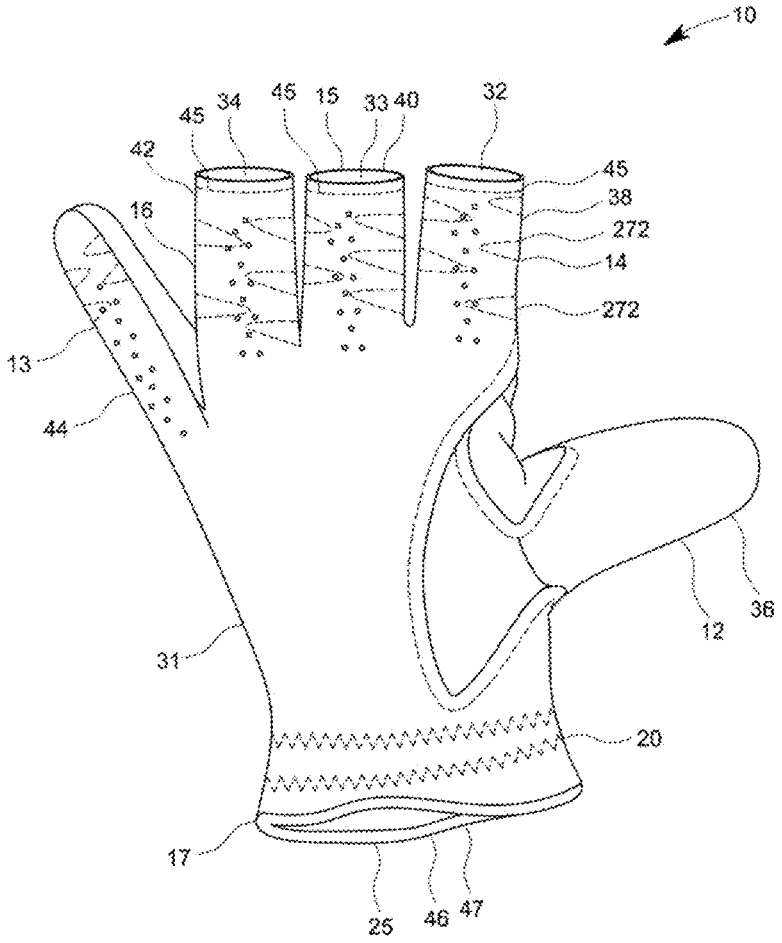
Figure 2:
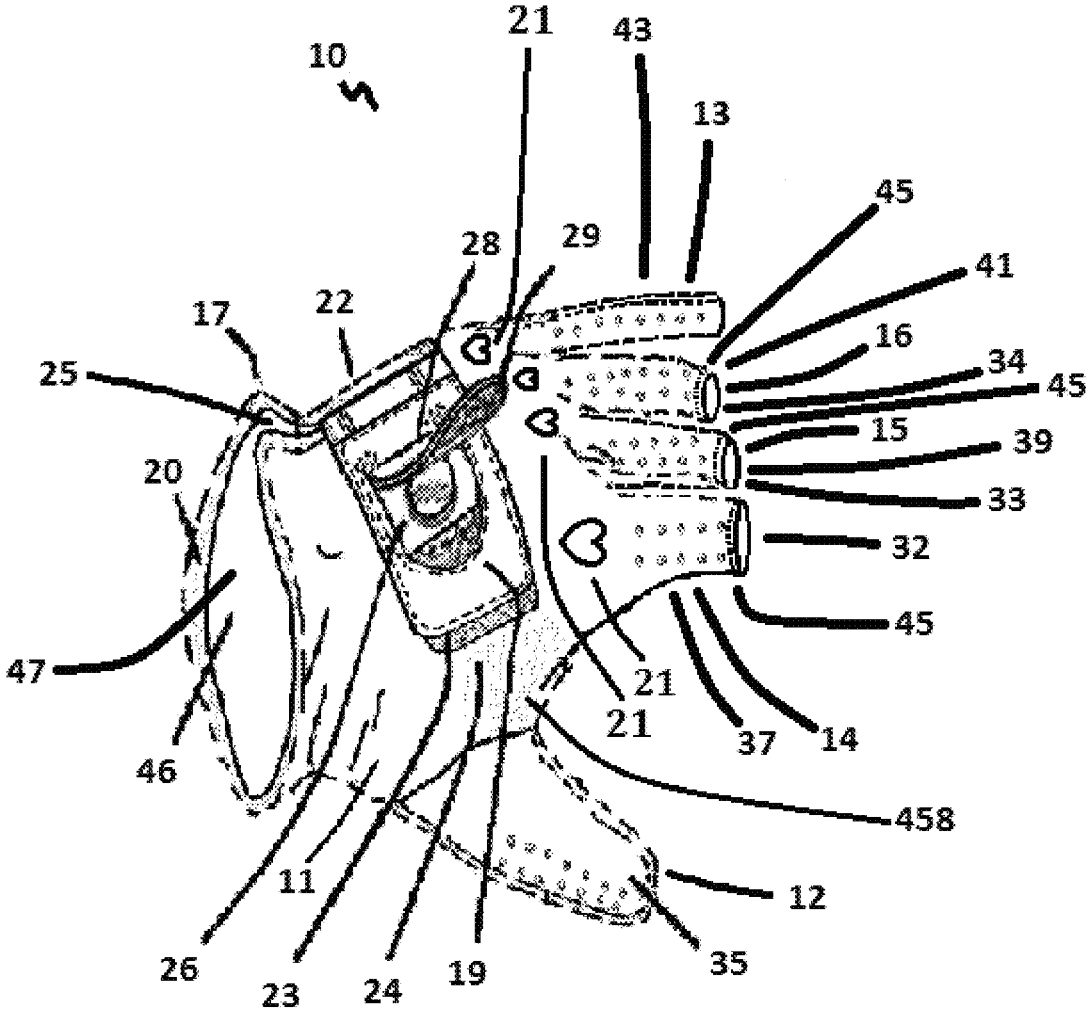

Referring now to FIG. 1 and FIG. 2, an embodiment of the present invention is shown and designated as 10. The palmar view of a glove is drawn in FIG. 1 and the dorsal view of the same glove is drawn in FIG. 2. This partial-fingered embodiment provides a glove having a dorsal portion 11, a palmar portion 31 for overlaying respective back and palm regions of a human hand, said dorsal and palmar portions having distal and proximal ends with a plurality of digital segments (or stalls) projecting from said distal ends. The glove includes a glove body having a back portion 11 covering the back of the hand, and a front portion 31 covering the palm or front of the hand when the glove is worn.

In the illustrated embodiment the glove is constructed such that it includes a thumb digital segment 12 that fully encloses a user's thumb, including enclosing the fingertips, and a pinkie digital segment 13 that fully encloses the user's pinkie finger, including enclosing the fingertips when the glove is worn.

In addition, the glove has a forefinger digital segment 14 with a distal terminal edge 32. Said forefinger digital segment is adapted to extend to cover the entire proximal phalanx of the user's forefinger but does not cover the fingertip of the forefinger when the glove is worn, defining the forefinger segment. In other words, the forefinger digital segment is adapted to expose a significant portion of the user's distal phalanx when the glove is worn, thereby allowing heightened tactile sensitivities along the fingertip which extends beyond the distal terminal edge such that the skin of the fingertip can touch a device or sports object, while simultaneously enhancing grip capabilities along the covered proximal phalanx of the user's forefinger when the glove is worn. Covering the proximal phalanx allows the user to maintain grip along the area where the proximal phalanx grips a golf club for example, while exposing the distal phalanx gives the user heightened tactile sensitivities along the area where the distal phalanx interlock with the opposing hand's pinkie finger, for example.

In addition, the glove has a middle finger digital segment 15 with a distal terminal edge 33. Said middle finger digital segment is adapted to extend to cover the entire proximal phalanx of the user's middle finger but does not cover the fingertip of the middle finger when the glove is worn, defining the middle finger segment. In other words, the middle finger digital segment is adapted to expose a significant portion of the user's distal phalanx when the glove is worn, thereby allowing heightened tactile sensitivities along the fingertip which extends beyond the distal terminal edge such that the skin of the fingertip can touch a device or sports object, while simultaneously enhancing grip capabilities along the covered proximal phalanx of the user's middle finger. Covering the proximal phalanx allows the user to maintain grip along the area where the proximal phalanx grips a golf club for example, while exposing the distal phalanx gives the user heightened tactile sensitivities along the distal phalanx thereby allowing for heightened sensitivity along the middle portion of the user's hand during the golf swing, for example.

In addition, the glove has a ring finger digital segment 16 with a distal terminal edge 34. Said ring finger digital segment is adapted to extend to cover the entire proximal phalanx of the user's ring finger but does not cover the fingertip of the ring finger when the glove is worn, defining the ring finger segment. In other words, the ring finger digital segment is adapted to expose a significant portion of the user's distal phalanx when the glove is worn, thereby allowing heightened tactile sensitivities along the fingertip which extends beyond the distal terminal edge such that the skin of the fingertip can touch a device or sports object, while simultaneously enhancing grip capabilities along the covered proximal phalanx of the user's ring finger. Covering the proximal phalanx allows the user to maintain grip along the area where the proximal phalanx grips a golf club for example, while exposing the distal phalanx gives the user heightened tactile sensitivities along the distal phalanx thereby allowing for heightened sensitivity along the back portion of the user's hand during the golf swing, for example.

The palmar portion of the glove body 31 also covers the palm segment overlaying the palm of the hand; the dorsal portion of the glove body 11 also covers the back of the user's hand when the glove is worn. The glove also has a wrist portion 17 that surrounds the wrist of the user.

The thumb stall 12 is defined by a dorsal portion 35 and a palmar portion 36. The forefinger stall 14 is defined by a dorsal portion 37 and a palmar portion 38. The middle finger stall 15 is defined by a dorsal portion 39 and a palmar portion 40. The ring finger stall 16 is defined by a dorsal portion 41 and a palmar portion 42. The pinkie finger stall 13 is defined by a dorsal portion 43 and a palmar portion 44.

Furthermore, the forefinger segment distal terminal edge 32, the middle finger segment distal terminal edge 33, and the ring finger segment distal terminal edge 34 are each reinforced by stitching 45. Stitching the forefinger segment, the middle finger segment and the ring finger segment along or around the opening is very important because the opening would otherwise easily tear, destroying the finger segments and therefore the glove, making the glove inoperable. Therefore the stitching 45 is adapted to encircle the entire distal terminal edges 32, 33, 34 in order to be effective at preventing tearing along the forefinger terminal edge 32, the middle finger terminal edge 33 and the ring finger terminal edge 34.

The wrist portion 17 is expansible so as to hold more securely to the user's wrist. Therefore the embodiment also has an expandable opening means 20 at a wrist end comprises an elastic material 20 along the wrist portion, such as an elastomeric band 20 fixed around throughout the wrist portion. In addition, the glove further comprises a securement opening means 22 at the open end of the glove body dorsal portion for fastening the glove body secure about the wrist area, critical in sports activities where the user's hand moves very rapidly such as in golf or football. The securement opening means may be unitary with the glove body and may include strap and strap capture mechanism such as VELCRO fasteners 23, 24, buttons, and the like or other suitable closures thereon. The securement opening means allows the user to ensure a tight fit around the user's hand so that it will not disengage from the user's hand during high velocity sport movements such as swinging a driving wood golf club or throwing a Hail Mary football pass. The securement opening means also allows the user to quickly engage and disengage the glove, important aspects during active sports play such as in golf and in football. The wrist portion further comprises a slit 25. The slit allows the user to quickly take off or put on the glove, and doing so very easily.

Providing a slit and securement opening means is especially valuable to users who play a sport that requires the constant removal of the glove, such as in football—where players generally take off their gloves during a change of possession, and golf—where virtually all players take off their glove when preparing to putt a golf ball. The securement opening means is adapted to allow the user to mechanically stretch the securement opening means, such as a strap across the slit and fasten the glove to the user's hand.

This embodiment further shows how the present invention may comprise a grip enhancing mechanism. Although the embodiment now provides a higher coefficient of friction on a golfer's weak hand, one now can further increase grip areas by adding a grip enhancing mechanism on select areas or on the entire palmar surface of the glove.

This embodiment may also comprise a detachable ball marker 26. A ball marker is often used when playing golf. During certain times, such as when reaching the green or when obstructing another player's direct path to the golf hole, the golfer may pick his ball and place a ball marker directly behind the golf ball; the golfer can then pick up the golf ball. The embodiment provides a convenient, detachable ball marker on the glove. The detachable ball marker in this embodiment is a small circular object with a design that points to where the golf ball exactly is located.

The detachable ball marker 26 is secured by any standard fastening means 28, such as by a compartment 28, by magnetism or snap fastening, for example. The illustrated embodiment shows a compartment 28 within the strap on the dorsal segment of the glove. The compartment secures the ball marker by VELCRO fasteners 19, 29, but other commonly known fasteners will work just as well. The ball marker may be circular or non-circular in design.

Additionally, embodiments may offer a liner 46 in the interior of the glove using methods known in the art, such as stitching. The liner 46 may be integrally formed on the glove. For example, the liner (or sleeve) could be attached to the glove by standard methods, such as by conventional stitching about the perimeter of the dorsal segment, the palmar segment or both.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic 46 could also be preferred. Additionally, the liner may provide added features to offer warmth and comfort such as by comprising of a fleece material, for example, especially useful when competing in harsher conditions or during extended practices on the golf range, for example. The liner may be infused with Aloe Vera 47.

It will be apparent to one of ordinary skill in the art that many other implementations of liners are possible.

A plurality of moisture management micro recesses 49 of about 0.120 millimeters in diameter may be randomly disposed throughout the front and back of the glove body and on any finger and thumb stalls of the glove, thereby providing added comfort and more ventilation.

The dorsal surface may comprise of a different material than the palmar surface, such as a more durable fabric, but would preferably also be rather flexible. If the dorsal surface is comprised of more durable fabrics, such as synthetic leather, then some added elasticity capabilities may be also preferable on select areas of the dorsal surface, in particular around the metacarpophalangeal joints. For example, the dorsal surface may comprise of an aperture on the forefinger's metacarpophalangeal joint, the middle finger's metacarpophalangeal joint, the ring finger's metacarpophalangeal joint, and on the pinkie finger's metacarpophalangeal joint. Alternatively, embodiments may simply comprise of a more elastic material, such as any of those aforementioned such as spandex, on the dorsal surface overlaying said metacarpophalangeal joints, or seams or slits, while the rest of the dorsal surface is comprised of a more durable material. The elastic material could be stitched onto those areas, and therefore replacing the more durable materials along those select areas.

The palmar and dorsal surfaces, and any wrist portions, may then be conjoined on any finger and thumb portions, dorsal and palm portions and a wrist portion using any standard methods, such as by stitching, thus defining a pocket for receiving a user's hand.

The materials forming the illustrated embodiment may comprise those discussed in reference to the present invention. Likewise, any previously discussed methods of construction may be applied to this embodiment. For example, the dorsal surface may comprise of a different material than the palmar surface, such as a more durable fabric, but would preferably also be rather flexible. If the dorsal surface is comprised of more durable fabrics, such as synthetic leather, then some added elasticity capabilities may be also preferable, though not required, on select area of the dorsal surface, in particular around the metacarpophalangeal joints 21. For example, the dorsal surface may comprise of an aperture on the forefinger's metacarpophalangeal joint, the middle finger's metacarpophalangeal joint 21, the ring finger's metacarpophalangeal joint 21, and on the pinkie finger's metacarpophalangeal joint 21. Alternatively, embodiments may simply comprise of a more elastic material on the dorsal surface overlaying said metacarpophalangeal joints while the rest of the dorsal surface is comprised of a more durable material. The elastic material could be stitched onto those areas, and therefore replacing the more durable materials along those select areas. The shape of these apertures are in the shape of hearts 21.

It is commonly known that wrist bands have been constructed with perspiration absorbing capabilities, allowing an athlete to wipe perspiration away from their face during competition. Where wrist bands are not commonly used, such as in golf play, the athletes are currently left deficient in this area unless they are handed a towel to wipe off the perspiration. As such, a moisture absorbent material 457 can be provided along the dorsal portion of embodiments allowing a wearer to wipe off perspiration commonly on a wearer's face during active sports play. The moisture absorbent material may be secured anywhere along the dorsal surface of the glove body. The moisture absorbent material may be formed of any moisture absorbent material aforementioned, such as, for example, about 1/12 inch terry cloth 458 or absorbent foam stitched onto the dorsal portion surface of the glove body.

The palmar and dorsal surfaces, and any wrist portions, may then for example be conjoined on any finger and thumb portions, dorsal and palm portions and a wrist portion using any standard methods, such as by stitching, thus defining a pocket for receiving a user's hand.

Figure 3:
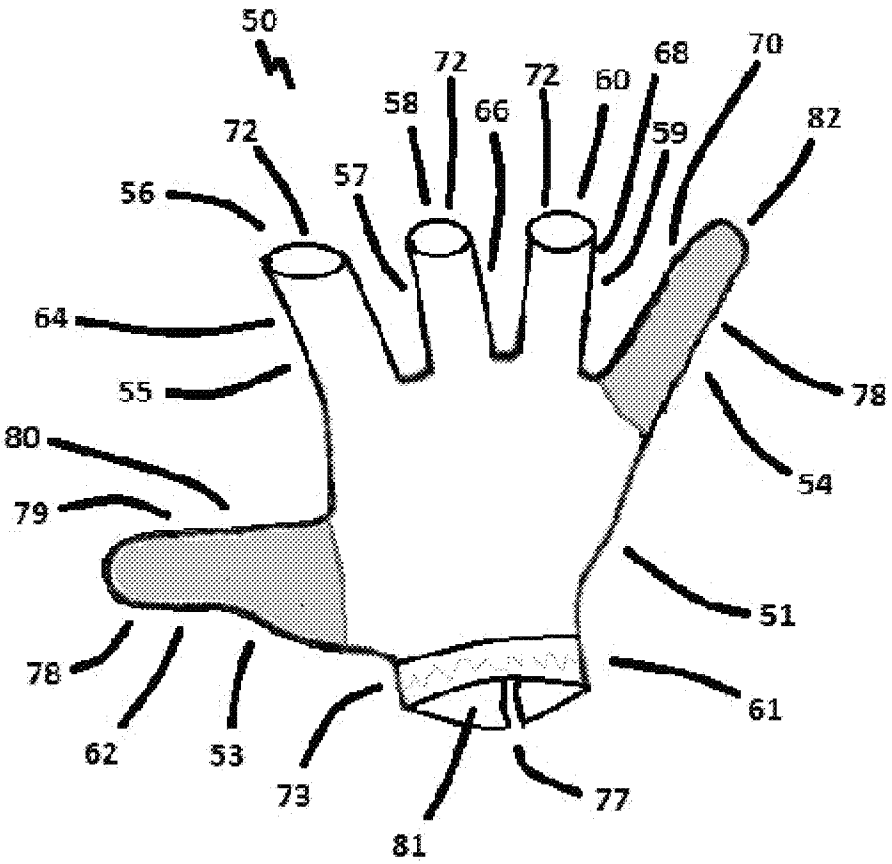
Figure 4:
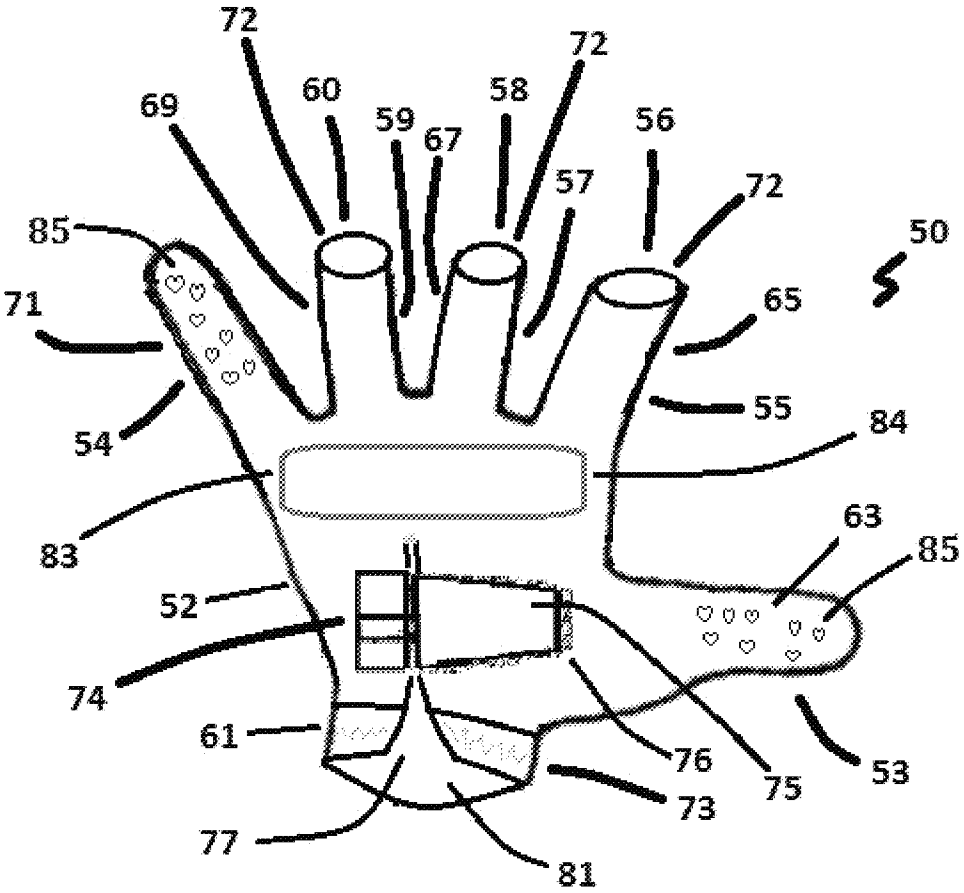

Referring now to FIG. 3 and FIG. 4, an embodiment of the present invention is shown and designated as 50. The palmar view of a glove is drawn in FIG. 3 and the dorsal view of the same glove is drawn in FIG. 4. This partial-fingered embodiment provides a glove having a dorsal portion 52, a palmar portion 51 for overlaying respective back and palm regions of a human hand, said dorsal and palmar portions having distal and proximal ends with a plurality of digital segments (or stalls) projecting from said distal ends. The glove includes a glove body having a back portion 52 covering the back of a user's hand, and a front portion 51 covering the palm or front of the hand when the glove is worn.

In the illustrated embodiment the glove is constructed such that it includes a thumb digital segment 53 that fully encloses a user's thumb, including enclosing the fingertips, and a pinkie digital segment 54 that fully encloses the user's pinkie finger, including enclosing the fingertips when the glove is worn.

In addition, the glove has a forefinger digital segment 55 with a distal terminal edge 56. Said forefinger digital segment has a proximal phalanx section that is adapted to extend to cover the entire proximal phalanx of the user's forefinger but does not cover the fingertip of the forefinger when the glove is worn. In other words, the forefinger digital segment is adapted to expose at least a significant portion of the user's distal phalanx when the glove is worn such that the skin of the fingertip can touch a device or sports object, thereby allowing heightened tactile sensitivities along the fingertip and simultaneously enhancing grip capabilities along the covered proximal phalanx of the user's forefinger. Additionally, the forefinger digital segment further has a middle phalanx section that is adapted to cover the user's middle phalanx when the glove is worn, defining the forefinger segment. Covering the proximal phalanx allows the user to maintain grip along the area where the proximal phalanx grips a golf club for example, while exposing the distal phalanx gives the user heightened tactile sensitivities along the area where the distal phalanx interlock with the opposing hand's pinkie finger, for example.

In addition, the glove has a middle finger digital segment 57 with a distal terminal edge 58. Said middle finger digital segment has a proximal phalanx section that is adapted to extend to cover the entire proximal phalanx of the user's middle finger but does not cover the fingertip of the middle finger when the glove is worn. In other words, the middle finger digital segment is adapted to expose a significant portion of the user's distal phalanx when the glove is worn, thereby allowing heightened tactile sensitivities along the fingertip and simultaneously enhancing grip capabilities along the covered proximal phalanx of the user's middle finger. Additionally, the middle finger digital segment further has a middle phalanx section that is adapted to cover the user's middle phalanx when the glove is worn, defining the middle finger segment. Covering the proximal phalanx allows the user to maintain grip along the area where the proximal phalanx grips a golf club for example, while exposing the distal phalanx gives the user heightened tactile sensitivities along the distal phalanx such that the skin of the fingertip can touch a device or sports object, thereby allowing for heightened sensitivity along the middle portion of the user's hand along the golf club during the golf swing, for example.

In addition, the glove has a ring finger digital segment 59 with a distal terminal edge 60. Said ring finger digital segment has a proximal section that is adapted to extend to cover the entire proximal phalanx of the user's ring finger but does not cover the fingertip of the ring finger when the glove is worn. In other words, the ring finger digital segment is adapted to expose a significant portion of the user's distal phalanx when the glove is worn such that the skin of the fingertip can touch a device or sports object, thereby allowing heightened tactile sensitivities along the fingertip and simultaneously enhancing grip capabilities along the covered proximal phalanx of the user's ring finger. Additionally, the ring finger digital segment further has a middle phalanx section is adapted to cover the user's middle phalanx when the glove is worn, defining the ring finger segment. Covering the proximal phalanx allows the user to maintain grip along the area where the proximal phalanx grips a golf club for example, while exposing the distal phalanx gives the user heightened tactile sensitivities along the distal phalanx thereby allowing for heightened sensitivity along the middle portion of the user's hand along the golf club during the golf swing, for example.

The glove also has a wrist portion 61 that surrounds the wrist of the user. The thumb stall 53 is defined by a dorsal portion 63 and a palmar portion 62. The forefinger stall 55 is defined by a dorsal portion 65 and a palmar portion 64. The middle finger stall 57 is defined by a dorsal portion 67 and a palmar portion 66. The ring finger stall 59 is defined by a dorsal portion 69 and a palmar portion 68. The pinkie finger stall 54 is defined by a dorsal portion 71 and a palmar portion 70.

Additionally, the distal terminal edge of the forefinger digital segment, the distal terminal edge of the middle finger digital segment, and the distal terminal edge of the ring finger digital segment are each further sealed 72. When cutting certain materials to form the glove such as synthetic materials 55, 57, 59 including synthetic leather it is virtually impossible to keep the edges from fraying and splitting, or from allowing atmospheric moisture to enter into the material through the formed edges, thereby eroding and destroying the glove material. Therefore it is preferable that the terminal edge 56 of the forefinger digital segment, the middle finger digital segment 58 and the ring finger digital segment 60 be permanently sealed 72, preferably by hot knife sealing 72 or stitching. The industrial hot knife is preferably used to melt the fabric edges of the terminal edge such that the terminal edge is entirely sealed thereby preventing fraying, fabric splitting, and atmospheric moisture from entering into the glove body through the terminal edges. If any portion of the distal terminal edge is not sealed, in other words if there portions along the terminal edge which are not completely sealed, these portions along the terminal edge will fray or split eroding the integrity of the glove structure and its valuable and unique benefits to the user. Hot knife sealing will also create a smooth finish along the entire distal terminal edge allowing for easier glove application principally be allowing the user's fingertips to smoothly engaging and disengaging the respective digital segment. Hot knife sealing can only be performed on certain materials such as synthetic leathers and plastics otherwise the material will burn and cause harm. Cotton material for example will burn and therefore hot knife sealing cannot be performed on that type of material.

The wrist portion 61 is expansible so as to hold more securely to the user's wrist. Therefore the embodiment also has an expandable opening means 73 at a wrist end comprises an elastic material 73 along the wrist portion 61, such as an elastomeric band 73 fixed around throughout the wrist portion. In addition, the glove further comprises a securement opening means 74 at the open end of the glove body dorsal portion for fastening the glove body secure about the wrist area, critical in sports activities where the user's hand moves very rapidly such as in golf or football. The securement opening means may be unitary with the glove body and may include strap and strap capture mechanism such as VELCRO fasteners 75, 76, buttons, and the like or other suitable closures thereon. The securement opening means allows the user to ensure a tight fit around the user's hand so that it will not disengage from the user's hand during high velocity sport movements such as swinging a driving wood golf club or throwing a Hail Mary football pass. The securement opening means also allows the user to quickly engage and disengage the glove, important aspects during active sports play such as in golf and in football. The wrist portion further comprises a slit 77. The slit allows the user to quickly take off or put on the glove, and doing so very easily.

Providing a slit and securement opening means is especially valuable to users who play a sport that requires the constant removal of the glove, such as in football—where players generally take off their gloves during a change of possession, and golf—where virtually all players take off their glove when preparing to putt a golf ball. The securement opening means is adapted to allow the user to mechanically stretch the securement opening means such as a strap, across the slit and fasten the glove to the user's hand.

This embodiment further shows how the present invention may comprise a grip enhancing mechanism 78 and thereby provide a higher coefficient of friction on select areas of the glove palmar surface.

The grip enhancing mechanism may comprise of a plurality of projections, a plurality of depressions or tackifiers including tackifier resins, such as rosins and their derivatives, terpenes, aliphatic, cycloaliphatic and aromatic resin, and any of a variety of hydrocarbon-type resins, tackifier coatings, tackified materials such tackified leathers and synthetic leathers, and other tackifier substances well commercially known in the art, strategically placed along the palmar portion of the glove body, thus providing very high grip capabilities to a user, especially to football quarterbacks and golfers.

In the illustrated embodiment, the glove palmar portion further comprises of a grip enhancing mechanism comprised of a plurality of discrete tackified locations. More specifically, the entire palmar portion of the thumb digital segment comprises a tackified material 79, such as impregnating a leather 79 with a tackifier resin 80 and then affixing said material onto the rest of the palmar portion of the glove body. This particular configuration provides for maximum grip capabilities for a user, such as a golfer. The less flexible thumb segment is not of importance to a golfer because the weak hand's thumb does not need to bend at any time during a golf swing. In addition, the entire palmar portion of the pinkie digital segment comprises a tackified material 82.

As aforementioned, the grip enhancing mechanism formed of these tackfied materials integral to the glove body or formed of tackified grip enhancing panels, are preferably configured to provide a significantly higher coefficient of friction, preferably of at least between 2.0 and 4.5; Still more preferably of Friction of between 2.5 and 4.5.

Once the grip enhancing mechanism have been formed, they may then be applied to the palmar surface of the glove by any standard methods, such as by stitches or adhesives, for example.

Additionally, embodiments may offer a liner is fixed to the interior of the glove using methods known in the art, such as stitching. The liner 81 may be integrally formed on the glove. For example, the liner (or sleeve) could be attached to the glove by standard methods, such as by conventional stitching about the perimeter of the dorsal segment, the palmar segment or both.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic 81 could also be preferred. Additionally, the liner may provide added features to offer warmth and comfort such as by comprising of a fleece material, for example, especially useful when competing in harsher conditions or during extended practices on the golf range, for example.

It will be apparent to one of ordinary skill in the art that many other implementations of liners are possible.

A plurality of moisture management recesses 85 may be randomly disposed about the front, back and finger and thumb stalls of the glove, thereby providing added comfort and adequate ventilation. This embodiment shows heart shaped recesses 85 on the pinkie digital segment and thumb digital segment.

The dorsal surface may comprise of a different material than the palmar surface, such as a more durable fabric, but would preferably also be rather flexible. If the dorsal surface is comprised of more durable fabrics, such as synthetic leather, then some added elasticity capabilities may be also preferable on select areas of the dorsal surface, in particular around the metacarpophalangeal joints. For example, the dorsal surface may comprise of an aperture on the forefinger's metacarpophalangeal joint, the middle finger's metacarpophalangeal joint, the ring finger's metacarpophalangeal joint, and on the pinkie finger's metacarpophalangeal joint. Alternatively, embodiments may simply comprise of a more elastic material 83, such as any of those aforementioned such as spandex, on the dorsal surface overlaying said metacarpophalangeal joints, or seams or slits, while the rest of the dorsal surface 52 is comprised of a more durable material. The elastic material could be stitched onto those areas, and therefore replacing the more durable materials along those select areas.

The materials forming the illustrated embodiment may comprise those discussed in reference to the present invention. Likewise, any previously discussed methods of construction may be applied to this embodiment. This dorsal segment may be constructed as many standard golf gloves, made primarily of a durable but flexible material, such as synthetic material like synthetic leather, while providing a much more elastic fiber 83 such as spandex 83, along the metacarpophalangeal joints of the four fingers 84 of the user's hand when the glove is worn.

The palmar and dorsal surfaces, and any wrist portions, may then be conjoined on any finger and thumb portions, dorsal and palm portions and a wrist portion using any standard methods, such as by stitching, thus defining a pocket for receiving a user's hand.

Figure 5:
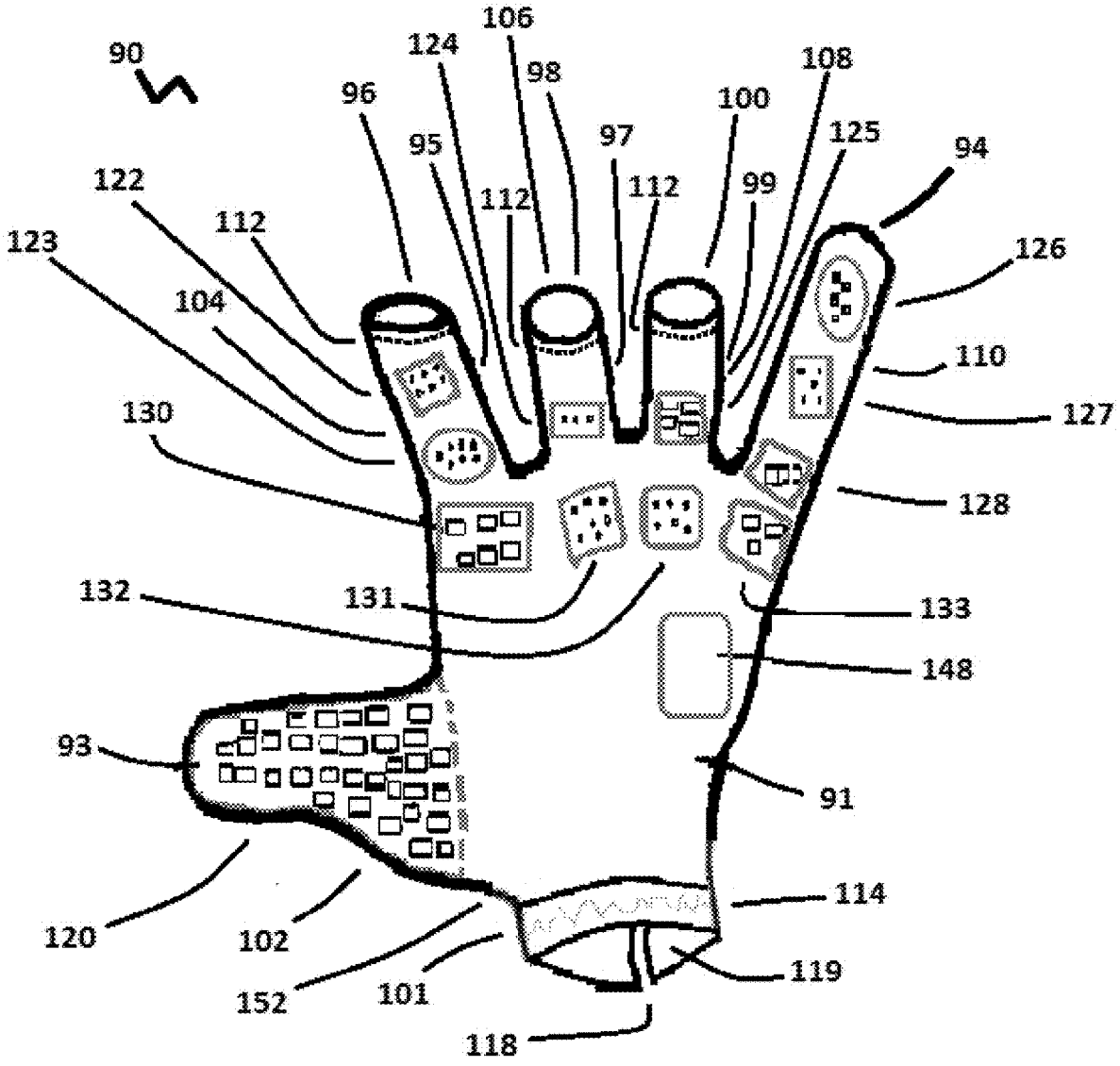
Figure 6:
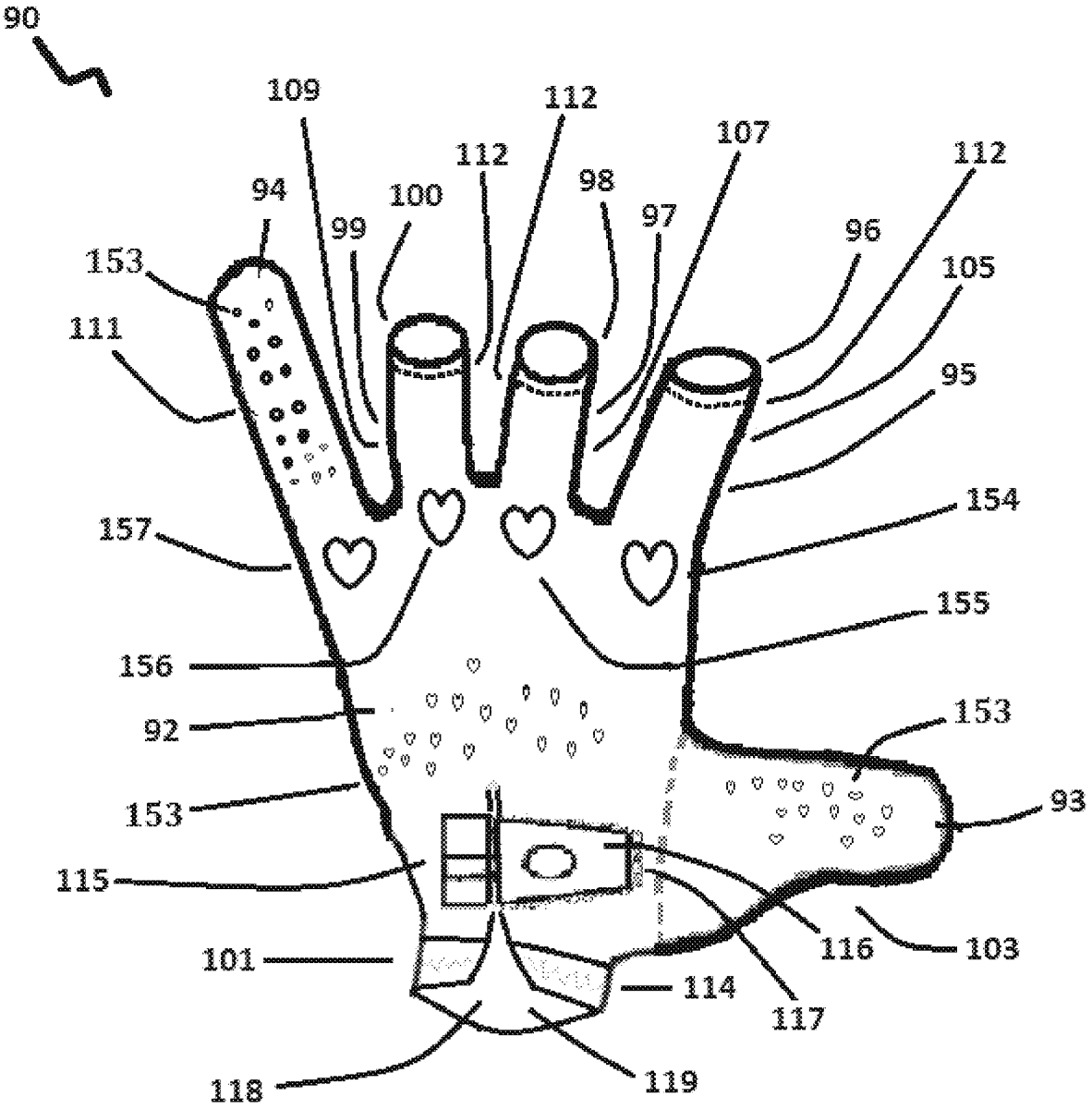

Referring now to FIG. 5 and FIG. 6, an embodiment of the present invention is shown and designated as 90. The palmar view of a glove is drawn in FIG. 5 and the dorsal view of the same glove is drawn in FIG. 6. This partial-fingered embodiment provides a glove having a dorsal portion 92, a palmar portion 91 for overlaying respective back and palm regions of a human hand, said dorsal and palmar portions having distal and proximal ends with a plurality of digital segments (or stalls) projecting from said distal ends. The glove includes a glove body having a back portion 92 covering the back of a user's hand, and a front portion 91 covering the palm or front of the hand when the glove is worn.

In the illustrated embodiment the glove is constructed such that it includes a thumb digital segment 93 that fully encloses a user's thumb, including enclosing the fingertips, and a pinkie digital segment 94 that fully encloses the user's pinkie finger, including enclosing the fingertips when the glove is worn.

In addition, the glove has a forefinger digital segment 95 with a distal terminal edge 96. Said forefinger digital segment has a proximal section that is adapted to extend to cover the entire proximal phalanx and a middle phalanx section that is adapted to cover the entire middle phalanx of the user's forefinger but does not cover the fingertip of the forefinger when the glove is worn, defining the forefinger segment of the glove. In other words, the forefinger digital segment is adapted to expose a significant portion of the user's distal phalanx when the glove is worn such that the skin of the fingertip can touch a device or sports object, thereby allowing heightened tactile sensitivities along the fingertip and simultaneously enhancing grip capabilities along the covered proximal phalanx of the user's forefinger. Covering the proximal phalanx allows the user to maintain grip along the area where the proximal phalanx grips a golf club for example, while exposing the distal phalanx gives the user heightened tactile sensitivities along the area where the distal phalanx interlock with the opposing hand's pinkie finger, for example.

In addition, the glove has a middle finger digital segment 97 with a distal terminal edge 98. Said middle finger digital segment has a proximal section that is adapted to extend to cover the entire proximal phalanx and a middle phalanx section that is adapted to cover the entire middle phalanx of the user's middle finger but does not cover the fingertip of the middle finger when the glove is worn, thereby defining the middle finger segment of the glove. In other words, the middle finger digital segment is adapted to expose a significant portion of the user's distal phalanx when the glove is worn such that the skin of the fingertip can touch a device or sports object, thereby allowing heightened tactile sensitivities along the fingertip and simultaneously enhancing grip capabilities along the covered proximal phalanx of the user's middle finger. Covering the proximal phalanx allows the user to maintain grip along the area where the proximal phalanx grips a golf club for example, while exposing the distal phalanx gives the user heightened tactile sensitivities along the distal phalanx thereby allowing for heightened sensitivity along the middle portion of the user's hand along a golf club during the golf swing, for example.

In addition, the glove has a ring finger digital segment 99 with a distal terminal edge 100. Said ring finger digital segment has a proximal phalanx section that is adapted to extend to cover the entire proximal phalanx and a middle phalanx section that is adapted to cover the entire middle phalanx of the user's ring finger but does not cover the fingertip of the ring finger when the glove is worn, thereby defining the ring finger segment of the glove. In other words, the ring finger digital segment is adapted to expose a significant portion of the user's distal phalanx when the glove is worn such that the skin of the fingertip can touch a device or sports object, thereby allowing heightened tactile sensitivities along the fingertip and simultaneously enhancing grip capabilities along the covered proximal phalanx of the user's ring finger. Covering the proximal phalanx allows the user to maintain grip along the area where the proximal phalanx grips a golf club for example, while exposing the distal phalanx gives the user heightened tactile sensitivities along the distal phalanx thereby allowing for heightened sensitivity along the middle portion of the user's hand along a golf club during the golf swing, for example.

The glove embodiment also has a wrist portion 101 that surrounds the wrist of the user. The thumb stall 93 is defined by a dorsal portion 103 and a palmar portion 102. The forefinger stall 95 is defined by a dorsal portion 105 and a palmar portion 104. The middle finger stall 98 is defined by a dorsal portion 107 and a palmar portion 106. The ring finger stall 99 is defined by a dorsal portion 109 and a palmar portion 108. The pinkie finger stall 94 is defined by a dorsal portion 111 and a palmar portion 110.

Furthermore, the forefinger segment distal terminal edge 96, the middle finger segment distal terminal edge 98, and the ring finger segment distal terminal edge 100 are each reinforced by stitching 112 or by sealing. Stitching the forefinger segment, the middle finger segment and the ring finger segment along or around the opening is very important because the opening would otherwise easily tear, destroying the finger segments and therefore the glove, making the glove inoperable. Therefore the stitching 112 is adapted to encircle the entire distal terminal edges 96, 98, 100 in order to be effective at preventing tearing or fraying along the forefinger terminal edge 96, the middle finger terminal edge 98 and the ring finger terminal edge 100. The finger digital segment distal terminal edges may alternatively be sealed, however. When cutting certain materials such as synthetic materials 91 including synthetic leather 91 it is virtually impossible to keep the edges from fraying and splitting, or from allowing atmospheric moisture to enter into the material through the formed edges, thereby eroding and destroying the glove material. Therefore it is essential that the entire terminal edge of the finger digital segments be permanently sealed or stitched.

The wrist portion 101 is expansible so as to hold more securely to the user's wrist. Therefore the embodiment also has an expandable opening means 114 at a wrist end comprises an elastic material 114 along the wrist portion, such as an elastomeric band 114 fixed around throughout the wrist portion. In addition, the glove further comprises a securement opening means 115 at the open end of the glove body dorsal portion for fastening the glove body secure about the wrist area, critical in sports activities where the user's hand moves very rapidly such as in golf or football. The securement opening means may be unitary with the glove body and may include strap and strap capture mechanism such as VELCRO fasteners 116, 117, buttons, and the like or other suitable closures thereon. The securement opening means allows the user to ensure a tight fit around the user's hand so that it will not disengage from the user's hand during high velocity sport movements such as swinging a driving wood golf club or throwing a Hail Mary football pass. The securement opening means also allows the user to quickly engage and disengage the glove, important aspects during active sports play such as in golf and in football. The wrist portion further comprises a slit 118. The slit allows the user to quickly take off or put on the glove, and doing so very easily.

Providing a slit and securement opening means is especially valuable to users who play a sport that requires the constant removal of the glove, such as in football—where players generally take off their gloves during a change of possession, and golf—where virtually all players take off their glove when preparing to putt a golf ball. The securement opening means is adapted to allow the user to mechanically stretch the securement opening means such as a strap or flap across the slit and fasten the glove to the user's hand.

Additionally, embodiments may offer a liner is fixed to the interior of the glove using methods known in the art, such as stitching. The liner 119 may be integrally formed on the glove. For example, the liner (or sleeve) could be attached to the glove by standard methods, such as by conventional stitching about the perimeter of the dorsal segment, the palmar segment or both.

This embodiment further shows how the present invention may comprise a grip enhancing mechanism. The grip enhancing mechanism creates a higher coefficient of friction then the surrounding glove palmar surface.

This embodiment further shows how the present invention may comprise a grip enhancing mechanism 120, 121, 122, 123, 124, 125, 126, 127, 128, 130, 131, 132, 133, 148 along the glove palmar surface. Although the embodiment now provides a higher coefficient of friction than what the skin of throwing hand of a quarterback or a golfer's dominant hand would otherwise provide for example, one may now further increase grip areas by adding a grip enhancing mechanism on select areas of the palmar portion of the glove. In general, the grip enhancing mechanism of the present invention may be integral to the glove or may be affixed to the glove surface by, for example, forming a grip enhancing panel and applying the panel onto a portion of the palmar portion of the glove body.

The glove body may include a grip enhancing mechanism comprising a plurality of depressions or a plurality of projections formed on select areas of the palmar portion, thereby creating a higher coefficient than on the rest of the glove body.

Formed on the illustrated glove is a plurality of depressions 120, 121, 122, 123, 124, 125, 126, 127, 128, 130, 131, 132, 133 and tackified materials 148. These square-like and circular depressions preferably are spaced apart to allow for added grip and flexibility. The plurality of depressions are preferably provided on at least one phalanx of any finger stalls 120, 121, 122, 123, 124, 125, 126, 127, 128.

The grip enhancing mechanism comprising a plurality of depressions overlay, more specifically, for example, the entire palmar portion 120 of the thumb stall palmar segment 93. In addition, a plurality of depressions overlay the middle phalanx 122, and the proximal phalanx 123 of the forefinger stall palmar portion. In addition, a plurality of depressions over the proximal phalanx 124 of the middle finger stall palmar portion. In addition, a plurality of depressions overlay the proximal phalanx 125 of the ring finger stall palmar portion. In addition, a plurality of depressions overlay the distal phalanx 126, the middle phalanx 127 and the proximal phalanx 128 of the pinkie finger. In addition, a plurality of depressions overlay the forefinger metacarpophalangeal joint 130, the middle finger metacarpophalangeal joint 131, the ring finger metacarpophalangeal joint 132, and pinkie finger metacarpophalangeal joint 133.

The grip enhancing mechanism comprising a plurality of depressions may be integrally formed on, or may be affixed to the glove body palmar portion. For example, the plurality of depressions may be affixed the glove body by forming said plurality of depressions onto a panel, and then affixed the panel onto select areas of the glove body by any standard methods, such as by stitching or adhesion for example.

The grip enhancing mechanism provide a higher and more effective coefficient of friction than the rest of the glove body palmar surface.

Furthermore, a grip enhancing mechanism 148 overlays the pinkie finger's metacarpal. Said grip enhancing mechanism comprises a discrete grip enhancing panel 148 that overlays the pinkie finger's metacarpal, whereby said grip enhancing panel is a tackified material 148; said grip enhancing panel is configured to overlay the pinkie finger metacarpal, in part or in its entirety, but not to extend beyond said metacarpal. Providing a grip enhancing mechanism along this location provides increased grip along a critical grip area especially important when controlling a football. In addition, many novice golfers find it difficult to keep the golf club shaft from moving on the downswing. Often, the shaft will be held toward the top of the pinkie metacarpal, closest to the metacarpophangeal joint, but as a golfer completes the downswing, the shafts uncontrollably moves down toward the bottom of the pinkie metacarpal, clearly resulting in inconstant golf swings. Thus, providing a grip enhancing mechanism along the pinkie metacarpal will serve to resolve these grip deficiencies.

Once the grip enhancing panels have been formed, these panels may then be applied to the palmar surface of the glove by any standard methods, such as by stitches or adhesives, for example.

Additionally, embodiments such as this one, may be completely coated with a with a water repellant substance 152 such as a synthetic resin 152 on the glove palmar surface or throughout the entire glove. The glove may also provide a plurality of moisture management recesses 153 in the form of micro recesses of about 0.120 millimeters or so in diameter may be randomly disposed about the front, back and finger and thumb stalls of the glove, thereby providing added comfort and more ventilation.

The materials forming the illustrated embodiment may comprise those discussed in reference to the present invention. Likewise, any previously discussed methods of construction may be applied to this embodiment. The dorsal surface may comprise of a different material than the palmar surface, such as a more durable fabric, but would preferably also be rather flexible. If the dorsal surface is comprised of more durable fabrics, such as synthetic leather, then some added elasticity capabilities may be also preferable on select areas of the dorsal surface, in particular around the metacarpophalangeal joints. For example, the dorsal surface may comprise of an aperture 154, 155, 156, 157 on the forefinger's metacarpophalangeal joint 154, the middle finger's metacarpophalangeal joint 155, the ring finger's metacarpophalangeal joint 156, and on the pinkie finger's metacarpophalangeal joint 157. Said apertures 154, 155, 156, 157 are in the shape of hearts.

The palmar and dorsal surfaces, and any wrist portions, may then be conjoined on any finger and thumb portions, dorsal and palm portions and a wrist portion using any standard methods, such as by stitching, thus defining a pocket for receiving a user's hand.

Figure 7:
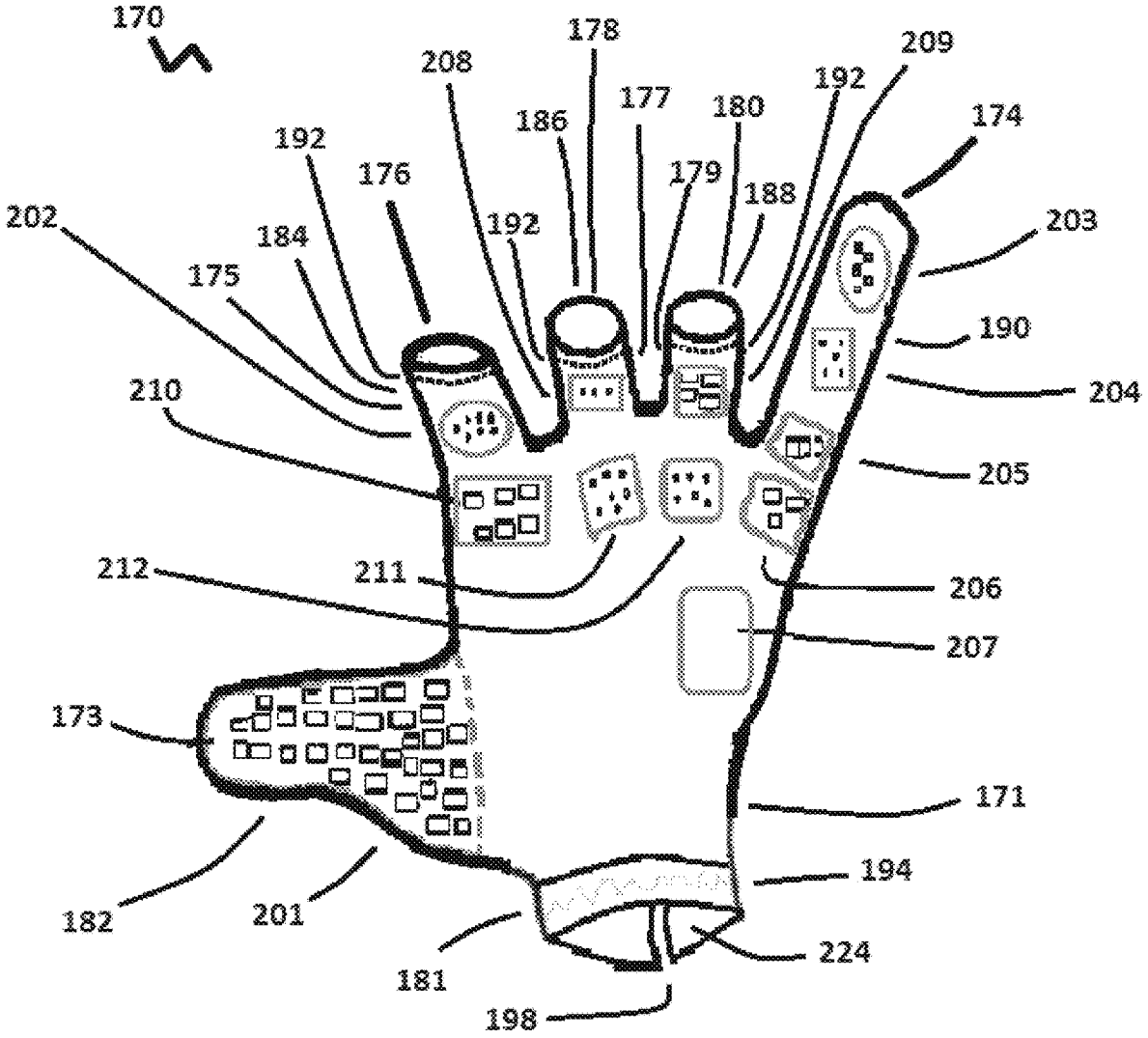
Figure 8:
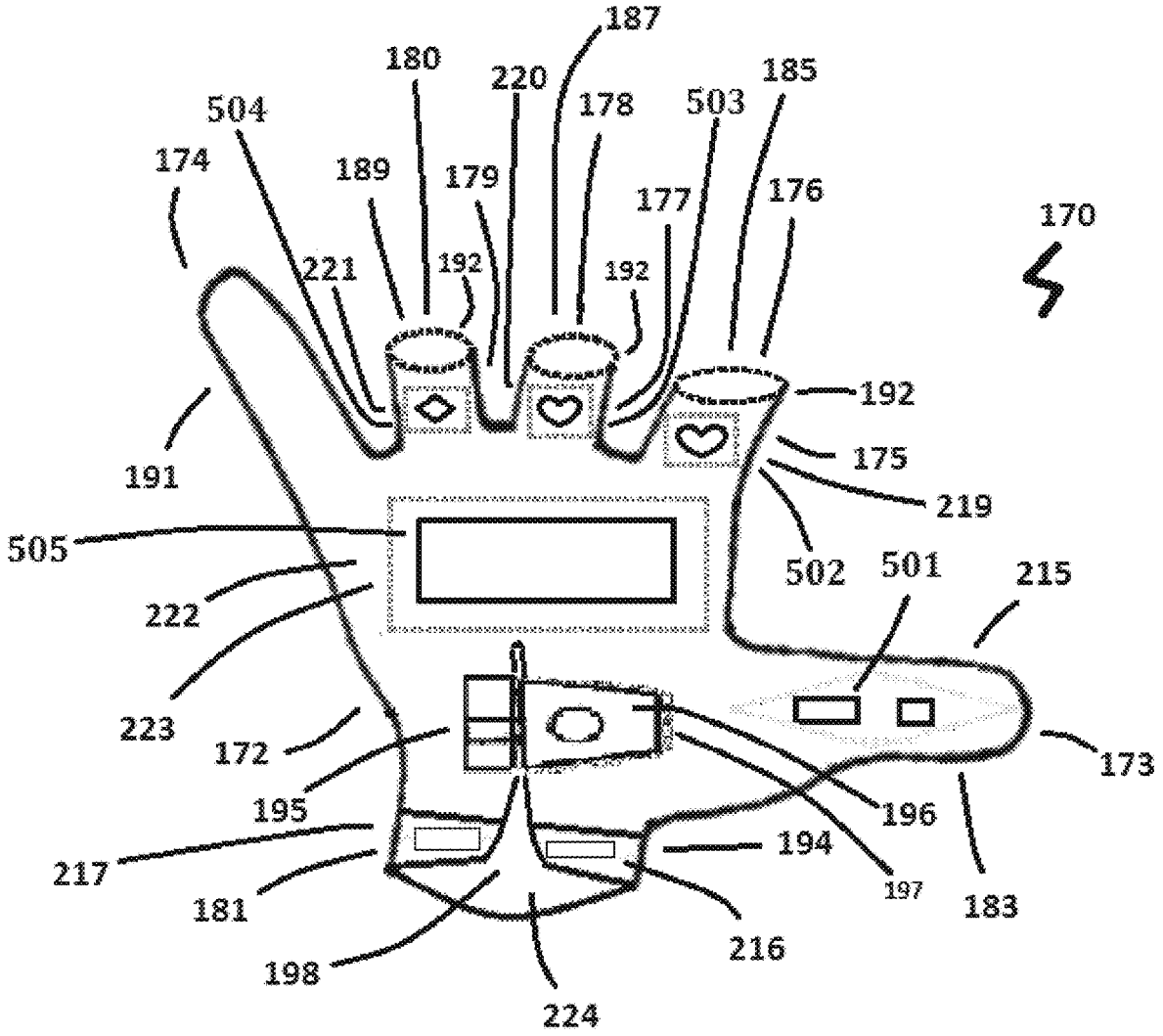
FIG. 8 is a drawing of the embodiment as described in FIG. 7, showing the dorsal view.

Referring now to FIG. 7 and FIG. 8, another embodiment of the athletic glove of the present invention is shown and designated as 170. The palmar (front) view of an embodiment is drawn in FIG. 7 and the dorsal (back) view of the same glove is drawn in FIG. 8. This partial-fingered embodiment provides a glove having a dorsal portion 172 and a palmar portion 171 for overlaying respective back and palm regions of a human hand, said dorsal and palmar portions having distal and proximal ends with a plurality of digital segments (or stalls) projecting from said distal ends. The glove includes a glove body having a back portion 172 covering the dorsal surface of a user's hand, and a front portion 171 covering essentially the entire palm surface of the hand when the glove is worn. The glove body includes finger segments and a thumb segment each adapted to receive a finger or thumb, respectively, therein.

In the illustrated embodiment the glove is constructed such that it includes a thumb digital segment 173 that fully encloses a user's thumb, including enclosing the fingertips, and a pinkie digital segment 174 that fully encloses the user's pinkie finger, including enclosing the fingertips when the glove is worn. Enclosing the thumb and pinkie finger significantly increases the user's grip of a football, for example, by substantially increasing the user's grip at the two opposite ends of the football simultaneously when throwing a football for example.

In addition, the glove has a forefinger digital segment 175 with a distal terminal edge 176. Said forefinger digital segment is adapted to extend to cover the entire proximal phalanx of the user's forefinger but does not cover any portion of the user's distal phalanx when the glove is worn. In other words, the forefinger digital segment is adapted to expose the user's distal phalanx when the glove is worn such that the skin of the fingertip can touch a device or sports object, thereby allowing heightened tactile sensitivities along the fingertip and simultaneously enhancing grip capabilities along the covered proximal phalanx of the user's forefinger. In addition, the forefinger digital segment is adapted to cover at least a portion the user's middle phalanx, defining the forefinger segment of the glove. Covering the proximal phalanx allows the user to maintain grip along the area where the proximal phalanx is unsupported by the football laces when throwing a football for example, thereby increasing the user to impart more spin and accuracy when throwing the football.

In addition, the glove has a middle finger digital segment 177 with a distal terminal edge 178. Said middle finger digital segment is adapted to extend to cover the entire proximal phalanx of the user's middle finger but does not cover any portion of the user's distal phalanx when the glove is worn. In other words, the middle finger digital segment is adapted to expose the user's distal phalanx when the glove is worn such that the skin of the fingertip can touch a device or sports object, thereby allowing heightened tactile sensitivities along the fingertip and simultaneously enhancing grip capabilities along the covered proximal phalanx of the user's middle finger. In addition, the middle finger digital segment is adapted to cover at least a portion the user's middle phalanx, defining the middle finger segment of the glove. Covering the proximal phalanx allows the user to maintain grip along the area where the proximal phalanx is unsupported by the football laces when throwing a football for example, while exposing the distal phalanx allows the user to place the middle finger's fingertip on top of the football laces unencumbered by a glove material.

In addition, the glove has a ring finger digital segment 179 with a distal terminal edge 180. Said ring finger digital segment is adapted to extend to cover the entire proximal phalanx of the user's ring finger but does not cover any portion of the user's distal phalanx when the glove is worn. In other words, the ring finger digital segment is adapted to expose the user's distal phalanx when the glove is worn such that the skin of the fingertip can touch a device or sports object, thereby allowing heightened tactile sensitivities along the fingertip and simultaneously enhancing grip capabilities along the covered proximal phalanx of the user's ring finger. In addition, the ring finger digital segment is adapted to cover at least a portion the user's middle phalanx, defining the ring finger segment of the glove. Covering the proximal phalanx allows the user to maintain grip along the area where the proximal phalanx is unsupported by the football laces when throwing a football for example, while exposing the distal phalanx allows the user to place the ring finger's fingertip on top of the football laces unencumbered by a glove material.

The glove also has a wrist portion 181 that surrounds the wrist of the user. The thumb stall 173 is defined by a dorsal portion 183 and a palmar portion 182. The forefinger stall 175 is defined by a dorsal portion 185 and a palmar portion 184. The middle finger stall 177 is defined by a dorsal portion 187 and a palmar portion 186. The ring finger stall 179 is defined by a dorsal portion 189 and a palmar portion 188. The pinkie finger stall 174 is defined by a dorsal portion 191 and a palmar portion 190.

Furthermore, the forefinger segment distal terminal edge 176, the middle finger segment distal terminal edge 178, and the ring finger segment distal terminal edge 180 are each reinforced by stitching 192 or by sealing. Stitching the forefinger segment, the middle finger segment and the ring finger segment along or around the opening is important because the opening would otherwise easily tear, destroying the finger segments and therefore the glove, making the glove inoperable. Therefore the stitching 192 is adapted to encircle the entire distal terminal edges 176, 178, 180 in order to be effective at preventing tearing along the forefinger terminal edge 176, the middle finger terminal edge 178 and the ring finger terminal edge 180.

The wrist portion 181 is expansible so as to hold more securely to the user's wrist. Therefore the embodiment also has an expandable opening means 194 at a wrist end comprises an elastic material 194 along the wrist portion, such as an elastomeric band 181 fixed around throughout the wrist portion. In addition, the glove further comprises a securement opening means 195 at the open end of the glove body dorsal portion for fastening the glove body secure about the wrist area, critical in sports activities where the user's hand moves very rapidly such as in golf or football. The securement opening means includes a strap 195 which may be unitary with the glove body and may include VELCRO fasteners 196, 197, buttons, and the like or other suitable closures thereon. The strap means allows the user to ensure a tight fit around the user's hand so that it will not disengage from the user's hand during high velocity sport movements such as swinging a driving wood golf club or throwing a Hail Mary football pass. The strap means also allows the user to quickly engage and disengage the glove, important aspects during active sports play such as in golf and in football. The wrist portion further comprises a slit 198. The slit allows the user to quickly take off or put on the glove, and doing so very easily.

Providing a slit and securement opening means is especially valuable to users who play a sport that requires the constant removal of the glove, such as in football—where players generally take off their gloves during a change of possession, and golf—where virtually all players take off their glove when preparing to putt a golf ball. The securement opening means is adapted to allow the user to mechanically stretch the securement opening means such as a strap across the slit and fasten the glove to the user's hand.

This embodiment further shows how the present invention may also comprise a grip enhancing mechanism 201, 202, 203, 204, 205, 208, 209, 206, 207, 210, 211, 212. Although the embodiment now provides a higher coefficient of friction on the throwing hand of a quarterback or on a golfer's dominant hand, one may now further increase grip areas by adding a grip enhancing mechanism on select areas.

In general, the grip enhancing mechanism of the present invention may be integral to the glove or may be affixed to the glove surface by, for example, forming a grip enhancing panel and applying the panel onto a portion of the glove.

The glove body may include a grip enhancing mechanism comprising a plurality of depressions or a plurality of projections formed on select areas of the palmar portion, thereby creating a higher coefficient than on the rest of the glove body palmar surface.

Formed on the illustrated glove is a plurality of projections 201, 202, 203, 204, 205, 208, 209, 206, 207, 210, 211, 212. These circular projections preferably are spaced apart to allow for added grip and flexibility.

The illustrated embodiment has a grip enhancing mechanism on select areas of the front of the hand, specifically along the four digital segments as well as along the region between the thumb and forefinger segments. The grip enhancing mechanism comprises oval projections, each having a height of at least about three hundred micrometers, and are further grouped in diamond shaped clusters to allow for greater hand flexibility and movement.

The grip enhancing mechanism comprising a plurality of oval projections 201, 202 are located on the thumb stall 201 and forefinger stall 202 such that it only overlays the user's proximal phalanx when the glove is worn, to maximize grip abilities of a user's thumb and forefinger. In addition, a grip enhancing mechanism comprising a plurality of projections located along substantially the entire pinkie finger palmar portion 203, 204, 205. In addition, a grip enhancing mechanism comprising a plurality of projections 206 overlay substantially the pinkie finger's metacarpophalangeal joint, and an additional one on a substantial portion of the pinkie finger's metacarpal 207 and formed from a nitrile material 207, for example.

In addition, a grip enhancing mechanism comprising of a plurality of projections overlay the proximal phalanx 208 of the middle finger stall palmar portion but does not overlay any portion of the user's distal phalanx when the glove is worn. In addition, a plurality of projections overlay the proximal phalanx 209 of the ring finger stall palmar portion but does not overlay any portion of the user's distal phalanx when the glove is worn as the digital segment does not overlay the distal phalanx.

In the illustrated embodiment, the grip enhancing mechanism further comprises a plurality of projections overlaying key areas of the user's palm surface, including and on any finger metacarpophalangeal joints, such as the forefinger metacarpophalangeal joint 210, the middle finger metacarpophalangeal joint 211, and the ring finger metacarpophalangeal joint 212.

The grip enhancing mechanism comprising of these grip enhancing panels preferably provide a higher and more effective coefficient of friction than the material forming the surrounding palmar portion of the glove body.

Additionally, embodiments such as this one, may be completely coated with a with a water repellant substance such as SCOTCH GUARD on the palmar surface or throughout the entire glove. Alternatively, moisture management recesses in the form of a plurality of micro recesses of about 0.120 millimeters or so in diameter may be randomly disposed about the front, back and finger and thumb stalls of the glove, thereby providing added comfort and more ventilation.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example. One could use any standard method of manufacture and assembly or construction.

The embodiment is suitably a substantially conventionally constructed sports glove, modified as aforementioned. This particular glove can be made of a polyester and cotton blend for superior comfort or of a synthetic leather latex coated glove for added durability. Other materials that could comprise these glove embodiments include, but are not limited to woven materials that include natural, synthetic or blends of natural and synthetic yarns, thermoextruded or thermoset rubbery embodiments including those made from thermoplastic elastomers, and cloths. Examples of synthetic yarns include nylon, polyester, and spandex (polyurethane) yarns. Additionally, embodiments such as this one, may be coated with a with a water repellant substance, such as a synthetic resin throughout the entire outer surface of the glove.

Embodiments may also preferably comprise of a shock-absorbing member 215, 219, 220, 221, 222, 216, 217 along any portion of the dorsal surface 172, such as any or all existing finger and thumb stalls, along the dorsal surface overlaying any or all of the metacarpals, or combinations thereof.

Embodiments may preferably comprise a shock-absorbing member 215 along substantially all of the dorsal surface overlaying the thumb of the user's hand when the glove is worn. The shock-absorbing member overlaying the user's thumb is in the pattern of a diamond 215, and is configured as a padded segment 215 that is adapted to overlay the user's proximal and distal phalanges of the user's thumb when the glove is worn. Other embodiments may prefer to overlay the thumb as separate padding segments, for example, to allow for significant finger flexibility by having one pad overlaying only the proximal phalanx, and a second pad overlaying only the distal phalanx of the thumb. By not covering any of the thumb joints you have added flexibility but less protection.

The length of the shock-absorbing member is further restricted to the length of the thumb segment extending from the glove and, as mentioned, the dorsal surface area of the thumb segment 183—allowing for the shock-absorbing member to extend circumferentially along the sides of the thumb segment but not extending onto the palmar surface of the thumb segment, therefore not extending over one hundred and eighty degrees.

This embodiment also has a shock-absorbing member 219 along substantially all of the dorsal surface overlaying the forefinger of the user's hand when the glove is worn. The shock-absorbing member overlaying the forefinger is in the pattern of a square 219, and is configured as a one pad segment 219.

The length of the shock-absorbing member is further restricted to the length of the forefinger segment extending from the glove and, as mentioned, the dorsal surface area of the forefinger segment 185—allowing for the shock-absorbing member to extend circumferentially along the sides of the forefinger segment but not extending onto the palmar surface of the forefinger segment.

This embodiment also has a shock-absorbing member 220 along substantially the dorsal surface overlaying the proximal phalanx of the middle finger but does not extend to cover any portion the middle finger's distal phalanx when the glove is worn. The shock-absorbing member overlaying the middle finger is in the pattern of a square 220, and is configured as a one pad segment 220, for example. The length of the shock-absorbing member would further be restricted to the length of the middle finger segment extending from the glove and, as mentioned, the dorsal surface area of the middle finger segment 187—allowing for the shock-absorbing member to extend circumferentially along the sides of the middle finger segment but not extending onto the palmar surface of the middle finger segment.

This embodiment also has a shock-absorbing member 221 along the dorsal surface overlaying the proximal phalanx of the ring finger but does not extend to cover any portion the ring finger's distal phalanx when the glove is worn. The shock-absorbing member overlaying the ring finger is in the pattern of a square 221, and is configured as a one pad segment 221. The length of the shock-absorbing member would further be restricted to the length of the ring finger segment extending from the glove and, as mentioned, the dorsal surface area of the ring finger segment 189—allowing for the shock-absorbing member to extend circumferentially along the sides of the ring finger segment but generally not extending onto the palmar surface of the ring finger segment.

This embodiment also has a shock-absorbing member along substantially the dorsal surface overlaying the metacarpals of the user's four fingers 222 when the glove is worn. The shock-absorbing member overlaying the four metacarpals is in the pattern of a rectangle 222, and is configured as aforementioned, such as a conventional padding material, such as foam rubber 222. The length and width of the shock-absorbing member of this embodiment is generally restricted to the dorsal portion of the glove overlaying the metacarpals of the hand, and therebetween, 223 in part or in their entirety.

Embodiments may also preferably comprise of a shock-absorbing member along any portion of the dorsal surface overlaying any of the carpometacarpals or wrist portion. The embodiment wrist portion also comprises a shock-absorbing member that protrudes on the dorsal segment 216 and 217, along the carpals about ½ inch or so. This will give the user added protection from the abrasion such as from hitting said fingers and wrist on the ground or while the quarterback rushes with the football.

As mentioned, the shock-absorbing member may be affixed to the glove by any standard methods of attachment, such as by stitching or adhesion. For example, it can be in the form of pouches or attachments to the glove and then bonding these second layers to the back of the glove, using heat sealing or other methods.

As illustrated, the the shock-absorbing members are integral with the material that form the glove, and may be applied to select areas of the glove by standard methods and forms of attachment methods such as, for example, by the dorsal segment comprising of a vinyl sheet material with a stretch nylon backing and the liner (or sleeve) 224 made of a knit of polyester. The liner is positioned along the inner surface of the dorsal segment of the glove whereby the padded layer or layers would be inserted and then sealed. The cushions may also be secured to the glove by conventional stitching.

The liner 224 can be interposed between the shock-absorbing member and the interior of the glove, and separates the shock-absorbing member from the user's hand, fingers, thumb and metacarpals, such as disclosed above, allowing easy insertion of the user's hand. Preferably, the liner is fixed to the dorsal segment interior using methods known in the art, such as stitching, to fix the shock-absorbing member to the glove. Padding can be interposed between the dorsal segment and the liner. The liner secures the shock-absorbing member between the user's hand the dorsal segment. Of course, other methods of attachment that are known in the art may be used, such as by chemical bonding.

The shock-absorbing members now give the user protection from the abrasion from hitting said fingers against the helmet of an opponent, for example. The shock-absorbing member of the present invention offer the unique ability of being able to protect an injury while maintaining grip capabilities in select areas by offering padded layer or layers, a significant and substantial advancement to prior art, such as bandages and BAND-AID, thus providing a solution to a long-felt need of being able to protect a quarterback's throwing hand. And as trend of quarterbacks now rushing more continues, embodiments with shock-absorbing members will undoubtedly prevent throwing hand injuries by now allowing users to play the position of quarterback with a glove on their throwing hand.

The paddings can be made of a neoprene material or of any other material aforementioned. The illustrated dorsal segment may be constructed of material aforementioned such as a thicker, more durable material, such as a synthetic leather for added protection comprising the dorsal portion 172 of the glove. The dorsal segment may be joined to the palmar segment 171, by methods known in the art such as by sewing, to form an opening for receiving the user's hand.

This embodiment has a second layer shock-absorbing member 501, 502,503,504 along a proximal phalanx dorsal surface overlaying the user's digital segment when the glove is worn. The shock-absorbing member overlaying the digital segment is in the pattern of a square 501, 502, 503, 504 and is comprises any material aforementioned, such as an open cell or closed cell foam 501, 502, 503, 504 such as BOLLARD foam material, for example. Other embodiments may prefer to offer additional separate padding segments, for example, with a second pad overlaying only the proximal phalanx and a third pad overlaying only a second phalanx of a digital segment.

The length of the second layer shock-absorbing member is further restricted to the length of the protrusion along the proximal phalanx on the digital segment. The shock-absorbing member may be square-like 501 or of any identifiable shape such as a heart 502, 503 or diamond 504, for example.

This embodiment has a second layer shock-absorbing member 505 along a dorsal surface overlaying a metacarpal of the user's hand when the glove is worn. The second shock-absorbing member layer overlaying the user's metacarpals is in the pattern of a square 505, and is comprises any material aforementioned, such as an open cell 505 or closed cell foam, such as BOLLARD foam material, for example. Other embodiments may prefer to offer additional separate padding segments, for example, with a second pad overlaying only one metacarpal, and a third shock absorbing member layer overlaying only an additional metacarpal of the user's hand when the glove is worn.

The length of the second layer shock-absorbing member is further restricted to the length of the protrusion 505 along the dorsal portion of the glove body dorsal portion. The shock-absorbing member may be square-like 505 or of any identifiable shape such as a heart or diamond, for example.

Figure 9:
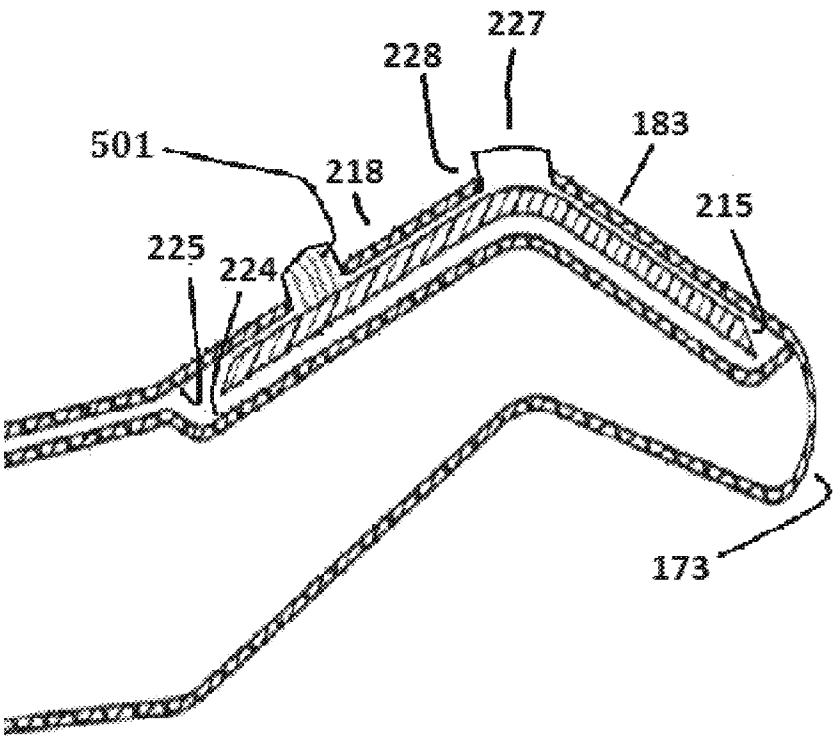
FIG. 9 is a cross-sectional view of FIG. 8, showing a liner and shock-absorbing members.

FIG. 9 is a cross-sectional view of FIGS. 7-8, showing the liner and protrusions. For example, the illustration shows a digital segment 173, whereby the shock-absorbing member 215 lies between the inner surface 225 of the dorsal segment of a digital segment 183 and the liner 224. The thickness of the shock-absorbing member can vary by user preference, such as about ¼ inch for example. The shock-absorbing member may be constructed with known material and those aforementioned, such as cotton, for example. Preferably, the liner is fixed to the dorsal segment interior using methods known in the art, such as stitching, to fix the shock-absorbing member to the glove.

This embodiment has a second layer shock-absorbing member 501, 502,503,504 along a proximal phalanx dorsal surface overlaying the user's digital segment when the glove is worn. The shock-absorbing member overlaying the digital segment is in the pattern of a square 501, 505 or of any identifiable shape such as a heart 502, 503 or diamond 504, for example and may comprise of any material aforementioned, such as an open cell or closed cell foam 501, such as BOLLARD foam material, for example. Other embodiments may prefer to offer additional separate padding segments, for example, with a second pad overlaying only the proximal phalanx, and a third pad overlaying only the distal phalanx of a digital segment.

The length of the second layer shock-absorbing member is further restricted to the length of the protrusion 501 along the proximal phalanx on digital segment, say about 0.20 inch or so for example, and other dimensions to snugly enclose the aforementioned pads.

Additionally, the embodiment is configured such that a second protrusion 227 exists on a digital segment 173, located over an interphalangeal joint 228 of the digital segment dorsal surface, such as over a proximal interphalangeal joint 228. This protrusion does not contain a second shock-absorbing member thus providing the user with added flexibility capabilities along the interphalangeal joint, especially beneficial if the dorsal segment is generally constructed with a more durable material, such as a leather latex glove. Also, the liner may be made of a fleece material 224 thus offering additional comfort and warmth for the user, especially useful during rainy conditions.

Referring now to FIG. 10 and FIG. 11, another embodiment of the athletic glove of the present invention is shown and designated as 230. The palmar (front) view of an embodiment is drawn in FIG. 10 and the dorsal (back) view of the same glove is drawn in FIG. 11. This partial-fingered embodiment provides a glove having a dorsal portion 232 and a palmar portion 231 for overlaying respective back and palm regions of a human hand, said dorsal and palmar portions having distal and proximal ends with a plurality of digital segments (or stalls) projecting from said distal ends. The glove includes a glove body having a back portion 232 covering the dorsal surface of a user's hand, and a front portion 231 covering essentially the entire palm surface of the hand when the glove is worn. The glove body includes a pinkie finger digital segment and a thumb digital segment each adapted to receive a pinkie finger and a thumb, respectively, therein.

In the illustrated embodiment the glove is constructed such that it includes a thumb digital segment 233 that completely encloses a user's thumb, including enclosing the fingertips, and a pinkie digital segment 234 that completely encloses the user's pinkie finger, including enclosing the fingertips when the glove is worn.

In addition, the glove has a forefinger digital segment 235 with a distal terminal edge 236. Said forefinger digital segment is adapted to extend to cover the proximal phalanx of the user's forefinger but does not extend to cover any portion of the user's distal phalanx when the glove is worn. In other words, the forefinger digital segment is adapted to expose the user's distal phalanx when the glove is worn such that the skin of the fingertip can touch a device or sports object, thereby allowing heightened tactile sensitivities along the fingertip and simultaneously enhancing grip capabilities along the covered proximal phalanx of the user's forefinger. In addition, the forefinger digital segment is adapted such that it does not cover any portion the user's middle phalanx, defining the forefinger digital segment of the glove and thereby exposing a majority of the finger when the glove is worn. Covering the proximal phalanx allows the user to maintain grip along the area where the proximal phalanx grips a golf club for example, while exposing the distal phalanx gives the user heightened tactile sensitivities along the area where the distal phalanx interlock with the opposing hand's pinkie finger, for example.

In addition, the glove has a middle finger digital segment 237 with a distal terminal edge 238. Said middle finger digital segment is adapted to extend to cover the proximal phalanx of the user's middle finger but does not cover any portion of the user's distal phalanx when the glove is worn. In other words, the middle finger digital segment is adapted to expose the user's distal phalanx when the glove is worn such that the skin of the fingertip can touch a device or sports object, thereby allowing heightened tactile sensitivities along the fingertip and simultaneously enhancing grip capabilities along the covered proximal phalanx of the user's middle finger. In addition, the middle finger digital segment is adapted such that it does not cover any portion the user's middle phalanx, defining the middle finger digital segment of the glove and thereby exposing a majority of the finger when the glove is worn. Covering the proximal phalanx allows the user to maintain grip along the area where the proximal phalanx grips a golf club for example, while exposing the distal phalanx gives the user heightened and new tactile sensitivities along the area where the middle finger distal phalanx touches and grips the shaft of the golf club.

In addition, the glove has a ring finger digital segment 239 with a distal terminal edge 240. Said ring finger digital segment is adapted to extend to cover the proximal phalanx of the user's ring finger but does not cover any portion of the user's distal phalanx when the glove is worn. In other words, the ring finger digital segment is adapted to expose the user's distal phalanx when the glove is worn such that the skin of the fingertip can touch a device or sports object, thereby allowing heightened tactile sensitivities along the fingertip and simultaneously enhancing grip capabilities along the covered proximal phalanx of the user's ring finger. In addition, the ring finger digital segment is adapted such that it does not cover any portion the user's middle phalanx, defining the ring finger digital segment of the glove and thereby exposing a majority of the finger when the glove is worn. Covering the proximal phalanx allows the user to maintain grip along the area where the proximal phalanx grips a golf club for example, while exposing the distal phalanx gives the user heightened and new tactile sensitivities along the area where the ring finger distal phalanx touches and grips the shaft of the golf club.

The palmar section also covers the palm segment 231 overlaying the palm of the hand; the dorsal section 232 also covers the back of the hand. The glove also has a wrist portion 251 that surrounds the wrist of the user. The thumb stall 233 is defined by a dorsal portion 242 and a palmar portion 241. The forefinger stall 235 is defined by a dorsal portion 244 and a palmar portion 243. The middle finger stall 237 is defined by a dorsal portion 246 and a palmar portion 245. The ring finger stall 239 is defined by a dorsal portion 248 and a palmar portion 247. The pinkie finger stall 234 is defined by a dorsal portion 250 and a palmar portion 249.

Furthermore, the forefinger segment distal terminal edge 236, the middle finger segment distal terminal edge 238, and the ring finger segment distal terminal edge 240 are each reinforced by stitching 252. Stitching the forefinger segment, the middle finger segment and the ring finger segment along or around the opening is important because the opening would otherwise easily tear, destroying the finger segments and therefore the glove, making the glove inoperable. Therefore the stitching 252 is adapted to encircle the entire distal terminal edges in order to be effective at preventing tearing along the forefinger terminal edge 336, the middle finger terminal edge 238 and the ring finger terminal edge 240.

Embodiments of the present invention may further comprise moisture management recesses for ventilation or moisture management purposes. These recesses can be circular in shape or in the shape of triangles 272. Additionally, some embodiments may provide moisture management recesses in the form of an identifiable human body part such as a plurality of hearts.

The wrist portion 251 is expansible so as to hold more securely to the user's wrist. Therefore the embodiment also has an expandable opening means 254 at a wrist end comprises an elastic material 254 along the wrist portion 251, such as an elastomeric band 254 fixed around throughout the wrist portion. In addition, the glove further comprises a securement opening means 255 at the open end of the glove body dorsal portion for fastening the glove body secure about the wrist area, critical in sports activities where the user's hand moves very rapidly such as in golf or football. The securement opening means 255 may include a hook and loop structure 255 whereby a strap 256 or flap is configured to loop around a receiving structure 257 with the glove body and may also include VELCRO fasteners 258, 359, buttons, and the like or other suitable closures thereon. The securement opening means comprising of a hook and loop structure allows the user to ensure an extremely tight fit around the user's hand so that it will not disengage from the user's hand during high velocity sport movements such as swinging a driving wood golf club or throwing a Hail Mary football pass. The securement opening means also allows the user to quickly engage and disengage the glove, important aspects during active sports play such as in golf and in football. The receiving structure 257 may be formed of any resilient and preferred nonelastic material such as a hard plastic 257 or metal such as aluminum, for example. The wrist portion further comprises a slit 271. The slit allows the user to quickly take off or put on the glove, and doing so very easily.

Providing a slit and securement opening means is especially valuable to users who play a sport that requires the constant removal of the glove, such as in football—where players generally take off their gloves during a change of possession, and golf—where virtually all players take off their glove when preparing to putt a golf ball. The securement opening means is adapted to allow the user to mechanically stretch the strap across the slit and fasten the glove to the user's hand.

This embodiment further shows how the present invention may also comprise a grip enhancing mechanism 260. Although the embodiment now provides a higher coefficient of friction on the throwing hand of a quarterback or on a golfer's dominant hand for example, one may now further increase grip areas by adding a grip enhancing mechanism on select areas.

The glove body may include a grip enhancing mechanism 260 comprising a plurality of depressions, a plurality of projections 270 or a tackifier 261 formed on select areas of the palmar portion, thereby creating a higher coefficient than on the rest of the glove body.

Formed on the illustrated glove is a plurality of projections 270 on a digital segment. These circular projections preferably are spaced apart to allow for added grip and flexibility.

The illustrated embodiment has a grip enhancing mechanism 270 on select areas of the front of the hand, specifically along the palmar portion of the pinkie finger digital segment 249. The grip enhancing mechanism 260 may comprise a plurality of oval-like projections 270, each having a height of at least about three hundred micrometers, and are clustered to allow for greater hand flexibility and movement while gripping a device or sports object.

In addition, the palmar portion of the thumb digital segment comprises a grip enhancing mechanism 260 comprising a discrete tackified material 261, such as impregnating a leather 261 with a tackifier resin 261 and then affixing said material onto the rest of the palmar portion of the glove body. This particular configuration provides for maximum grip capabilities for a user, such as a football quarterback. As aforementioned, the quarterback's thumb is not supported by the laces of the football and can therefore slip during harsh weather conditions or when the quarterback is under sudden duress and has to run to avoid being sacked. The glove body palmar portion further comprises of a tackified material 262 that extends to overlay at least a portion of the metacarpophalangeal joint 263 of the user's forefinger when the glove is worn.

The grip enhancing mechanism formed of these tackfied materials integral to the glove body or formed of tackified grip enhancing panels, are preferably configured to provide a significantly higher coefficient of friction, preferably of at least a Shore A Durometer Coefficient of Friction of between 2.0 and 4.5; Still more preferably a Shore A Durometer Coefficient of Friction of between 2.5 and 4.5.

As aforementioned, the grip enhancing mechanism comprising of tackifiers may include tackifier resins, such as rosins and their derivatives, terpenes, aliphatic, cycloaliphatic and aromatic resin, and any of a variety of hydrocarbon-type resins, tackifier coatings, tackified materials such tackified leathers and synthetic leathers, and other tackifier substances well commercially known in the art.

Additionally, embodiments such as this one, may be completely coated with a with a water repellant substance 264 such as SCOTCH GUARD 264 throughout the glove surface.

It is commonly known that wrist bands have been constructed with perspiration absorbing capabilities, allowing an athlete to wipe perspiration away from their face during competition. Where wrist bands are not commonly used, such as in golf play, the athletes are currently left deficient in this area unless they are handed a towel to wipe off the perspiration. As such, a moisture absorbent material 457 can be provided along the dorsal portion of embodiments allowing a wearer to wipe off perspiration commonly on a wearer's face during active sports play. The moisture absorbent material may be secured anywhere along the dorsal surface of the glove body. The moisture absorbent material may be formed of any moisture absorbent material aforementioned, such as, for example, about 1/12 inch terry cloth or absorbent foam 458 stitched onto the dorsal portion surface of the glove body.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example. One could use any standard method of manufacture and assembly or construction.

The embodiment is suitably a substantially conventionally constructed sports glove, modified as aforementioned. This particular glove can be made of a polyester and cotton blend for superior comfort or of a synthetic leather latex coated glove for added durability. Other materials that could comprise these glove embodiments include, but are not limited to woven materials that include natural, synthetic or blends of natural and synthetic yarns, thermoextruded or thermoset rubbery embodiments including those made from thermoplastic elastomers, and cloths. Examples of synthetic yarns include nylon, polyester, and spandex (polyurethane) yarns. Additionally, embodiments such as this one, may be coated with a with a water repellant substance, such as a synthetic resin throughout the entire outer surface of the glove.

FIG. 12 is an illustration of a user gripping a golf club using the conventional interlocking grip method 400.

As aforementioned, the present invention provides users with several important benefits, in multiple sports. For example, those playing the sport of golf may use this embodiment on their weak hand thereby allowing the golfer significantly more grip capabilities while simultaneously being able to have heightened tactile abilities at the same time on key areas of the interlocked—and partially uncovered—forefinger 402. As discussed, the unique digital segment configuration creates synergistic effects. By fully enclosing the user's thumb segment 403 the embodiment maintains critical grip along the user's thumb, essential for a proper golf swing. The fully enclosed thumb also protects the thumb from abrasion especially during the golf down swing. Exposing the thumb would cause the user harm and quite possible make the glove inoperable for use in golf. Equally important is a fully enclosed pinkie finger. The pinkie finger is at the bottom of the shaft and is responsible for minimizing movement by the shaft during the golf downswing. Therefore, it is important that the pinkie finger be enclosed 404 and prevent abrasion. The enclosed pinkie finger also ensures solid grip at one end of the golf grip while enclosing the thumb ensures solid grip at the other end of the weak hand.

When you use the interlocking grip method, the forefinger 405 of the golfer's weak-hand is placed over his dominant hand and is interlocked with the dominant hand's pinkie finger 406. With this grip, clearly the role of the weak-hand's forefinger has to do with grip but also much more with coordination and feel on the strong-hand to more effectively control the golf swing and to provide greater golf swing consistency. There is, therefore, no real need to cover all of the weak-hand's forefinger, and covering the entire forefinger actually diminishes said forefinger's sensitivities.

Currently, only full-fingered gloves are used by golfers on their weak-hand. Prior art gloves therefore do not allow a golfer to take complete advantage of his/her preferred grip by allowing for skin contact between both hands and thereby maximizing hand coordination throughout the golf swing. Embodiments of the present invention offer significant improvements to prior art by its unique finger configuration.

For example, the present invention comprises a glove that covers all of the weak-hands thumb and pinkie finger while leaving the fingertips of the middle, ring and forefinger uncovered such that the skin of each fingertip 407, 408, 402 can touch an object. Users who prefer the interlocking grip method will greatly benefit from significantly increased feel between the now uncovered portion of the interlocked forefinger of the gloved weak hand with the ungloved and interlocked pinkie finger of the strong hand. Using the present invention also allows a user to place their completely enclosed thumb and covered portions of their middle finger, ring finger and pinkie finger directly on and touching the golf club to maintain a solid grip by the glove embodiment, while being able to substantially increase tactile abilities by leaving the fingertips of the user's middle finger and ring finger when the glove is worn. This and other embodiments now allow far greater feel and coordination lost with prior art especially when gripping a golf club using the conventional interlocking grip. The interlocked fingers now allow for far better feedback because both interlocked fingers are now to make skin-to-skin contact, making it easier to adjust a golf swing. Users who prefer this embodiment will greatly benefit from maximum feel between the completely uncovered interlocked fingers of both hands. Exposing the fingertips of the middle and ring fingers are therefore very important to the creation of synergies, in particular for those playing golf using the interlocking grip method, for example. And to those golfers, exposing the fingertip of the forefinger is a critical feature, and is an essential aspect of the present invention and in achieving synergies in: the ability to offer greater golf consistency and accuracy by solving this previously unsolvable problem in prior art; a far more successfully coordinated golf swing; and heightened feel capabilities for better feedback if the golf club inappropriately moves during a golf swing. Additionally, the user's thumb must be completely covered to protect the user from abrasion from the golf club when using the interlocking grip method. Exposing the fingertip of the user's thumb for example would essentially make the glove inoperable. Using this embodiment will allow a user to maximize feel with both hands not just with only the standard ungloved dominant hand, a far superior option than by using the prior art 409.

FIG. 13 is an illustration of a standard way of gripping a football when preparing the throw a football 410. The illustration is provided on the webpage wikihow.com/Throw-a-spiral which shows a conventional way to hold and throw a football where you place your middle finger 411 and ring finger 412 on top of the football laces 413, your Index [forefinger] finger 414 on the strap at one end of the top portion of the football and away from the laces, and your pinkie finger 415 at the other end of the top portion of the football and also away from the laces 413.

Finally your thumb 416 is placed on the bottom side of the football and is the only digital segment on the bottom side of the football.

Whereas the middle and ring fingers over the laces have a solid grip on the ball—primarily due to the football laces on the ball—the three digital segments off the laces (thumb, forefinger and pinkie finger) are virtually unsupported and therefore have a relatively weaker grip, creating a weak overall grip on the football. This weak overall grip becomes more pronounced when added stress is placed on the thumb or forefinger which is not able to use any portion of the football laces when gripping the football. Unfortunately, one need only view the statistics to see that fumbles persist as an insoluble problem, even at the professional level today. In the 2010 National Football League (NFL) season, there were only ten players who had 9 or more fumbles in the season. All ten players were quarterbacks (The Official NFL Record & Fact Book, 2011). It is therefore essential that the thumb and pinkie finger of the user's hand be supported by fully enclosing said digital segments with the glove and thereby provide necessary and critical grip capabilities. At the same time, at least the fingertips of the user's middle finger and ring finger must be exposed so that it will not be encumbered and able to fit snugly between and on top of the football laces as well as to provide necessary heightened tactile sensitivities with these fingers.

FIG. 14 is a replication of a recent ad 420 promoting the Nov. 1, 2018 NFL game of the evening between the Oakland Raiders and the San Francisco 49ers. Illustrated is prima facie evidence of a standard method of a standard method of gripping a football when preparing to throw the football. Shown is the Oakland Raiders Quarterback Derek Carr's 421 glove-less throwing hand which has his middle finger 423 and ring finger 424 on top of the football laces 425 while his thumb, forefinger 426 and pinkie finger 427 are holding the football as best they can.

As has been discussed using embodiments of the present invention now allow a football quarterback, for example, to place the throwing hand's thumb and pinkie finger—now covered by the present invention glove—on the football and significantly increasing the grip and control of the football while simultaneously maintaining maximum tactile abilities by leaving uncovered the fingertips of his forefinger, middle finger, and ring finger. This unique digital segment configuration allows the quarterback the ability to place the exposed fingertips of the user's forefinger, middle finger, and ring finger over the football laces unencumbered while simultaneously maintaining significant feel on the football. This and other features now essentially make the sports glove more operable, novel and significantly superior to prior art in these areas.

Referring now to FIG. 15, FIG. 16 & FIG. 17, an embodiment of the present invention is shown and designated as 500. The palmar view of a glove is drawn in FIG. 15 and the dorsal view of the same glove is drawn in FIG. 16 & FIG. 17. This partial-fingered embodiment provides a glove having a dorsal portion 511, a palmar portion 512 for overlaying respective back and palm regions of a human hand, said dorsal and palmar portions having distal and proximal ends with a plurality of digital segments (or stalls) projecting from said distal ends. The glove includes a glove body having a back (dorsal) portion covering the back of the hand, and a front (palmar) portion covering the palm or front of the hand when the glove is worn.

In the illustrated embodiment the glove comprises a palmar portion 512 and a dorsal portion 511 for overlaying a respective back and palm region of a human hand when the glove is worn. The palmar portion and the dorsal portion each have a distal end and a proximal end. The glove also has a plurality of digital segments that project out from both the distal end of the palmar portion and the distal end of the dorsal portion. The plurality of digital segments include a thumb digital segment 513 that is adapted to completely enclose a thumb including a fingertip 514 of the thumb and a pinkie finger digital segment 515 that is adapted to completely enclose a pinkie finger including a fingertip 516 of the pinkie finger when the glove is worn. As aforementioned, also critical in the glove construction of the present invention is that it also has a plurality of intermediate digital segments laterally between the thumb digital segment and the pinkie finger digital segment, wherein all of the plurality of intermediate digital segments 517, 523, 529 are adapted to overlay proximal phalanxes of respective fingers and leave fingertips of the respective fingers exposed when the glove is worn.

The glove has a forefinger digital segment 517 with a distal terminal edge 518. Said forefinger digital segment has a middle portion 519 that is adapted to extend to overlay the middle phalanx and a proximal portion 520 that is adapted to extend to overlay the proximal phalanx of the user's forefinger but does not cover the fingertip of the forefinger when the glove is worn. In other words, the forefinger digital segment is adapted to expose the distal phalanx when the glove is worn, thereby allowing heightened tactile sensitivities along the fingertip which extends beyond the distal terminal edge such that the skin of the fingertip can touch a device or sports object, while simultaneously enhancing grip capabilities along the covered portions of the proximal and middle phalanges of the user's forefinger when the glove is worn. Covering portions of the proximal phalanx allows the user to maintain grip along the area where the proximal phalanx grips a golf club for example, while exposing the distal phalanx gives the user heightened flexibility and less constriction along the area where the distal phalanx interlock with the opposing hand's pinkie finger, for example.

In addition, the glove has a middle finger digital segment 523 with a distal terminal edge 524. Said middle finger digital segment has a middle portion that is adapted to extend to cover the middle phalanx and a proximal portion that is adapted to extend to cover the proximal phalanx of the user's middle finger but does not cover the fingertip of the middle finger when the glove is worn. In other words, the middle finger digital segment is adapted to expose a significant portion of the user's distal phalanx when the glove is worn, thereby allowing heightened flexibility and less constriction along the fingertip which extends beyond the distal terminal edge such that the skin of the fingertip can touch a device or sports object, while simultaneously enhancing grip capabilities along the covered portion of the proximal phalanx of the user's middle finger.

In addition, the glove has a ring finger digital segment 529 with a distal terminal edge 530. Said ring finger digital segment has a middle portion that is adapted to extend to cover the middle phalanx and a proximal portion that is adapted to extend to cover the entire proximal phalanx of the user's ring finger but does not cover the fingertip of the ring finger when the glove is worn, defining the ring finger segment. In other words, the ring finger digital segment is adapted to expose a significant portion of the user's distal phalanx when the glove is worn, thereby allowing heightened flexibility and less constriction along the fingertip which extends beyond the distal terminal edge such that the skin of the fingertip can touch a device or sports object, while simultaneously enhancing grip capabilities along the covered proximal phalanx of the user's ring finger.

The palmar portion of the glove body also covers the palm segment overlaying the palm of the hand; the dorsal portion of the glove body also covers the back of the user's hand when the glove is worn. The glove also has a wrist portion 533 that surrounds the wrist of the user.

The thumb stall is defined by a dorsal portion 534 and a palmar portion 535. The forefinger stall is defined by a dorsal portion 536, a palmar portion 537, a first side adjacent the thumb stall and a second side opposite the first side and adjacent the middle finger stall. The middle finger stall is defined by a dorsal portion and a palmar portion. The ring finger stall is defined by a dorsal portion 544 and a palmar portion 545. The pinkie finger stall is defined by a dorsal portion 546 and a palmar portion 547.

The wrist portion 533 is expansible so as to hold more securely to the user's wrist. Therefore the embodiment also has an expandable opening means at a wrist end comprises an elastic material 552 along the wrist portion, such as an elastomeric band fixed around throughout the wrist portion. In addition, the glove further comprises a securement opening means at the open end of the glove body dorsal portion for fastening the glove body secure about the wrist area, critical in sports activities where the user's hand moves very rapidly such as in golf or football. The securement opening means may be unitary with the glove body and may include strap 554 and strap capture mechanism such as VELCRO fasteners 555, 556, buttons, and the like or other suitable closures thereon. The securement opening means allows the user to ensure a tight fit around the user's hand so that it will not disengage from the user's hand during high velocity sport movements such as swinging a driving wood golf club or throwing a Hail Mary football pass. The securement opening means also allows the user to quickly engage and disengage the glove, important aspects during active sports play such as in golf and in football. The wrist portion further comprises a slit 557. The slit allows the user to quickly take off or put on the glove, and doing so very easily.

Providing a slit and securement opening means is especially valuable to users who play a sport that requires the constant removal of the glove, such as in football—where players generally take off their gloves during a change of possession, and golf—where virtually all players take off their glove when preparing to putt a golf ball. The securement opening means is adapted to allow the user to mechanically stretch the securement opening means, such as a strap across the slit and fasten the glove to the user's hand.

Additionally, embodiments may offer a liner 558 in the interior of the glove using methods known in the art, such as stitching. The liner may be integrally formed on the glove. For example, the liner (or sleeve) could be attached to the glove by standard methods, such as by conventional stitching about the perimeter of the dorsal segment, the palmar segment or both.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing in harsher conditions or during extended practices on the golf range, for example. The liner may be infused with Aloe Vera 561.

It is commonly known that wrist bands have been constructed with perspiration absorbing capabilities, allowing an athlete to wipe perspiration away from their face during competition. Where wrist bands are not commonly used, such as in golf play, the athletes are currently left deficient in this area unless they are handed a towel to wipe off the perspiration. As such, a moisture absorbent material 457 can be provided along the dorsal portion of embodiments allowing a wearer to wipe off perspiration commonly on a wearer's face during active sports play. The moisture absorbent material may be secured anywhere along the dorsal surface of the glove body. The moisture absorbent material may be formed of any moisture absorbent material aforementioned, such as, for example, about 1/12 inch terry cloth 458 or absorbent foam stitched onto the dorsal portion surface of the glove body.

The palmar and dorsal surfaces, and any wrist portions, may then for example be conjoined on any finger and thumb portions, dorsal and palm portions and a wrist portion using any standard methods, such as by stitching, thus defining a pocket for receiving a user's hand.

The illustrated embodiment further comprises a pouch 562 positioned along the glove body dorsal portion. The pouch is secured by a securement mechanism 563, such as by snap fastening, hook-and-loop, or stitching. The pouch overlays the metacarpals of the wearer's middle finger & ring finger, and preferably also the forefinger & pinkie finger when the glove is worn. The pouch is constructed such that the wearer can place and secure items inside 564 of it such as golf items, keys or a snack. As such, the pouch has an exterior surface 565, an interior surface 566, an exterior edge and interior edge forming a lip 567, and a flap 569 that the wearer is able to manually over the lip to thereby open and close the pouch. The pouch interior thus creates a compartment for securing items onto the glove. The pouch flap has an interior surface 570 that can be manually secured to the pouch by any standard means, such as by snap buttons 571. The pouch lip may also be manually engaged by zippers of course. The pouch interior thus creates a compartment for securing items onto the glove. In other words, the pouch comprises of a lip at a proximal end which may open and close and a permanently closed distal end, thus creating a compartment.

The pouch securement to the glove body is reinforced by a second securement mechanism 572. As aforementioned, sport gloves often require the high velocity movement of the wearer's hands. While the first pouch securement mechanism 563 secures the pouch to the glove body, the second securement mechanism 572 is positioned to reinforce the pouch on the glove body as well as to minimize movement of the pouch during active sports play such as when swinging a golf club. The second securement mechanism formed of a strap 573 that can extend across the entire pouch exterior surface 565 and secured by any standard methods such as by a hook-and-loop structure such as by using VELCRO 574, 575. The back surface 576 of the pouch flap preferably has a second material 577 extending out creating an opening 578 such that the wearer can move the strap 573 through the opening to significantly limit movement of the pouch during active sport activities.

Referring now to FIG. 18, FIG. 19 & FIG. 20, an embodiment of the present invention is shown and designated as 600. The palmar view of a glove is drawn in FIG. 18 and the dorsal view of the same glove is drawn in FIG. 19 & FIG. 20. This partial-fingered embodiment provides a glove having a dorsal portion 611, a palmar portion 612 for overlaying respective back and palm regions of a human hand, said dorsal and palmar portions having distal and proximal ends with a plurality of digital segments (or stalls) projecting from said distal ends. The glove includes a glove body having a back (dorsal) portion covering the back of the hand, and a front (palmar) portion covering the palm or front of the hand when the glove is worn.

In the illustrated embodiment the glove comprises a palmar portion 612 and a dorsal portion 611 for overlaying a respective back and palm region of a human hand when the glove is worn. The palmar portion and the dorsal portion each have a distal end and a proximal end. The glove also has a plurality of digital segments that project out from both the distal end of the palmar portion and the distal end of the dorsal portion. The plurality of digital segments include a thumb digital segment 613 that is adapted to completely enclose a thumb including a fingertip 614 of the thumb and a pinkie finger digital segment 615 that is adapted to completely enclose a pinkie finger including a fingertip 616 of the pinkie finger when the glove is worn. As aforementioned, also critical in the glove construction of the present invention is that it also has a plurality of intermediate digital segments laterally between the thumb digital segment and the pinkie finger digital segment, wherein all of the plurality of intermediate digital segments 617, 623, 629 are adapted to overlay proximal phalanxes of respective fingers and leave fingertips of the respective fingers exposed when the glove is worn.

The glove has a forefinger digital segment 617 with a distal terminal edge 618. Said forefinger digital segment has a middle portion 619 that is adapted to extend to overlay the middle phalanx and a proximal portion that is adapted to extend to overlay the proximal phalanx of the user's forefinger but does not cover the fingertip of the forefinger when the glove is worn. In other words, the forefinger digital segment is adapted to expose the distal phalanx when the glove is worn, thereby allowing heightened tactile sensitivities along the fingertip which extends beyond the distal terminal edge such that the skin of the fingertip can touch a device or sports object, while simultaneously enhancing grip capabilities along the covered portions of the proximal and middle phalanges of the user's forefinger when the glove is worn. Covering portions of the proximal phalanx allows the user to maintain grip along the area where the proximal phalanx grips a golf club for example, while exposing the distal phalanx gives the user heightened flexibility and less constriction along the area where the distal phalanx interlock with the opposing hand's pinkie finger, for example.

In addition, the glove has a middle finger digital segment 623 with a distal terminal edge 624. Said middle finger digital segment has a middle portion that is adapted to extend to cover the middle phalanx and a proximal portion that is adapted to extend to cover the proximal phalanx of the user's middle finger but does not cover the fingertip 625 of the middle finger when the glove is worn. In other words, the middle finger digital segment is adapted to expose a significant portion of the user's distal phalanx when the glove is worn, thereby allowing heightened flexibility and less constriction along the fingertip which extends beyond the distal terminal edge such that the skin of the fingertip can touch a device or sports object, while simultaneously enhancing grip capabilities along the covered portion of the proximal phalanx of the user's middle finger.

In addition, the glove has a ring finger digital segment 629 with a distal terminal edge 630. Said ring finger digital segment has a middle portion 631 that is adapted to extend to cover the middle phalanx and a proximal portion 632 that is adapted to extend to cover the entire proximal phalanx of the user's ring finger but does not cover the fingertip of the ring finger when the glove is worn, defining the ring finger segment. In other words, the ring finger digital segment is adapted to expose a significant portion of the user's distal phalanx when the glove is worn, thereby allowing heightened flexibility and less constriction along the fingertip which extends beyond the distal terminal edge such that the skin of the fingertip can touch a device or sports object, while simultaneously enhancing grip capabilities along the covered proximal phalanx of the user's ring finger.

The palmar portion of the glove body also covers the palm segment overlaying the palm of the hand; the dorsal portion of the glove body also covers the back of the user's hand when the glove is worn. The glove also has a wrist portion 633 that surrounds the wrist of the user.

The thumb stall is defined by a dorsal portion 634 and a palmar portion 635. The forefinger stall is defined by a dorsal portion and a palmar portion. The middle finger stall is defined by a dorsal portion and a palmar portion. The ring finger stall is defined by a dorsal portion and a palmar portion. The pinkie finger stall is defined by a dorsal portion 646 and a palmar portion 647.

The finger stall edges 618, 624, 630 are either stitched or hot sealed, depending on preference and type of material used, to prevent moisture from entering the glove body and eroding the material. Stitching or hot sealing also prevents the material from tearing.

This embodiment further shows how the present invention may comprise a grip enhancing mechanism 685 and thereby provide a higher coefficient of friction on select areas of the glove palmar surface.

In the illustrated embodiment, the glove palmar portion further comprises of a grip enhancing mechanism comprised of a discrete tackified material 686 along the thumb stall palmar portion such as by embedded a leather or synthetic leather with a tackifier resin 80 and then affixing said material onto a tackified-free thumb stall dorsal portion. This particular configuration provides for maximum grip capabilities for a user, such as a golfer.

The wrist portion 633 is expansible so as to hold more securely to the user's wrist. Therefore the embodiment also has an expandable opening means at a wrist end comprises an elastic material along the wrist portion, such as an elastomeric band 653 fixed around throughout the wrist portion. In addition, the glove further comprises a securement opening means 654 at the open end of the glove body dorsal portion for fastening the glove body secure about the wrist area, critical in sports activities where the user's hand moves very rapidly such as in golf or football. The securement opening means may be unitary with the glove body and may include strap 654 and strap capture mechanism such as VELCRO fasteners 655, 656, buttons, and the like or other suitable closures thereon. The securement opening means allows the user to ensure a tight fit around the user's hand so that it will not disengage from the user's hand during high velocity sport movements such as swinging a driving wood golf club or throwing a Hail Mary football pass. The securement opening means also allows the user to quickly engage and disengage the glove, important aspects during active sports play such as in golf and in football. The wrist portion further comprises a slit 657. The slit allows the user to quickly take off or put on the glove, and doing so very easily.

Providing a slit and securement opening means is especially valuable to users who play a sport that requires the constant removal of the glove, such as in football—where players generally take off their gloves during a change of possession, and golf—where virtually all players take off their glove when preparing to putt a golf ball. The securement opening means is adapted to allow the user to mechanically stretch the securement opening means, such as a strap across the slit and fasten the glove to the user's hand.

Additionally, embodiments may offer a liner 658 in the interior of the glove using methods known in the art, such as stitching. The liner may be integrally formed on the glove. For example, the liner (or sleeve) could be attached to the glove by standard methods, such as by conventional stitching about the perimeter of the dorsal segment, the palmar segment or both.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing in harsher conditions or during extended practices on the golf range, for example. The liner may be infused with Aloe Vera 661.

A plurality of moisture management recesses may be randomly disposed throughout the front and back of the glove body and on any finger and thumb stalls of the glove, such as on the pinkie finger stall, thereby providing added comfort and more ventilation. These recesses are shaped as triangles or circles.

It is commonly known that wrist bands have been constructed with perspiration absorbing capabilities, allowing an athlete to wipe perspiration away from their face during competition. Where wrist bands are not commonly used, such as in golf play, the athletes are currently left deficient in this area unless they are handed a towel to wipe off the perspiration. As such, a moisture absorbent material 457 can be provided along the dorsal portion of embodiments allowing a wearer to wipe off perspiration commonly on a wearer's face during active sports play. The moisture absorbent material may be secured anywhere along the dorsal surface of the glove body. The moisture absorbent material may be formed of any moisture absorbent material aforementioned, such as, for example, about 1/12 inch terry cloth 458 or absorbent foam stitched onto the dorsal portion surface of the glove body.

The palmar and dorsal surfaces, and any wrist portions, may then for example be conjoined on any finger and thumb portions, dorsal and palm portions and a wrist portion using any standard methods, such as by stitching, thus defining a pocket for receiving a user's hand.

The illustrated embodiment further comprises a pouch 662 positioned along the glove body dorsal portion. The pouch is secured to the glove by a detachable pouch securement mechanism, such as by snap fastening or hook-and-loop fasteners 663, 668 thereby making the pouch detachable from the glove. The pouch overlays the metacarpals of the wearer's middle finger & ring finger, and preferably also the forefinger & pinkie finger when the glove is worn. The pouch is constructed such that the wearer can place and secure items inside 664 of it such as golf items, keys or even a liquid snack. As such, the pouch has an exterior surface 665, an interior surface 666 that is preferably water proof, an exterior edge and interior edge forming a lip 667, and a flap 669 that the wearer is able to manually over the lip to thereby open and close the pouch. The pouch interior thus creates a compartment for securing items onto the glove. In other words, the pouch comprises of a lip at a proximal end which may open and close and a permanently closed distal end, thus creating a compartment.

The pouch flap has an interior surface 670 that can be manually secured to the pouch by any standard means, such as by snap buttons 671. The securement of pouch lip may also be manually reinforced by zippers 680.

The detachability of the pouch from the glove body provides several important added benefits to the wearer. For example, washing sport gloves will often start to diminish the tackiness of the palm side, tackiness being important in sports play like golf which requires firmly gripping a sports device such as a golf club. By detaching the pouch from the glove, the wearer can now wash the outside and inside of the pouch without having to also wash and diminish the glove. The pouch exterior is preferably coated with a water repellant so to better protect the material forming the pouch during washing.

By detaching the pouch the wearer can now even replace the pouch with a different pouch. Especially in golf today, more and more golfers are seeking to color-coordinate their look to make them feel better, build more confidence, and to just more fully enjoy the game. A glove with a detachable pouch allows the wearer to further color-coordinate their outfits by attaching the appropriate colored pouch onto what is often an otherwise white or black golf glove.

As aforementioned, the first pouch securement mechanism is constructed such that the pouch is detachable from the glove but is also reliably secures the pouch to the glove body. Such as, for example, the dorsal surface of the glove body may comprise of connecting pouch securement mechanism such as hook-and loop fasteners 663, such as VELCRO or snap buttons for example. The bottom surface of the pouch therefore has the recipient VELCRO or button fastener to manually attach and detach the pouch to the glove body.

We claim:

1. A method of swinging a golf club using a conventional interlocking grip method, comprising the following steps:

a. Providing a sport means comprising a partially open hand cover, where said cover is a glove having connected back and palmar portions for protecting respective back and palmar areas of the human hand, the back and palmar portions having distal and proximal ends with a plurality of digital segments projecting from the distal ends, wherein the digital segment of the thumb overlays an entire thumb including the fingertip of said thumb, wherein the digital segment of the pinkie finger overlays an entire pinkie finger including the fingertip of said pinkie finger, wherein the digital segment of the forefinger overlays an entire proximal phalanx and leaves exposed a distal phalanx and a middle phalanx, wherein the digital segment of the middle finger overlays an entire middle finger proximal phalanx and leaves exposed a distal phalanx and a middle phalanx, wherein the digital segment of the ring finger overlays an entire proximal phalanx and leaves exposed a distal phalanx and a middle phalanx, wherein the glove back portion further comprises a moisture absorbent terry cloth material stitched on said glove back portion and is adapted to enable the wearer to wipe off perspiration commonly on a wearer's face during active sports play;

b. Placing said glove on a weak hand;

c. Interlocking a wearer's forefinger of the gloved weak hand with a pinkie finger of an ungloved strong hand enabling skin-to-skin contact between the forefinger of the weak hand and the pinkie finger of the strong hand;

d. Gripping the golf club using both hands using the conventional interlocking grip method;

e. swinging the golf club.

2. The method of claim 1, wherein the glove palmar portion comprises a grip enhancing mechanism.

3. The method of claim 1, wherein the glove body dorsal surface comprises micro recesses in the shape of triangles.

4. The method of claim 1, wherein the thumb digital segment comprises a grip enhancing mechanism comprising a tackified leather.

5. The method of claim 1, wherein the steps comprise:

f. Using tactile sensitivities between the uncovered interlocked forefinger and pinkie finger to determine whether the weak hand and the strong hand separated from each other during the golf club down swing.

6. The method of claim 1, wherein the steps comprise:

f. Using tactile sensitivities between the uncovered interlocked forefinger and pinkie finger to determine whether the weak hand and the strong hand separated from each other during the golf club down swing;

g. Verifying the accuracy of consistency in swinging the golf club in a unified manner by determining if a golf ball was hit square at impact during the golf club down swing.

7. The method of claim 1, wherein the steps comprise:

f. Using tactile sensitivities between the uncovered interlocked forefinger and pinkie finger to determine whether the weak hand and the strong hand separated from each other during the golf club down swing;

g. Verifying the accuracy of consistency in swinging the golf club in a unified manner by determining if a golf ball was hit square at impact during the golf club down swing;

h. Repeating steps b-g until a unified golf swing has been ascertained as determined by feedback from tactile sensitivities between the interlocked fingers as well as by golf ball impact in step f.

* * * * *